US012421688B2

(12) United States Patent
Omae et al.

(10) Patent No.: US 12,421,688 B2
(45) Date of Patent: Sep. 23, 2025

(54) WORK VEHICLE, METHOD FOR CONTROLLING WORK VEHICLE, AND CONTROLLER FOR WORK VEHICLE

(71) Applicant: KUBOTA CORPORATION, Osaka (JP)

(72) Inventors: Ken Omae, Sakai (JP); Ryuki Nishimoto, Sakai (JP); Ken Uno, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/884,118

(22) Filed: Sep. 13, 2024

(65) Prior Publication Data

US 2025/0084611 A1 Mar. 13, 2025

(30) Foreign Application Priority Data

Sep. 13, 2023 (JP) ..... 2023-148801

(51) Int. Cl.
*E02F 3/43* (2006.01)
*E02F 9/22* (2006.01)
*E02F 9/26* (2006.01)

(52) U.S. Cl.
CPC ..... *E02F 3/439* (2013.01); *E02F 9/2285* (2013.01); *E02F 9/265* (2013.01)

(58) Field of Classification Search
CPC ..... E02F 3/437; E02F 9/2285; E02F 3/439
See application file for complete search history.

(56) References Cited

U.S. PATENT DOCUMENTS

| | | | | |
|---|---|---|---|---|
| 7,894,962 | B2 * | 2/2011 | Sahlin | E02F 3/847 701/50 |
| 11,655,615 | B1 | 5/2023 | Abe et al. | |
| 2018/0305902 | A1 * | 10/2018 | Tsukamoto | E02F 3/439 |
| 2019/0218744 | A1 * | 7/2019 | Izumikawa | E02F 3/425 |
| 2021/0115643 | A1 * | 4/2021 | Tanaka | B60K 35/00 |

FOREIGN PATENT DOCUMENTS

| | | |
|---|---|---|
| JP | 07-509294 | 10/1995 |
| JP | 6919479 B2 | 4/2019 |
| JP | 2023-115701 | 8/2023 |
| WO | WO94/26988 | 11/1994 |

* cited by examiner

*Primary Examiner* — Abiy Teka
(74) *Attorney, Agent, or Firm* — MORI & WARD, LLP

(57) ABSTRACT

A work vehicle includes a processor configured to: calculate a first posture parameter representing a start arm height and a second posture parameter representing a start implement direction; acquire a first reference parameter that is a second posture parameter associated with the first posture parameter representing the start arm height in first relational data; obtain a measurement value of the arm height; acquire a second reference parameter that is a second posture parameter associated with the first posture parameter representing the measurement value in the first relational data; determine a target direction when the arm height is the measurement value such that a difference between the second posture parameter representing the target direction and the second posture parameter representing the start implement direction is equal to a difference between the second reference parameter and the first reference parameter; and control such that the implement direction approaches the target direction.

21 Claims, 20 Drawing Sheets

25 (20)

WORK VEHICLE, METHOD FOR CONTROLLING WORK VEHICLE, AND CONTROLLER FOR WORK VEHICLE

CROSS-REFERENCE TO RELATED APPLICATIONS

The present application claims priority under 35 U. S. C. § 119 to Japanese Patent Application No. 2023-148801, filed Sep. 13, 2023. The contents of this application are incorporated herein by reference in their entirety.

BACKGROUND

Technical Field

The present disclosure relates to a work vehicle, a method for controlling the work vehicle, and a controller for the work vehicle.

Discussion of the Background

International Publication No. WO94/26,988 discloses horizontal control of a bucket for keeping the attitude of the bucket with respect to the ground unchanged even when the position of the bucket is changed by an arm in response to an instruction to change the posture of the bucket or the arm electrically input by a joystick. U.S. Pat. No. 11,655,615 discloses a technique of performing the above-described horizontal control by controlling a hydraulic circuit so as to send a part of hydraulic fluid discharged from an arm cylinder to a bucket cylinder in response to an instruction to change the posture of the bucket or the arm input by an operation valve.

SUMMARY

According to one aspect of the present disclosure, a work vehicle includes an implement, an arm, a vehicle body, a traveling device, a first hydraulic cylinder, a second hydraulic cylinder, a second hydraulic cylinder, a hydraulic pump, an engine, a rotational speed sensor, a first control valve, an arm posture detection sensor, an implement posture detection sensor, a memory, a processor, a first input device, and a second input device. The implement includes a joint and an implement tip which is opposite to the joint. The arm includes an arm distal end including the joint and configured to swingably support the implement. The arm proximal end is opposite to the arm distal end. The vehicle body is configured to swingably support the arm proximal end. The traveling device is configured to move the vehicle body. The first hydraulic cylinder has a first oil chamber and a second oil chamber and is configured to control an implement direction from the joint toward the implement tip. The first hydraulic cylinder is configured to take a first status and a second status alternatively. The first oil chamber is a first oil supplied chamber, and the second oil chamber is a first oil discharged chamber in the first status. The first oil chamber is the first oil discharged chamber, and the second oil chamber is the first oil supplied chamber in the second status. Hydraulic fluid is supplied to the first oil supplied chamber. Hydraulic fluid is discharged from the first oil discharged chamber. The second hydraulic cylinder is configured to control an arm height which is a height of the arm distal end with respect to a ground contact surface of the traveling device in a height direction perpendicular to a traveling direction of the traveling device. The hydraulic pump is configured to supply hydraulic fluid to the first hydraulic cylinder and the second hydraulic cylinder. The engine is configured to drive the hydraulic pump. The rotational speed sensor is configured to detect a detected rotation speed of the engine. The first control valve includes a first pool and is configured to control the first hydraulic cylinder to take the first status and the second status alternatively in accordance with a first spool position which is a position of the first spool, and to adjust an amount of the hydraulic fluid supplied to the first oil supplied chamber per unit time and an amount of the hydraulic fluid discharged from the first oil discharged chamber per unit time. The arm posture detection sensor is configured to detect the arm height. The implement posture detection sensor is configured to detect the implement direction. The memory is configured to store first relational data in which a first posture parameter is associated with a second posture parameter, the first posture parameter representing the arm height, the second posture parameter representing the implement direction. The processor is configured to control the hydraulic pump, the engine, and the first control valve. The first input device is configured to receive a first instruction to perform implement posture electric control to control the implement direction. The second input device is configured to receive a second instruction to change the arm height.

According to another aspect of the present disclosure, a method for controlling a work vehicle, includes receiving a first instruction to perform implement posture electric control to control an implement direction from a joint of an implement of the work vehicle to an implement tip of the implement based on first relational data in which a first posture parameter is associated with a second posture parameter, the first relational data representing an arm height that is a height of an arm distal end of an arm of the work vehicle with respect to a ground contact surface of a traveling device of the work vehicle, the second posture parameter representing the implement direction. The method includes receiving a second instruction to change the arm height. The method includes calculating from an output of an arm posture detection sensor configured to detect the arm height, the first posture parameter representing a start arm height, which is the arm height detected at reception of the second instruction that occurs after reception of the first instruction. The method includes calculating from an output of an implement posture detection sensor configured to detect the implement direction after reception of the first instruction, the second posture parameter representing a start implement direction which is the implement direction detected at reception of the second instruction that occurs after reception of the first instruction. The method includes acquiring a first reference parameter that is the second posture parameter associated with the first posture parameter representing the start arm height in first relational data. The method includes controlling according to the second instruction, a second hydraulic cylinder configured to control the arm height. The method includes obtaining a measurement value of the arm height from an output of an arm posture detection sensor configured to detect the arm height. The method includes acquiring a second reference parameter that is the second posture parameter associated with the first posture parameter representing the measurement value in the first relational data. The method includes determining a target direction that is a target of the implement direction when the arm height is the measurement value such that a difference between the second posture parameter representing the target direction and the second posture parameter representing the start implement direction is equal to a difference between the second reference parameter and the first reference parameter. The method includes controlling a first hydraulic cylinder configured to control the implement direction such that the implement direction approaches the target direction.

According to further aspect of the present disclosure, a controller of a work vehicle includes a memory and a processor. The memory is configured to store first relational data in which a first posture parameter is associated with a second posture parameter, the first posture parameter representing an arm height which is a height of an arm distal end of an arm of the work vehicle with respect to a ground contact surface of a traveling device of the work vehicle, the second posture parameter representing an implement direction from a joint of an implement of the work vehicle toward an implement tip of the implement. The processor is configured to receive from a first input device, a first instruction to perform implement posture electric control to control the implement direction based on the first relational data. The processor is configured to receive from a second input device, a second instruction to change the arm height. The processor is configured to calculate from an output of an arm posture detection sensor configured to detect the arm height, the first posture parameter that represents a start arm height, the start arm height being the arm height detected at reception of the second instruction that occurs after reception of the first instruction. The processor is configured to calculate from an output of an implement posture detection sensor configured to detect the implement direction, the second posture parameter that represents a start implement direction, the start implement direction being the implement direction detected at reception of the second instruction that occurs after reception of the first instruction. The processor is configured to acquire a first reference parameter that is the second posture parameter associated with the first posture parameter representing the start arm height in the first relational data. The processor is configured to control a second hydraulic cylinder configured to control the arm height according to the second instruction. The processor is configured to receive an output of an arm posture detection sensor configured to detect the arm height to obtain a measurement value of the arm height. The processor is configured to acquire a second reference parameter that is the second posture parameter associated in the first relational data with the first posture parameter representing the measurement value. The processor is configured to determine a target direction that is a target of the implement direction when the arm height is the measurement value such that a difference between the second posture parameter representing the target direction the second posture parameter representing the start implement direction is equal to a difference between the second reference parameter and the first reference parameter. The processor is configured to control a first hydraulic cylinder configured to control the implement direction such that the implement direction approaches the target direction.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
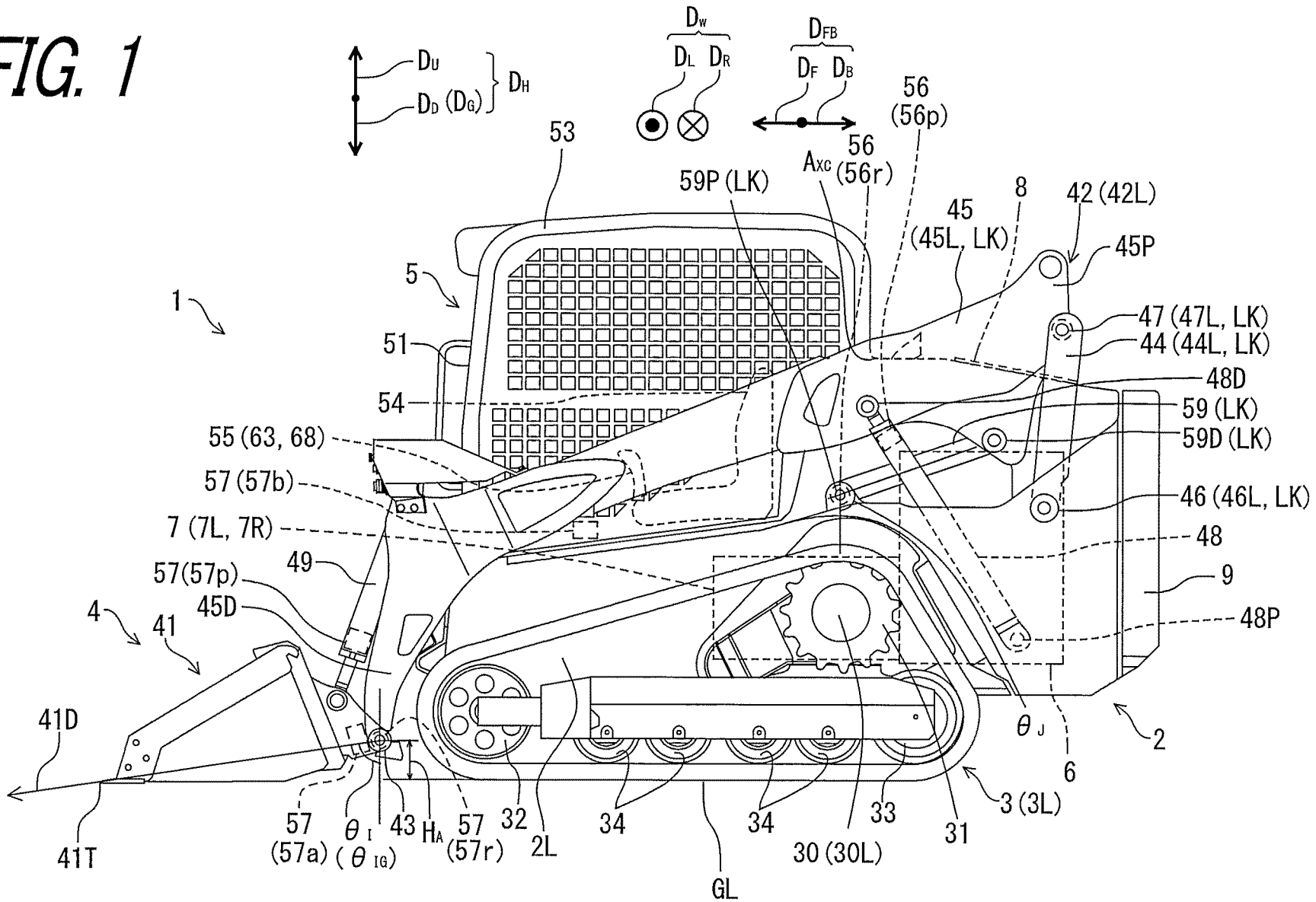
FIG. 1 is a side view of a work vehicle.

Hereinafter, embodiments of the present disclosure will be described with reference to the accompanying drawings. Like reference numerals designate corresponding or identical elements throughout the several views.

Figure 2:
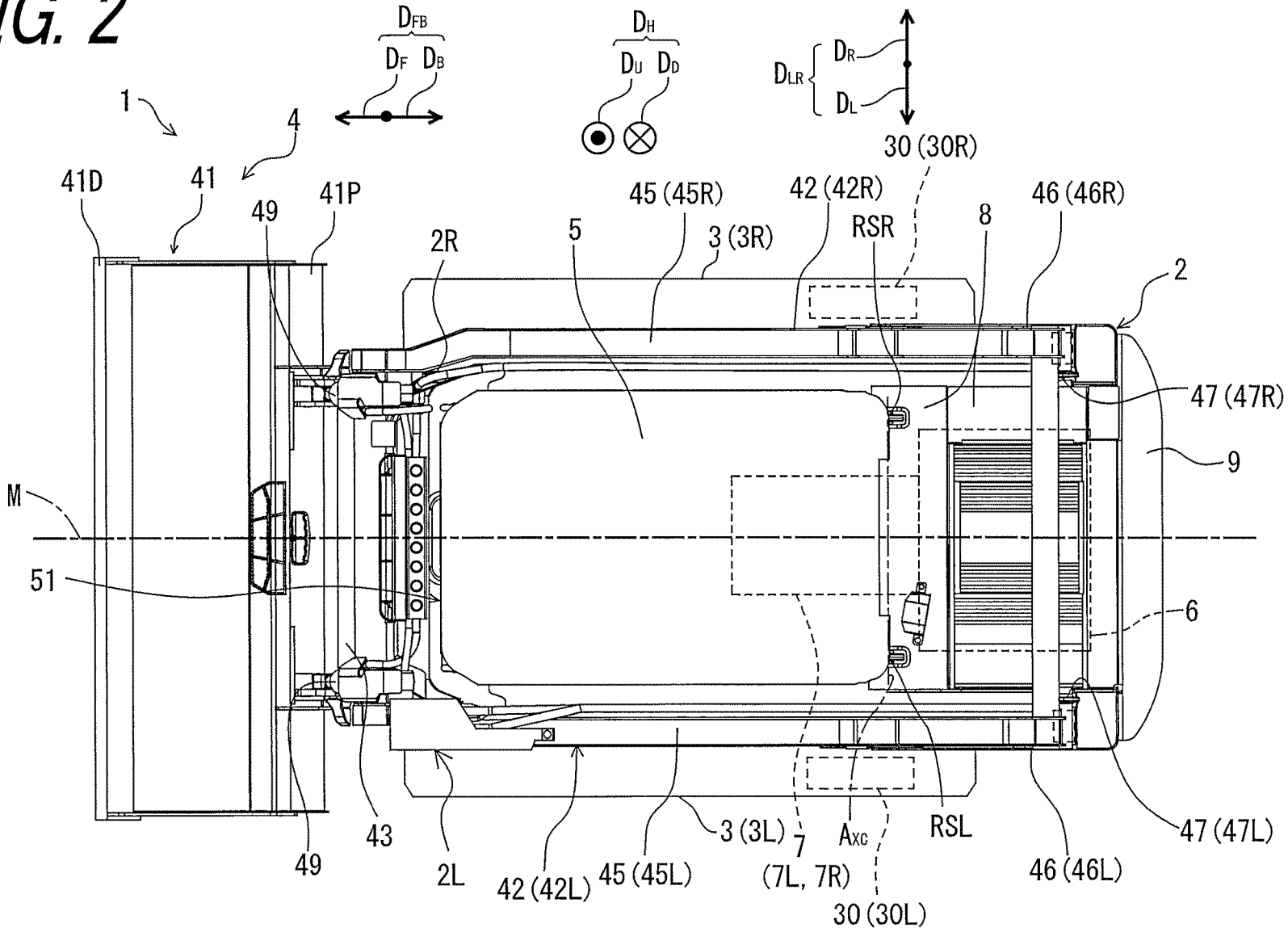
FIG. 2 is a top view of the work vehicle.

Referring to FIGS. 1 and 2, a work vehicle 1, for example, a compact truck loader, includes a vehicle body 2, a pair of traveling devices 3, and a working device 4. The vehicle body 2 supports the traveling device 3 and the working device 4. The traveling device 3 is configured to move the vehicle body 2. In the illustrated embodiment, the traveling device 3 is a crawler type traveling device 3. Therefore, each of the pair of traveling devices 3 includes a drive wheel 31, driven wheels 32 and 33, and a rolling wheel 34, which are driven by the hydraulic motor device 30. However, each of the pair of traveling devices 3 is not limited to the crawler type traveling device 3. Each of the pair of traveling devices 3 may be, for example, a front wheel/rear wheel traveling device 3 or a traveling device 3 having a front wheel and a rear crawler. The working device 4 includes an implement 41 at the distal end of the working device 4. In FIGS. 1 and 2, a bucket is illustrated as an example of the implement 41. The implement 41 has a joint 43 and an implement tip 41T opposite to the joint 43. The joint 43 is, for example, a pivot shaft. A proximal end of the working device 4 is attached to a rear portion of the vehicle body 2. The working device 4 includes a pair of arm assemblies 42 for rotatably supporting the implement 41 via joints 43. Each of the pair of arm assemblies 42 includes a first link 44, arm 45, a link mechanism LK including a second link 59. The arm 45 includes an arm distal end 45D that swingably supports the implement 41 at the joint 43 and an arm proximal end 45P opposite to the arm distal end 45D. The arm distal end 45D swingably supports joint 43. The vehicle body 2 swingably supports the proximal end 45P. To be more specific, the vehicle body 2 swingably supports the proximal end 45P via the first link 44 and the second link 59. The link mechanism LK connects the vehicle body 2 and the arm distal end 45D.

The first link 44 is rotatable with respect to the vehicle body 2 around the fulcrum shaft 46. The second link 59 is rotatable with respect to the vehicle body 2 around the fulcrum shaft 59P. The arm 45 is rotatable with respect to the first link 44 around the joint shaft 47. The arm 45 is rotatable about the joint shaft 59D with respect to the second link 59. The arm 45 operates with one degree-of-freedom because of a link defined by two free ends (joint shaft 47, joint shaft 59P) of the four joint link mechanism LK including two fixed ends (fulcrum shaft 46, fulcrum shaft 59D) and two free ends (joint shaft 47, joint shaft 59D). That is, the position of the joint 43 is uniquely determined by the rotation angle $\theta_J$ of the fulcrum shaft 59P.

The work vehicle 1 further includes a plurality of second hydraulic cylinders 48. Each of the plurality of second hydraulic cylinders 48 is rotatably connected to the vehicle body 2 and the arm 45, and moves the first link 44, the arm 45, and the like to raise and lower the implement 41. That is, each of the plurality of second hydraulic cylinders 48 is configured to control an arm height $H_A$ which is a height of the arm distal end 45D with respect to the ground contact surface GL of the traveling device 3 in the height direction DH perpendicular to the traveling direction of the traveling device 3. For the sake of simplicity, the height of the arm distal end 45D is the height of the joint 43. That is, the arm height $H_A$ is a distance between the ground contact surface GL of the traveling device 3 and the joint 43 in the height direction $D_H$. The work vehicle 1 includes an arm posture detection sensor 56 configured to detect a rotation angle $\theta_j$ of the fulcrum shaft 59P to detect the position of the arm distal end 45D (joint 43). The arm posture detection sensor 56 is a rotation angle detection sensor configured to detect rotation angle $\theta_j$ of a joint (fulcrum shaft 59P) of the link mechanism LK. That is, the arm posture detection sensor 56 is a rotation angle detection sensor configured to detect the rotation angle $\theta_J$ of the link (second link 59) that swingably supports the arm 45. In FIG. 1, for the sake of simplicity, an angle formed by a vector from the center of the fulcrum shaft 59P toward the downward direction DD and a vector from the center of the fulcrum shaft 59P toward the center of the joint shaft 59D is shown as the rotation angle $\theta_j$, but other angles may be used. The arm posture detection sensor 56 includes a potentiometer 56*r*, for example. The arm posture detection sensor 56 is configured to detect an arm height $H_A$. Here, the parameter representing the arm height $H_A$ is referred to as a first posture parameter. The rotation angle $\theta_J$ is an example of a first posture parameter. The first posture parameter may be a parameter representing the arm height $H_A$ converted from the rotation angle $\theta_j$. The first posture parameter may be the rotation angle $\theta_j$ itself.

The work vehicle 1 further includes at least one first hydraulic cylinder 49. The at least one first hydraulic cylinder 49 is configured to control the implement direction 41D from the joint 43 towards the implement tip 41T. The work vehicle 1 includes an implement posture detection sensor 57 for detecting an implement direction 41D. The implement posture detection sensor 57 includes, as an example, the inertial measurement unit (IMU) 40 includes a first inertial measurement unit (IMU) 57*a* attached to the implement 41 and a second inertial measurement unit (IMU) 57*b* attached to the vehicle body 2. The first inertial measurement unit 57*a* and the second inertial measurement unit 57*b* each include at least an accelerometer and a gyroscope, and can detect the gravity direction DG. That is, the first inertial measurement unit 57*a* can detect the second angle $\theta_{IG}$ formed by the implement direction 41D and the gravity direction DG. The second inertial measurement unit 57*b* can detect a first angle $\theta_{VG}$ (not illustrated) formed between the vehicular reference direction (for example, the vehicular downward direction DD) and the gravity direction DG. FIG. 1 shows an example in which the work vehicle 1 is placed on a horizontal plane, and the first angle $\theta_{VG}$ is 0 degree with the downward direction DD as the vehicle reference direction. The work vehicle (the controller 15 as described later) 15 acquires the first angle $\theta_{VG}$ from the signal outputted from the second inertial measurement unit 57*b*, and the second angle $\theta_{IG}$ from the signal outputted from the first inertial measurement unit 57*a*, and obtains the implement inclination angle $\theta_I$ between the implement direction 41D and the vehicle-based direction (e.g., the vehicle-downward direction DD) with reference to the first angle $\theta_{VG}$ and the second angle $\theta_{IG}$. Here, the parameter representing the implement direction 41D is referred to as a second posture parameter. The implement inclination angle $\theta_I$ is an example of a second posture parameter.

The arm posture detection sensor 56 may be a linear sensor 56*p* that detects the position $P_A$ of the second hydraulic cylinders 48 instead of the potentiometer 56*r*. The implement posture detection sensor 57 may be a linear sensor 57*p* that detects the position $P_I$ of the first hydraulic cylinders 49 instead of the first inertial measurement unit 57*a* and the second inertial measurement unit 57*b*. An example of such a linear sensor is a sensor for detecting a stroke in a hydraulic cylinder, which is described in introduction of products, KYB Giho No. 54 (April, 2017), pages 75 to 78. The implement posture detection sensor 57 may be a potentiometer 57*r* for detecting rotation angle $\theta_R$ of the joint 43, instead of the first inertial measurement unit 57*a*, the second inertial measurement unit 57*b* or the linear sensor 57*p*. The position $P_I$ and the rotation angle $\theta_R$ of the first hydraulic cylinder 49 are another example of the first parameter. The position $P_A$ of the second hydraulic cylinder 48 is another example of the second parameter.

The vehicle body 2 includes a cabin 5. The cabin 5 includes a front window 51 that can be opened and closed, and the outer shape of the cabin 5 is defined by a cab frame 53. The front window 51 may be omitted. As shown in FIG. 2, the cab frame 53 is rotatable around rotational shafts RSL and RSR on the vehicle body 2. In FIGS. 1 and 2, the common pivot axes $A_{XC}$ defined by the rotational shafts RSL and RSR is illustrated: That is, the cab frame 53 is attached to the vehicle body 2 to be rotatable around the pivot axis $A_{XC}$.

In the embodiment according to the present application, a front-back direction $D_{FB}$(forward direction $D_F$/backward direction $D_B$) means a front-back direction (forward direction/backward direction) as seen from an operator seated on the operator's seat 54 of the cabin 5. A leftward direction $D_L$, a rightward direction $D_R$, a width direction $D_W$ means the left direction, the right direction, and the left-right direction as viewed from the operator, respectively. An upward direction $D_U$, a downward direction $D_D$, height direction $D_H$ means an upward direction, a downward direction, and a height direction as viewed from the operator. The front-back, left-right (width), and up-down (height) directions of the work vehicle 1 coincide with the front-back, left-right (width), and up-down (height) directions as viewed from the operator, respectively.

Figure 3:
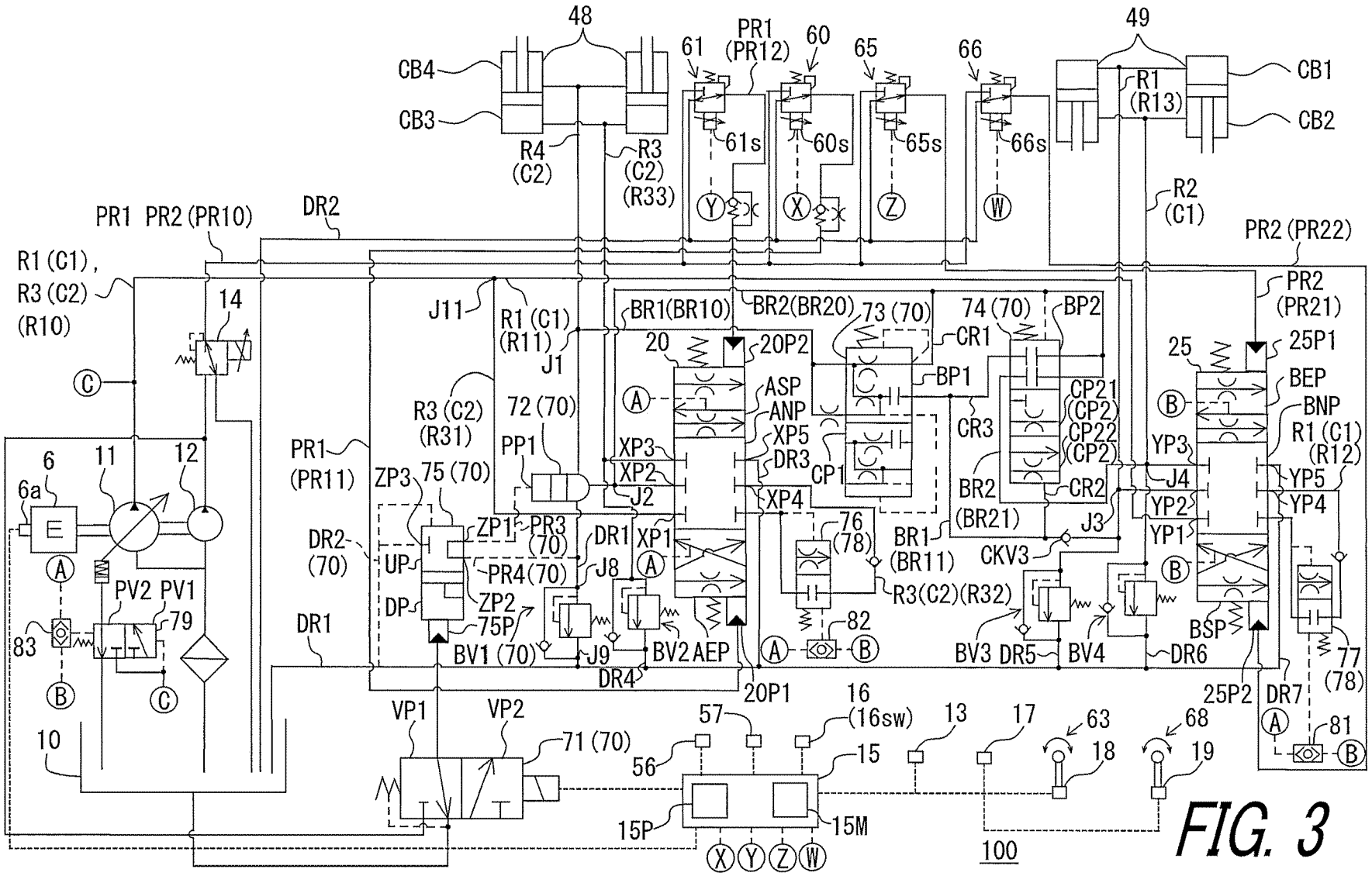
FIG. 3 is a schematic configuration diagram of a first hydraulic cylinder, a second hydraulic cylinder, and a hydraulic circuit of the work vehicle.

The work vehicle 1 includes the operator's seat 54 and the operation lever 55 (the arm input member 63 and the implement input member 68) in the cabin 5. The arm input member 63 is configured to receive an instruction for changing the arm height $H_A$. In the following embodiments, this instruction is referred to as a second instruction. The arm input member 63 is referred to as a second input device. That is, the second input device is the operation lever 55 configured to receive a raising instruction to increase the arm height $H_A$ and a lowering instruction to decrease the arm height $H_A$. The implement input member 68 is configured to receive an instruction for changing the implement direction 41D. In the following embodiments, this instruction is referred to as a third instruction. The implement input member 68 is referred to as a third input device. The operation lever 55 shown in FIG. 1 is configured to receive the second instruction by the forward and backward movement of the operation lever 55 and to receive the third instruction by the left and right movement of the operation lever 55. Therefore, the operation lever 55 is formed by integrating the second input device and the third input device. However, as shown in FIG. 3 later, the arm input member 63 and the implement input member 68 may be separate members.

FIG. 1 shows the left side of the work vehicle 1. As shown in FIG. 2, the vehicle body 2 is substantially symmetrical with respect to the vehicle body center plane M, and includes a first side surface 2L which is a left side surface and a second side surface 2R which is a right side surface. Among the pair of traveling devices 3, the traveling device 3 provided on the first side surface 2L is shown as a first traveling device 3L, and the traveling device 3 provided on the second side surface 2R is shown as a second traveling device 3R. Among the pair of arm assemblies 42, the arm assembly 42 provided on the left side with respect to the vehicle body center plane M is referred to as a first arm assembly 42L, and the arm assembly 42 provided on the right side with respect to the vehicle body center plane M is referred to as a second arm assembly 42R. The first link 44 provided on the left side with respect to the vehicle body center plane M is shown as a first left link 44L. The arm 45 provided on the left side with respect to the vehicle body center plane M is shown as a first arm 45L, and the arm 45 provided on the right side with respect to the vehicle body center plane M is shown as a second arm 45R. The fulcrum shaft 46 provided on the left side with respect to the vehicle body center plane M is a first fulcrum shaft 46L, the fulcrum shaft 46 provided on the right side with respect to the vehicle body center plane M is shown as a second fulcrum shaft 46R. The joint shaft 47 provided on the left side with respect to the vehicle body center plane M is shown as a first joint shaft 47L, and the joint shaft 47 provided on the right side with respect to the vehicle body center plane M is shown as a second joint shaft 47R. Among the hydraulic motor devices 30, the hydraulic motor device 30 provided on the left side with respect to the vehicle body center plane M is the first hydraulic motor device 30.L, and the hydraulic motor device 30 provided on the right side with respect to the vehicle body center plane M is indicated as a second hydraulic motor device 30R.

Referring to FIGS. 1 and 2, the work vehicle 1 includes an engine 6 provided at a rear portion of a vehicle body 2, a rotational speed sensor 6*a*; and a plurality of hydraulic pumps 7 including a first traveling hydraulic pump 7L, a second traveling hydraulic pump 7R. The engine 6 is configured to drive the plurality of hydraulic pumps 7. The rotational speed sensor 6*a* is configured to detect the detected rotation speed $N_E$ of the engine 6. The first traveling hydraulic pump 7L and the second traveling hydraulic pump 7R are configured to discharge the hydraulic fluid for driving the hydraulic motor device 30 and the like that drives the drive wheel 31. The plurality of hydraulic pumps other than the first traveling hydraulic pump 7L and the second traveling hydraulic pump 7R are configured to discharge hydraulic fluid for driving the hydraulic actuators (the plurality of second hydraulic cylinder 48, at least one first hydraulic cylinder 49, and the like) connected to the working device 4. The engine 6 is provided between the pair of arm assemblies 42 in the width direction DW of the work vehicle 1. The work vehicle 1 further includes a cover 8 for covering the engine 6. The work vehicle 1 further includes a bonnet cover 9 provided at a rear end of the vehicle body 2. The bonnet cover 9 can be opened and closed, and a maintenance worker can perform maintenance work of the engine 6 and the like.

<Hydraulic Circuit>

The work vehicle 1 includes hydraulic circuit 100 and a controller 15. The hydraulic circuit 100 is configured to control the first hydraulic cylinder 49 and the second hydraulic cylinder 48. FIG. 3 is a schematic configuration diagram of the first hydraulic cylinder 49, the second hydraulic cylinder 48, and the hydraulic circuit 100 of the work vehicle 1. The hydraulic circuit 100 includes a hydraulic pump 11, a pilot pump 12, a first control valve 25, a second control valve 20, a first pilot control valve 65, a second pilot control valve 66, a third pilot control valve 60, a fourth pilot control valve 61, a first oil passage R1, a second oil passage R2, a third oil passage R3, a fourth oil passage R4, a first pilot oil passage PR1, and a second pilot oil passage PR2, a bypass oil passage BR1, and a switching mechanism 70. The controller 15 is configured to control the hydraulic circuit 100. In the following embodiments, the first oil passage R1 and the second oil passage R2 may be collectively referred to as a first cylinder hydraulic circuit C1. The third oil passage R3 and the fourth oil passage R4 may be collectively referred to as a second cylinder hydraulic circuit C2. The first cylinder hydraulic circuit C1 connects the first hydraulic cylinders 49 and the hydraulic pumps 11. The second cylinder hydraulic circuit C2 connects the second hydraulic cylinder 48 and the hydraulic pumps 11.

The first hydraulic cylinder 49 includes a first chamber CB1 into which the hydraulic fluid flows when the implement tip 41T is tilted downward and a second chamber CB2 into which the hydraulic fluid flows when the implement tip 41T is tilted upward. The second hydraulic cylinder 48 includes a third chamber CB3 into which the hydraulic fluid flows when the arm distal end 45D is raised, and a fourth chamber CB4 into which the hydraulic fluid flows when the arm distal end 45D is lowered. The hydraulic pump 11 is configured to be driven by the engine 6 and supply the hydraulic fluid stored in the hydraulic fluid tank 10 to a first hydraulic cylinder 49 and a second hydraulic cylinder 48. The hydraulic pump 11 is for example a variable displacement hydraulic pump. A port connected to a swash plate of the hydraulic pump 11 is connected to a regulator valve 79 described later, and the pressure of the hydraulic fluid output from the hydraulic pump 11 is regulated. The pilot pump 12 is configured to be driven by the engine 6 and discharge pilot oil for controlling the second control valve 20 and the first control valve 25. Among the hydraulic fluid stored in the hydraulic fluid tank 10, the hydraulic fluid discharged from the pilot pump 12 and used for control may be referred to as pilot oil, and the pressure of the pilot oil may be referred to as pilot pressure. The pilot pump 12 is, for example, a fixed displacement hydraulic pump.

A first oil passage R1 connects a hydraulic pump 11 with a first chamber CB1 of the first hydraulic cylinder 49. The first control valve 25 is provided in the first oil passage R1. The first control valve 25 is provided in the first cylinder hydraulic circuit C1 between the hydraulic pump 11 and the first hydraulic cylinder 49. The first control valve 25 includes pilot ports 25P1, 25P2 and is configured to control the hydraulic fluid supplied to the first chamber CB1 and the second chamber CB2 of the first hydraulic cylinder in response to the hydraulic pressure of the pilot oil applied to the pilot ports 25P1, 25P2. The first oil passage R1 includes a partial oil passage R10 common to a third oil passage R3 extending from the hydraulic pump 11 to the joint J11, and a partial oil passage R11 extending from the joint J11 to the first control valve 25, a partial oil passage R12 connecting different connection ports of the first control valve 25 to each other, and a partial oil passage R13 extending from the first control valve 25 to a first chamber CB1 of the first hydraulic cylinder 49. The second oil passage R2 connects the first control valve 25 and the second chamber CB2 of the first hydraulic cylinder 49. The first oil passage R1 and the second oil passage R2 are branched by being connected to different ports of the first control valve 25.

Figure 4:
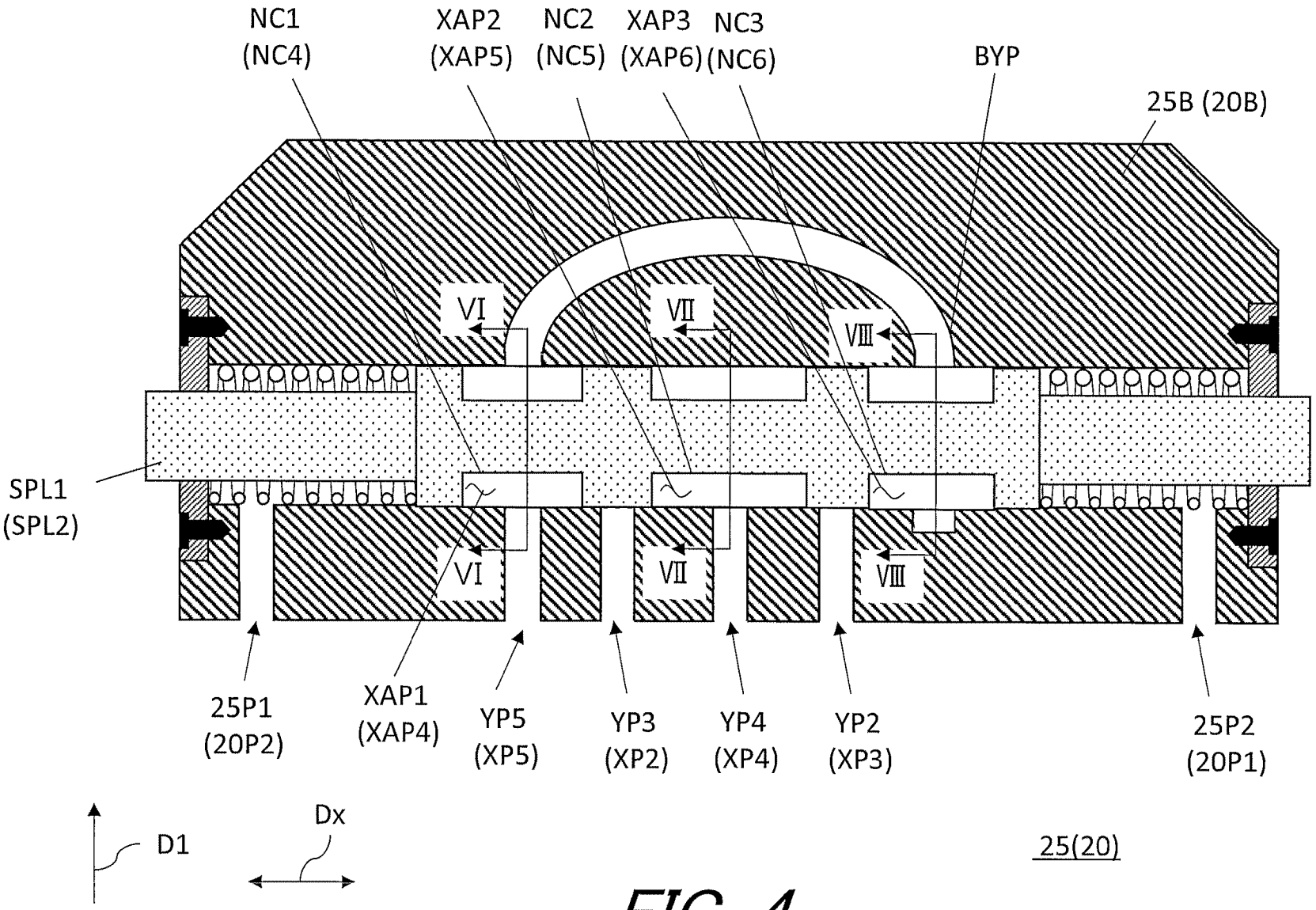
FIG. 4 is a schematic configuration diagram showing an example of the internal configuration of ae first control valve and a second control valve.
Figure 5:
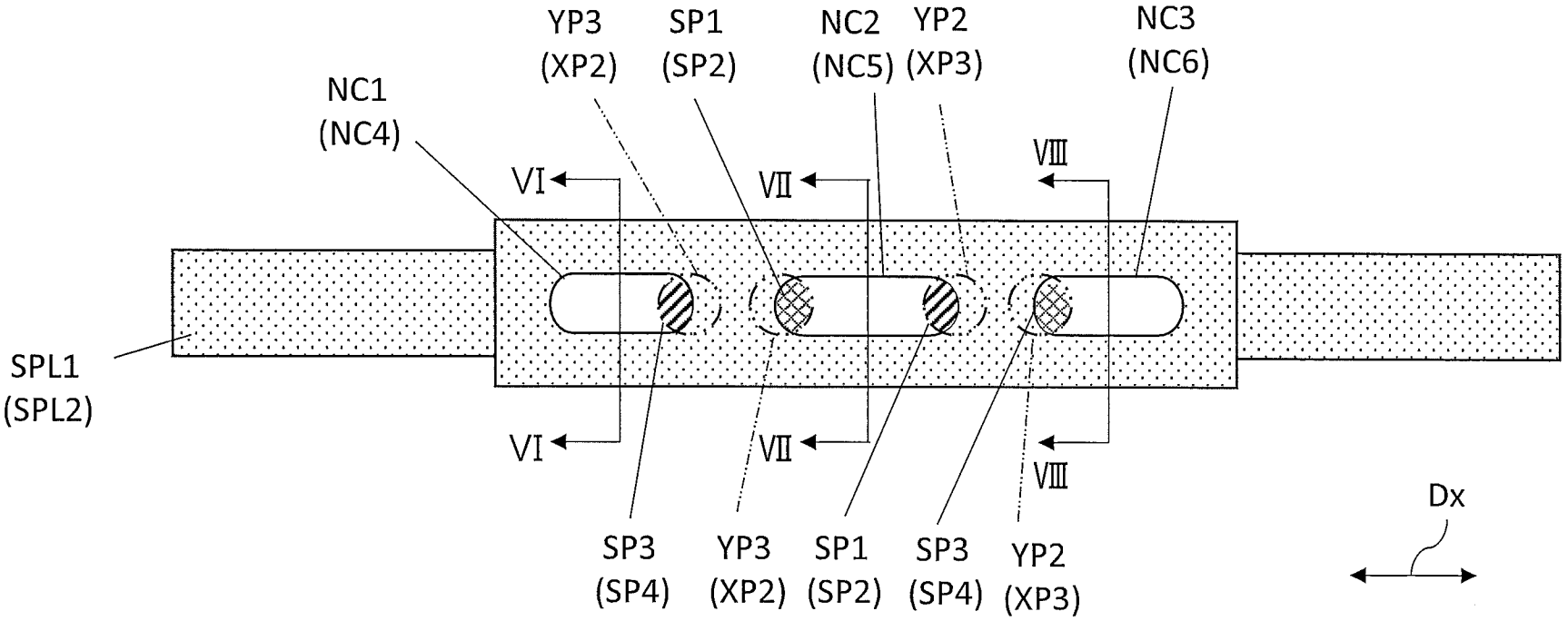
FIG. 5 is a view of the first spool and the second spool as viewed from the first direction in FIG. 4.
Figure 6:
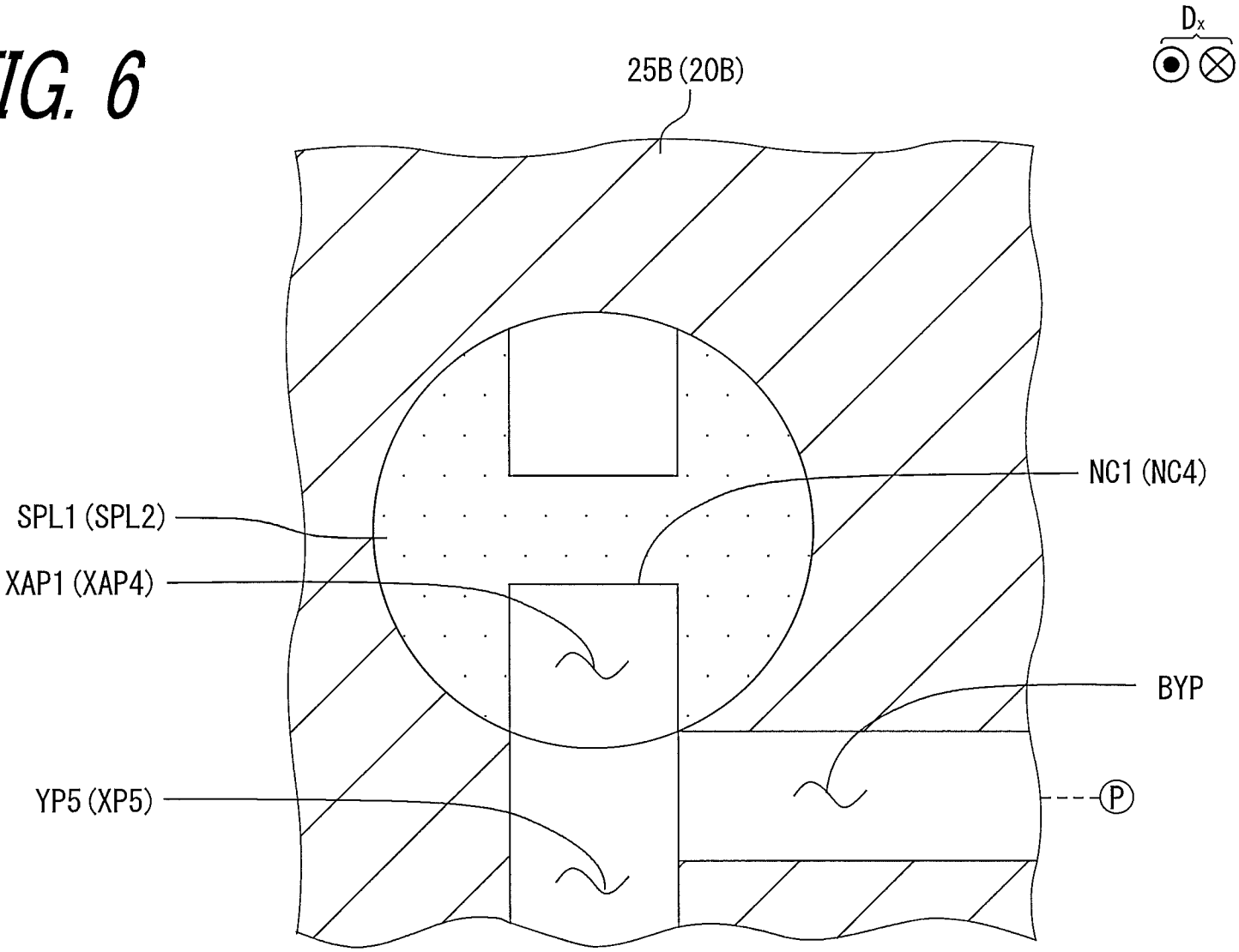
FIG. 6 is a cross-sectional view of the first control valve and the second control valve taken along line VI-VI in FIG. 4.
Figure 7:
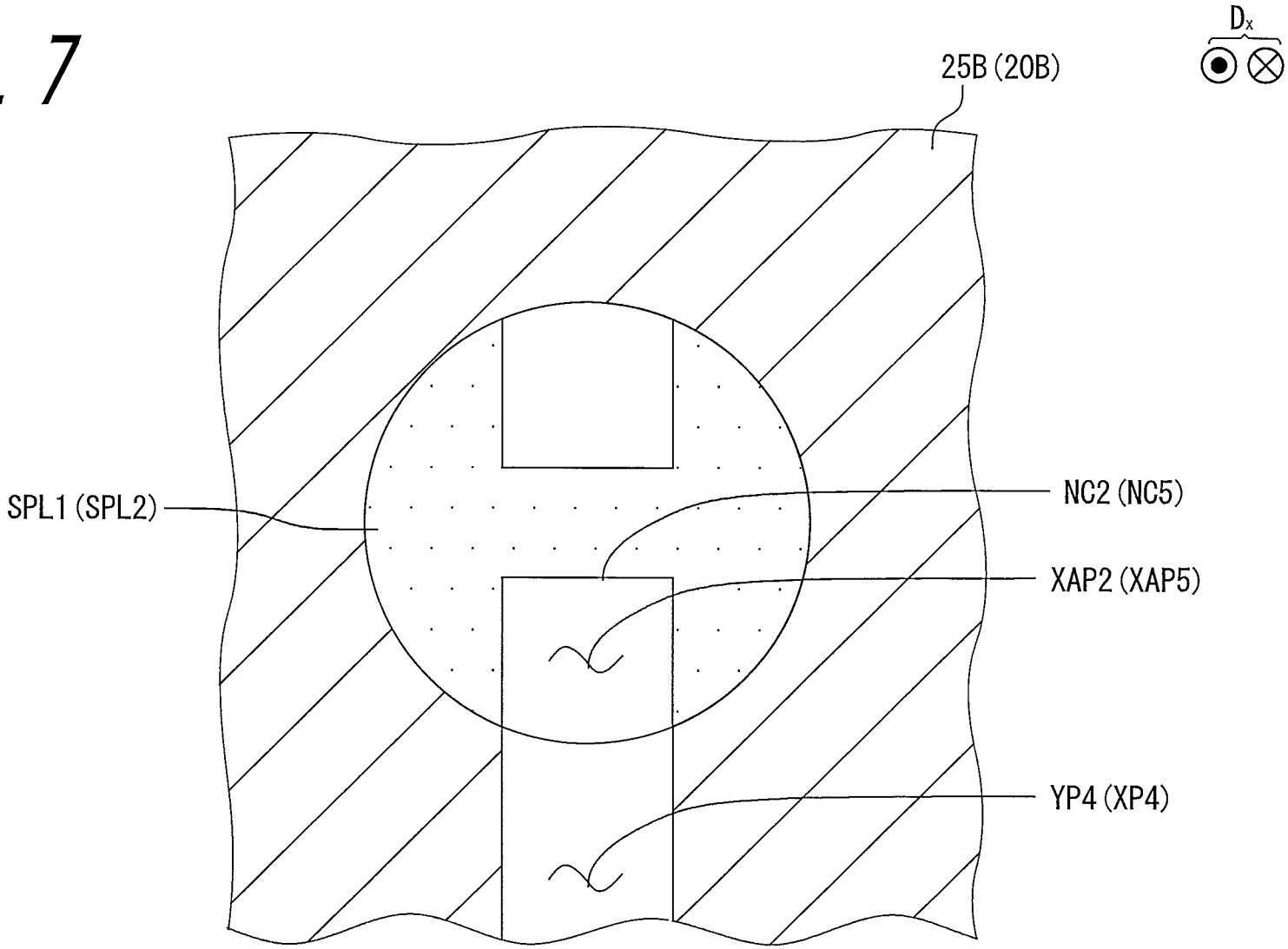
FIG. 7 is a cross-sectional view of the first control valve and the second control valve taken along line VII-VII in FIG. 4.
Figure 8:
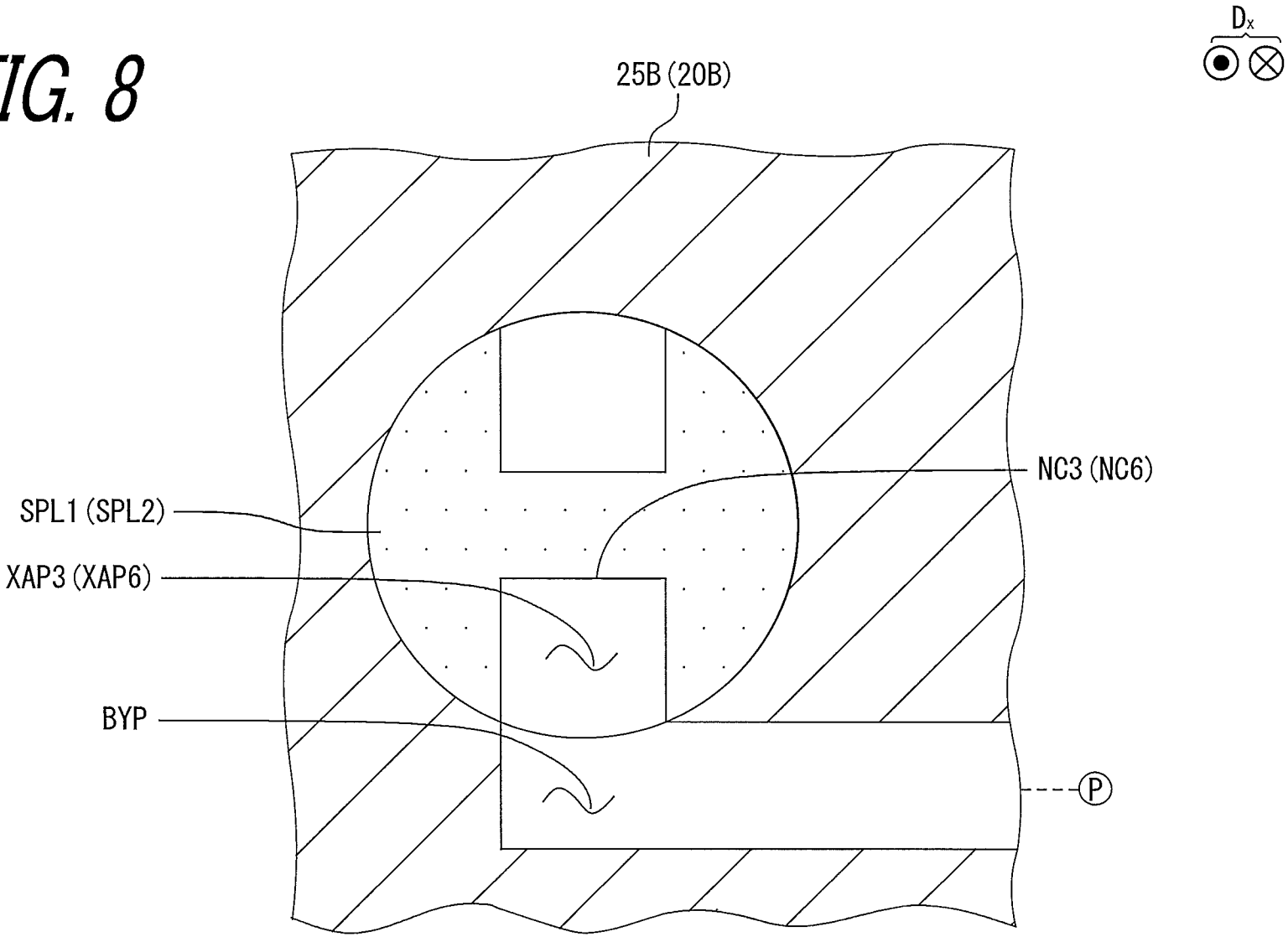
FIG. 8 is a sectional view of the first control valve and the second control valve taken along line VIII-VIII of FIG. 4.

FIG. 4 is a schematic configuration diagram showing an example of an internal configuration of the first control valve 25. As shown in FIG. 4, the first control valve 25 includes a first spool SPL1 and a first valve housing 25B. FIG. 5 is a view of the first spool SPL1 as viewed from the first direction D1 in FIG. 4. Referring to FIGS. 4 and 5, the first spool SPL1 is a rod-shaped member extending in the axial direction Dx. The first direction D1 is the axial direction Dx. The first valve housing side 25B supports the first spool SPL1 so as to be slidable in the axial direction Dx. Referring to FIGS. 4 and 5, the first spool SPL1 has a first notch NC1, a second notch NC2, and a third notch NC3. FIG. 6 is a sectional view of the first control valve 25 taken along line VI-VI in FIG. 4. FIG. 7 is a cross-sectional view of the first control valve 25 taken along line VII-VII in FIG. 4. FIG. 8 is a sectional view of the first control valve 25 taken along line VIII-VIII of FIG. 4. Referring to FIG. 6, the first notch NC1 forms a first axial opening XAP1 in the axial direction Dx. Referring to FIG. 7, the second notch NC2 forms a second axial opening XAP2 in the axial direction Dx. Referring to FIG. 8, the third notch NC3 forms a third axial opening XAP3 in the axial direction Dx.

Figure 9:
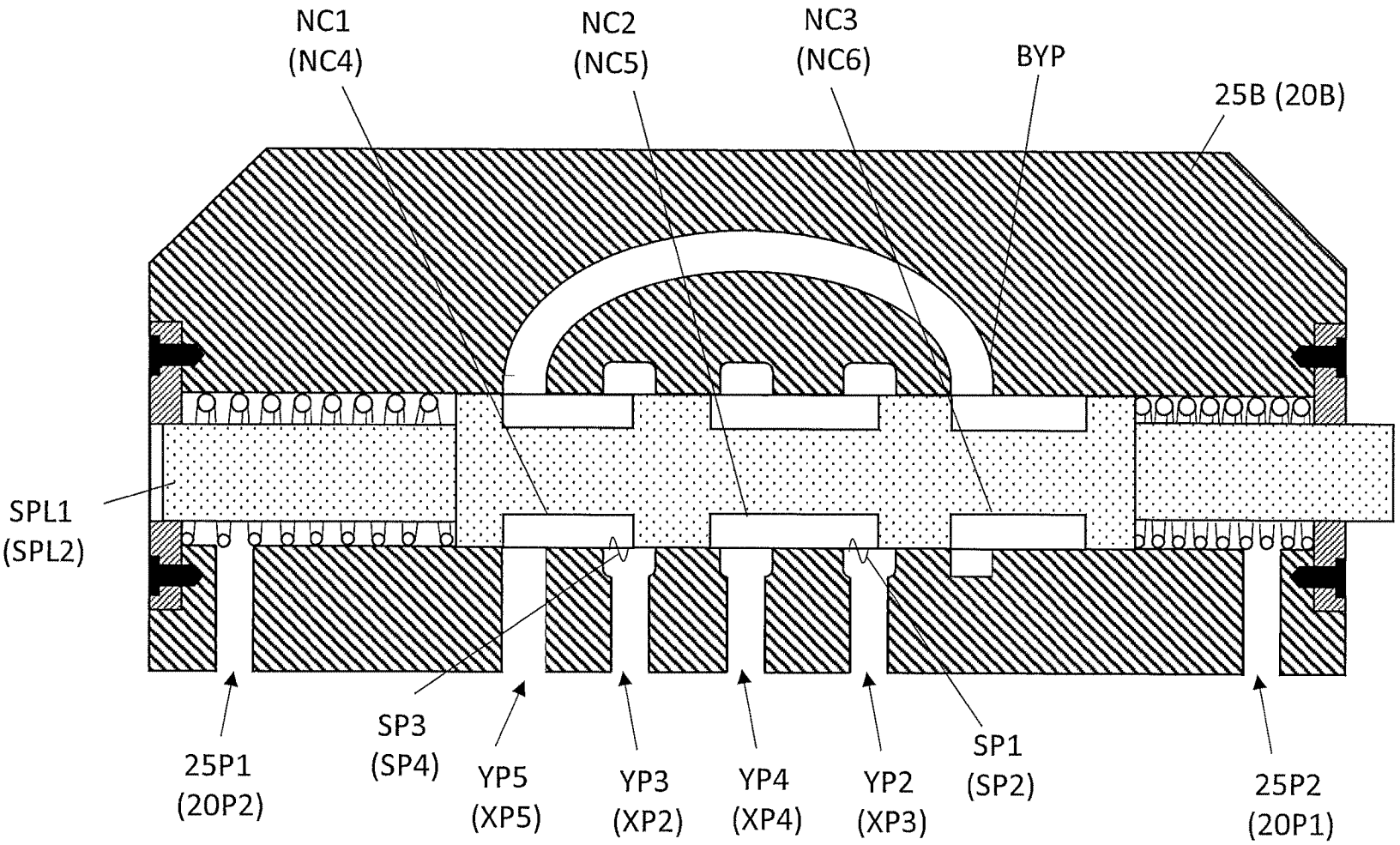
FIG. 9 is a schematic diagram showing another example of the internal structure of the first control valve and the second control valve.
Figure 10:
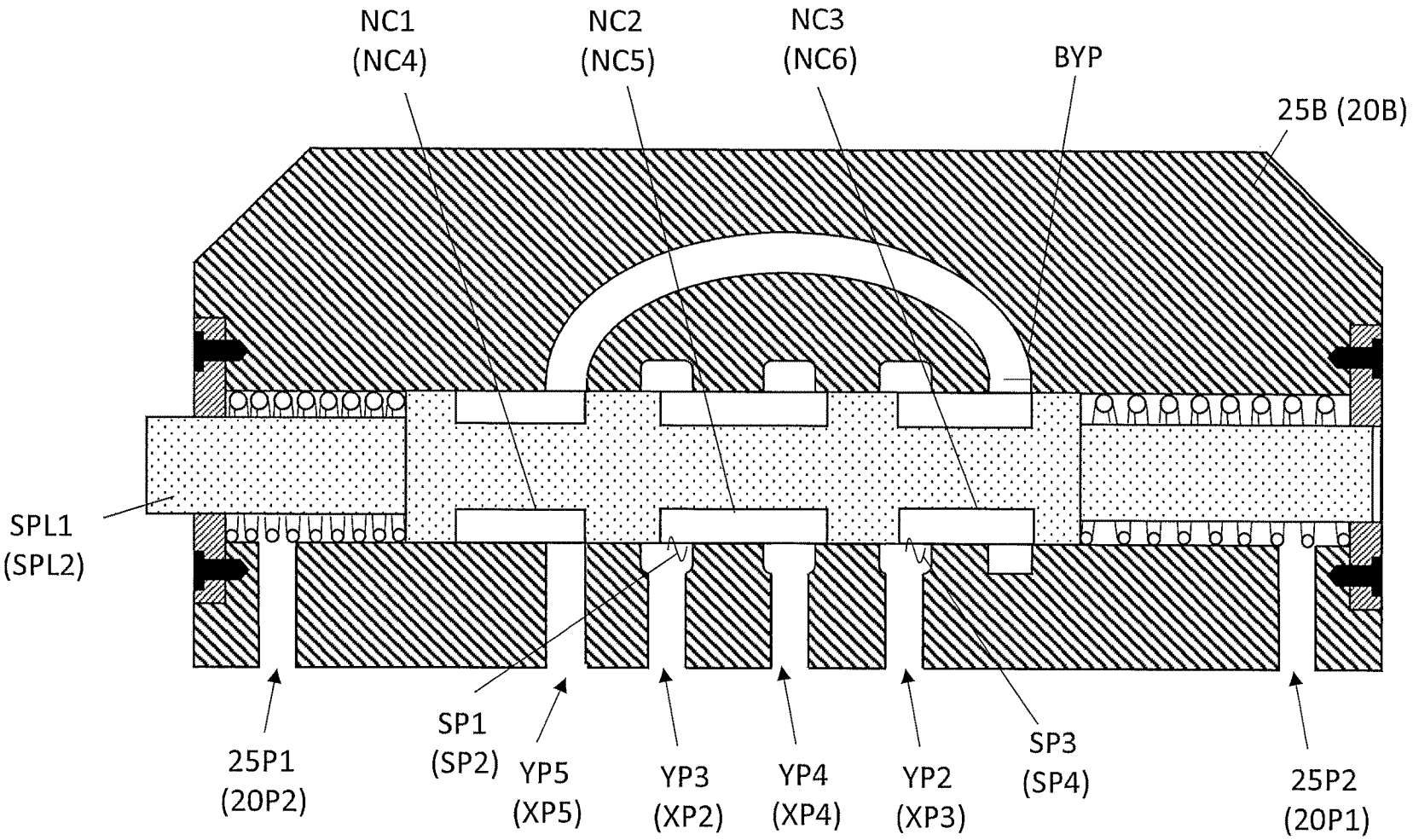
FIG. 10 is a schematic configuration diagram showing still another example of the internal configuration of the first control valve and the second control valve.

FIG. 4 shows the internal configuration of the first control valve 25 in which the position of the first spool SPL1 is switched to the first hydraulic cylinder rest control position BNP. FIG. 9 shows the internal configuration of the first control valve 25 in which the position of the first spool SPL1 is switched to the first hydraulic cylinder extension control position BEP. FIG. 10 shows the internal configuration of the first control valve 25 in which the position of the first spool SPL1 is switched to the first hydraulic cylinder retraction control position BSP. The first control valve 25 switches a first spool position, which is a position of the first spool SPL1, to a first hydraulic cylinder rest control position BNP, a first hydraulic cylinder extension control position BEP, or a first hydraulic cylinder retraction control position BSP, depending on a difference between the pilot pressure pp1 applied to the pilot port 25P1 and the pilot pressure pp2 applied to the pilot port 25P2. The first control valve 25 is configured to switch the first spool position to the first hydraulic cylinder extension control position BEP or the first hydraulic cylinder retraction control position BSP, thereby alternatively switching each of the two oil chambers CB1 and CB2 of the first hydraulic cylinder 49 between a first oil supplied chamber (CB1 or CB2) for supplying the hydraulic fluid and a first oil discharged chamber (CB2 or CB1) for discharging the hydraulic fluid. To be more specific, referring to FIG. 9, when the first spool position is switched to the first hydraulic cylinder extension control position BEP, the first oil supplied chamber is the first chamber CB1 of the first hydraulic cylinder 49, and the first oil discharged chamber is the second chamber CB2 of the first hydraulic cylinders 49. Referring to FIG. 10, when the first spool position is switched to the first hydraulic cylinder retraction control position BSP, the first oil supplied chamber is the second chamber CB2 of the first hydraulic cylinder 49, and the first oil discharged chamber is the first chamber CB1 of the first hydraulic cylinder 49.

To be more specific, the first control valve 25 includes a first implement control valve port YP1, a second implement control valve port YP2, a third implement control valve port YP3, a fourth implement control valve port YP4, and a fifth implement control valve port YP5. The first implement control valve port YP1 is connected to the hydraulic pump 11 via a first oil passage R1. The second implement control valve port YP2 is connected to the first chamber CB1 of the first hydraulic cylinder 49 via the first oil passage R1. The third implement control valve port YP3 is connected to the second oil passage R2. When the pilot pressure pp1 applied to the pilot port 25P1 is higher than the pilot pressure pp2 applied to the pilot port 25P2 by a predetermined pressure or more, the first control valve 25 switches the first spool position to the first hydraulic cylinder extension control position BEP at which the first and second implement control valve ports YP1 and YP2 are communicated with each other via the fourth implement control valve port YP4 and the third implement control valve port YP3 is communicated with a first drain oil passage DR1 (described later) via the fifth implement control valve port YP5. Referring to FIG. 9, the second implement control valve port YP2 and the second notch NC2 form a first opening SP1. The third implement control valve port YP3 and the first notch NC1 form a third opening SP3. In FIG. 5, the outline of the second implement control valve port YP2 at this time is indicated by a two dot chain line, and the first opening SP1 is indicated by hatching. The outline of the third implement control valve port YP3 at this time is indicated by a two dot chain line, and the third opening SP3 is indicated by hatching. The first opening area AS1, which is the area of the first opening SP1, can be continuously changed by changing the first spool position. The maximum value of the first opening area AS1 is sufficiently smaller than the area of the second axial opening XAP2 of the second notch NC2. The third opening area which is the area of the third opening SP3 can be continuously changed by changing the first spool position. The maximum value of the third opening areas is sufficiently smaller than the areas of the first axial opening XAP1 of the first notch NC1.

When the pilot pressure pp2 applied to the pilot port 25P2 is higher than the pilot pressure pp1 applied to the pilot port 25P1 by the predetermined pressure or more, the first control valve 25 switches the first spool position to the first hydraulic cylinder retraction control position in which the first implement control valve port YP1 and the third implement control valve port YP3 are communicated with each other via the fourth implement control valve port YP4 and the second implement control valve port YP2 is communicated with the DR1 (described later) via the fifth implement control valve port. YP2. Note that the first valve housing 25B has a bypass oil passage BYP for connecting the second implement control valve port YP2 and the fifth implement control valve port YP5. The bypass oil passage BYP is also shown in FIGS. 6 and 8. Referring to FIG. 10, the third implement control valve port YP3 and the second notch NC2 form a first opening SP1. The second implement control valve port YP2 and the third notch NC3 form a third opening SP3. In FIG. 5, the outline of the third implement control valve port YP3 at this time is indicated by a two dot chain line, and the first opening SP1 is indicated by a check pattern. The outline of the second implement control valve port YP2 at this time is indicated by a two dot chain line, and the third opening SP3 is indicated by a check pattern. The first opening area AS1, which is the area of the first opening SP1, can be continuously changed by changing the first spool position. The maximum value of the first opening area AS1 is sufficiently smaller than the area of the second axial opening XAP2 of the second notch NC2. The third opening area which is the area of the third opening SP3 can be continuously changed by changing the first spool position. The maximum value of the third opening areas is sufficiently smaller than the areas of the third axial opening XAP3 of the third notch NC3.

When the absolute value of the difference between the pilot pressure PP2 applied to the pilot port 25P2 and the pilot pressure pp1 applied to the pilot port 25P1 is equal to or less than the predetermined value, the first control valve 25 switches the first spool position to the first hydraulic cylinder rest control position BNP where the first, second, third, fourth, and fifth implement control valve ports YP1, YP2, YP3, YP4, and YP5 are isolated. In the schematic views of the first control valve 25 shown in FIGS. 4, 9, and 10, a portion related to the control of the oil passage between the first implement control valve port YP1 and the fourth implement control valve port YP4 is omitted.

As shown in FIG. 3, the hydraulic circuit 100 further includes shuttle valves 81 that output higher pressures between the pressures applied to the second and third implement control valve ports YP2 and YP3 and the pressures applied to second and third arm control valve ports XP2 and XP3, and first pressure compensation valve 77 provided in the first cylinder hydraulic circuit C1 between the first control valve 25 and the hydraulic pumps 11. The first pressure compensation valve 77 makes the first implement control valve port YP1 to communicate with the fourth implement control valve port YP4 only when the pressure applied to the first implement control valve port YP1 is higher than the pressure outputted from the shuttle valve 81 by a fourth threshold value or more. This fourth threshold pressure may be referred to as the first pressure. That is, the first pressure compensation valve 77 controls the hydraulic pressure of the hydraulic fluid output from the first opening SP1 to be lower than the hydraulic pressure of the hydraulic fluid input to the first opening SP1 by the first oil pressure.

The first control valve 25 is configured to change a first opening area AS1, which is an area of a first opening SP1 that communicates an oil passage connecting the first oil supplied chamber (CB1 or CB2) and the first control valve 25 with an oil passage connecting the hydraulic pump 11 and the first control valve 25, in accordance with the first spool position. A maximum value of the first opening area AS1 is sufficiently smaller than the area of the second axial opening XAP2 of the second notch NC2, when the first opening SP1 is regarded as an orifice, it is known that the flow rate of the hydraulic fluid passing through the first opening SP1 is proportional to the product of the first opening area AS1 and the square root of difference between input and output pressures of first opening SP1. The first pressure compensation valve 77 controls the difference between the input and output pressure of the first opening SP1 to be the first pressure, and therefore the first control valve 25 can adjust the amount of the hydraulic fluid supplied to the first oil supplied chamber (CB1 or CB2) per unit time by changing the first opening area AS1 at the first hydraulic cylinder extension control position BEP and the first hydraulic cylinder retraction control position BSP. The third opening SP3 can be referred to as an opening of the first control valve 25 that allows an oil passage connecting the first oil discharged chamber (CB2 or CB1) and the first control valve 25 to communicate with a first drain oil passage DR1 (described later). The area of the third opening SP3 varies according to the first opening area AS1. In FIG. 9, the first opening SP1 is an opening between the second implement control valve port YP2 and the first spool SPL1, and the third opening SP3 is an opening between the third implement control valve port YP3 and the first spool SPL1. In FIG. 10, the first opening SP1 is an opening between the third implement control valve port YP3 and the first spool SPL1, and the third opening SP3 is an opening between the second implement control valve port YP2 and the first spool SPL1.

The third oil passage R3 connects the hydraulic pump 11 and the third chamber CB3 of the second hydraulic cylinder 48. The third oil passage R3 includes a partial oil passage R10 which is common to a first oil passage R1 extending from a hydraulic pump 11 and a partial oil passage R31 branched from the first oil passage R1 in the joint J11. The second control valve 20 is provided in the third oil passage R3. The second control valve 20 is provided in a second cylinder hydraulic circuit C2 between the hydraulic pump 11 and the second hydraulic cylinder 48. The second control valve 20 includes a pilot port 20P1, 20P2, and is configured to control the hydraulic fluid supplied to the third chamber CB3 and the fourth chamber CB4 of the second hydraulic cylinder 48 in response to the oil pressure of the pilot oil applied to the pilot ports 20P1, 20P2. The third oil passage R3 further includes a partial oil passage R32 connecting different connection ports of the second control valve 20 to each other and a partial oil passage R33 extending to the third chamber CB3 of the second hydraulic cylinder 48. The fourth oil passage R4 connects the second control valve 20 and the fourth chamber CB4 of the second hydraulic cylinder 48. Third oil passage R3 and the fourth oil passage R4 are branched by being connected to different ports of the first control valve 25.

FIG. 4 is a schematic diagram showing an example of the internal configuration of the second control valve 20. In FIG. 4, the reference numeral of the second control valve 20 is shown in parentheses. As shown in FIG. 4, the second control valve 20 includes a second spool SPL2 and a second valve housing 20B. FIG. 5 also shows a view of the second spool SPL2 as seen from the first direction D1 in FIG. 4. Referring to FIGS. 4 and 5, the second spool SPL2 is a rod-shaped member extending in the axial direction Dx. The first direction D1 is perpendicular to the axial direction Dx. The second valve housing 20B supports the second spool SPL2 so as to be slidable in the axial direction Dx. Referring to FIGS. 4 and 5, the second spool SPL2 has a fourth notch NC4, a fifth notch NC5, and a sixth notch NC6. FIG. 6 is a cross-sectional view of the second control valve 20 taken along line VI-VI of FIG. 4. FIG. 7 is a cross-sectional view of the second control valve 20 taken along line VII-VII of FIG. 4. FIG. 8 is a sectional view of the second control valve 20 taken along line VIII-VIII of FIG. 4. Referring to FIG. 6, the fourth notch NC4 forms a fourth axial opening XAP4 in the axial direction Dx. Referring to FIG. 7, the fifth notch NC5 forms a fifth axial opening XAP5 in the axial direction Dx. Referring to FIG. 8, the sixth notch NC6 forms a sixth axial opening XAP6 in the axial direction Dx.

FIG. 4 shows the internal configuration of the second control valve 20 in which the position of the second spool SPL2 is switched to the second hydraulic cylinder rest control position ANP. FIG. 9 shows the internal configuration of the second control valve 20 in which the position of the second spool SPL2 is switched to the second hydraulic cylinder extension control position AEP. FIG. 10 shows the internal configuration of the second control valve 20 in which the position of the second spool SPL2 is switched to the second hydraulic cylinder retraction control position ASP. The second control valve 20 switches the second spool position, which is the position of the second spool SPL2, to the second hydraulic cylinder rest control position ANP, the second hydraulic cylinder extension control position AEP, or the second hydraulic cylinder retraction control position ASP, depending on the difference between the pilot pressure pp3 applied to the pilot port 20P1 and the pilot pressure pp4 applied to the pilot port 20P2. The second control valve 20 alternatively switches each of the two oil chambers (CB3, CB4) of the second hydraulic cylinder 48 to the second oil supplied chamber (CB3 or CB4) for supplying the hydraulic fluid and the second oil discharged chamber (CB3 or CB4) for discharging the hydraulic fluid by switching the second spool position to the second hydraulic cylinder extension control position AEP or the second hydraulic cylinder retraction control position ASP. In detail, referring to FIG. 9, when the position of the second spool position is switched to the second hydraulic cylinder extension control position AEP, the second oil supplied chamber is the third chamber CB3 of the second hydraulic cylinder 48, and the first oil discharged chamber is the fourth chamber CB4 of the second hydraulic cylinder 48. Referring to FIG. 10, when the position of the second spool position is switched to the second hydraulic cylinder retraction control position ASP, the second oil supplied chamber is the fourth chamber CB4 of the second hydraulic cylinder 48, and the first oil discharged chamber is the third chamber CB3 of the second hydraulic cylinder 48.

To be more specific, the second control valve 20 further includes a first arm control valve port XP1, a second arm control valve port XP2, a third arm control valve port XP3, and a fourth arm control valve port XP4, and a fifth arm control valve port XP5. The first arm control valve port XP1 is connected to the hydraulic pump 11 via a third oil passage R3. The second arm control valve port XP2 is connected to the fourth oil passage R4. The third arm control valve port XP3 is connected to the third chamber CB3 of the second hydraulic cylinder 48 via the third oil passage R3. When the pilot pressure pp3 applied to the pilot port 20P1 is higher than the pilot pressure pp4 applied to the pilot port 20P2 by a predetermined pressure or more, the second control valve 20 makes a first arm control valve port XP1 to communicate with a third arm control valve port XP3 via the fourth arm control valve port XP4, and switches the second hydraulic cylinder extension control position AEP at which the second arm control valve port XP2 is communicated with a first drain oil passage DR1 (described later) via the fifth arm control valve port XP5. Referring to FIG. 9, the third arm control valve port XP3 and the fifth notch NC5 form a second opening SP2. The second arm control valve port XP2 and the fourth notch NC4 form a fourth opening SP4. In FIG. 5, the outline of the third arm control valve port XP3 at this time is indicated by a two dot chain line, and the second opening SP2 is indicated by hatching. The outline of the second arm control valve port XP2 at this time is indicated by a two dot chain line, and the fourth opening SP4 is indicated by hatching. The second opening area AS2, which is the area of the second opening SP2, can be continuously changed by changing the second spool position. The maximum value of the second opening area AS2 is sufficiently smaller than the area of the fifth axial opening XAP5 of the fifth notch NC5. The fourth opening area which is the area of the fourth opening SP4 can be continuously changed by changing the position of the second spool. The maximum value of the fourth opening area is sufficiently smaller than the area of the fourth axial opening XAP4 of the fourth notch NC4.

When the pilot pressure pp4 applied to the pilot port 20P2 is higher than the pilot pressure pp3 applied to the pilot port 20P1 by the predetermined pressure, the second control valve 20 switches the second spool position to the second hydraulic cylinder retraction control position ASP at which the first arm control valve port XP1 and the second arm control valve port XP2 are communicated with each other via the fourth arm control valve port XP4, and the third arm control valve port XP3 is communicated with the first drain oil passage DR1*t* via the fifth arm control valve port XP5. The second valve housing 20B includes a bypass oil passage BYP for connecting the third arm control valve port XP3 and the fifth arm control valve port XP5. The bypass oil passage BYP is also shown in FIGS. 6 and 8. Referring to FIG. 10, the second arm control valve port XP2 and the fifth notch NC5 form a second opening SP2. The third arm control valve port XP3 and the sixth notch NC6 form a fourth opening SP4. In FIG. 5, the outline of the second arm control valve port XP2 at this time is indicated by a two dot chain line, and the second opening SP2 is indicated by a check pattern. The outline of the third arm control valve port XP3 at this time is indicated by a two dot chain line, and the fourth opening SP4 is indicated by a check pattern. The second opening area AS2, which is the area of the second opening SP2, can be continuously changed by changing the second spool position. The maximum value of the second opening area AS2 is sufficiently smaller than the area of the fifth axial opening AP5 of the fifth notch NC5. The fourth opening area which is the area of the fourth opening SP4 can be continuously changed by changing the position of the second spool. The maximum value of the fourth opening areas is sufficiently smaller than the area of the sixth axial opening XAP6 of the sixth notch NC6.

When the difference between the pilot pressure pp4 applied to the pilot port 20P2 and the pilot pressure pp3 applied to the pilot port 20P1 is equal to or smaller than the predetermined pressure, the second control valve 20 switches the second spool position to the second hydraulic cylinder rest control position ANP for isolating the first arm control valve port XP1, the second arm control valve port XP2, the third arm control valve port XP3, the fourth arm control valve port XP4 and the fifth arm control valve port XP5. In the schematic views of the first control valve 25 shown in FIGS. 4, 9, and 10, a portion related to the control of the oil passage between the first arm control valve port XP1 and the fourth arm control valve port XP4 is omitted.

As shown in FIG. 3, the hydraulic circuit 100 further includes a shuttle valve 82 that outputs higher one of pressures applied to the second arm control valve port XP2 or a third arm control valve port XP3 described later and pressures applied to the second implement control valve port YP2 or the third implement control valve port YP3, and the second pressure compensation valve 76 provided in the second cylinder hydraulic circuit C2 between the second control valve 20 and the hydraulic pump 11. The second pressure compensation valve 76 communicates the first arm control valve port XP1 with the fourth arm control valve port XP4 only when the pressure applied to the first arm control valve port XP1 is higher than the pressure outputted from the shuttle valve 82 by a third threshold value or more. The third threshold pressure is equal to the fourth threshold pressure and may be referred to as the first pressure. The second pressure compensation valve 76 is configured to control the second output oil pressure of the hydraulic fluid outputted from the second control valve 20 to the second oil supplied chamber (CB3 or CB4) to be lower than the second input oil pressure inputted from the second pressure compensation valve 76 to the second control valve 20 by the first pressure.

The second control valve 20 is configured to change a second opening area AS2, which is an area of a second opening SP2 of the second control valve 20 that communicates an oil passage connecting the second oil supplied chamber (CB3 or CB4) and the second control valve 20 with an oil passage connecting the hydraulic pump 11 and the second control valve 20, according to the second spool position. The maximum value of the second opening area AS2 is sufficiently smaller than the fifth axial opening XAP5 of the fifth notch NC5, and therefore, when the second opening SP2 is regarded as an orifice, the flow rate of the hydraulic fluid passing through the second opening SP2 is known to be proportional to the product of the square root of the difference between the input and output pressures of the second opening SP2 and the second opening area AS2. As the pressure difference between the input and output of the second opening SP2 is controlled by the second pressure compensation valve 76 to be the first pressure, the second control valve 20 is controlled such that the second control valve 20 can adjust the amount of hydraulic fluid supplied per unit time to the second oil supplied chamber (CB3 or CB4) by changing the second opening area AS2 in each of the second hydraulic cylinder extension control position AEP or second hydraulic cylinder retraction control position ASP, respectively. The fourth opening SP4 can be referred to as an opening of the second control valve 20 that allows an oil passage connecting the second oil discharged chamber (CB3 or CB4) and the second control valve 20 to communicate with a first drain oil passage DR1 (described later). The fourth opening SP4 varies in size in accordance with the second opening area AS2. In FIG. 9, the second opening SP2 is an opening between the third arm control valve port XP3 and the second spool SPL2, and the fourth opening SP4 is an opening between the second arm control valve port XP2 and the second spool SPL2. In FIG. 10, the second opening SP2 is an opening between the second arm control valve port XP2 and the second spool SPL2, and the fourth opening SP4 is an opening between the third arm control valve port XP3 and the second spool SPL2.

The difference between the pressures at the input and output of the first opening SP1 of the first pressure compensation valve 77 and the difference between the pressures at the input and output of the second opening SP2 of the second pressure compensation valve 76 are set to the same first pressure. Therefore, the ratio between the flow rate of the hydraulic fluid per unit time via the first control valve 25 and the flow rate of the hydraulic fluid per unit time via the second control valve 20 can be adjusted by the ratio between the first opening area AS1 and the second opening area AS2. The second pressure compensation valve 76 and the first pressure compensation valve 77 are collectively referred to as a pressure control mechanism 78.

The pressure control mechanism 78 further includes a shuttle valve 83 that outputs a higher one of the oil pressure applied to the first oil supplied chamber (CB1 or CB2) and the hydraulic pressure applied to the second oil supplied chamber (CB3 or CB4), and a regulator valve 79 for the pressure output from the hydraulic pump 11 to be equal to or higher than the above described first pressure. The position of the regulator valve 79 is switched to the first position PV1 when the oil pressure is lower than the higher oil pressure and higher than the first oil pressure, and is switched to the second position PV2 when the hydraulic pressure is higher than the higher hydraulic pressure by the first hydraulic pressure or more. Thus, even if the hydraulic pressure increases while at least one of the first hydraulic cylinder 49 and the second hydraulic cylinder 48 is being controlled, the hydraulic pump 11 can supply a pressure higher than the first pressure, and therefore the first hydraulic cylinder 49 and the second hydraulic cylinder 48 can be continuously controlled. When the hydraulic pump 11 is controlled in this way, the difference between the lower one of the hydraulic pressure s applied to the first oil supplied chamber (CB1 or CB2) and the second oil supplied chamber (CB3 or CB4) and the hydraulic pressure of the hydraulic fluid output from the hydraulic pump 11 is larger than the first oil pressure. However, the functions of the first and second pressure compensation valves 77 and 76 adjust the difference between the pressures at the input and output of the first opening SP1 and the difference between the pressures at the input and output of the second opening SP2 to the same first pressures. The pressure control mechanism 78 may use another hydraulic control component to set the hydraulic pressure to be equal to or higher than the first hydraulic pressure, which is higher than the hydraulic pressure applied to the first oil supplied chamber (CB1 or CB2) or the hydraulic pressure applied to the second oil supplied chamber (CB3 or CB4).

Thus, as the pressure control mechanism 78 can adjust the amount of hydraulic fluid via the first control valve 25 by the first opening area AS1, the first control valve 25 is configured to adjust the hydraulic fluid per unit time supplied to the first oil supplied chamber (CB1 or CB2) per unit time and the amount of hydraulic fluid discharged from the first oil discharged chamber (CB2 or CB1) per unit time in accordance with the first spool position, which is the position of the first spool SPL1. As the pressure control mechanism 78 can adjust the amount of hydraulic fluid via the second control valve 20 by the second opening area AS2, the second control valve 20 is configured to adjust the amount of hydraulic fluid supplied to the second oil supplied chamber (CB3 or CB4) per unit time and the amount of hydraulic fluid discharged from the second oil discharged chamber (CB4 or CB3) per unit time in accordance with the second spool position, which is the position of the second spool SPL2.

The first pilot oil passage PR1 connects the pilot ports 20P1, 20P2 with a pilot pump 12. To be specific, the first pilot oil passage PR1 includes a partial oil passage PR10*f* common to the second pilot oil passage PR2 extending from the pilot pump 12 to the third pilot control valve 60 and the fourth pilot control valve 61, a partial oil passage PR11 extending from the third pilot control valve 60 to the pilot port 20P1, and a partial oil passage PR12 extending from the fourth pilot control valve 61 to the pilot port 20P2. The hydraulic circuit 100 further includes an additional solenoid valve 14 provided in the partial oil passage PR10. That is, the additional solenoid valve 14 is provided in at least one of the first pilot oil passage PR1 between the pilot pump 12 and the third pilot control valve 60 and the fourth pilot control valve 61 and the second pilot oil passage PR2 between the pilot pump 12 and the first pilot control valve 65 and the second pilot control valve 66. The additional solenoid valve 14 is a solenoid valve capable of changing the pressure of the hydraulic fluid output from the pilot pump 12. The pressure of the hydraulic fluid can be changed by control from the controller 15.

The third pilot control valve 60 is a solenoid control valve provided in the first pilot oil passage PR1. The third pilot control valve 60 includes a solenoid 60*s* and controls the hydraulic pressure of the pilot oil applied to the pilot port 20P1 based on the control amount u3 applied to the solenoid 60*s*. The arm input member 63 is provided with a rotation detection sensor 18 such as a potentiometer, and the controller 15 acquires an operation amount of the arm input member 63 operated for lifting and lowering the arm 45 from the rotation detection sensor 18, and outputs a control amount U3 applied to the solenoid 60*s* based on the operation amount. The fourth pilot control valve 61 is a solenoid control valve provided in the first pilot oil passage PR1. The fourth pilot control valve 61 includes a solenoid 61*s* and controls the hydraulic pressure of the pilot oil applied to the pilot port 20P2 based on the control amount u4 applied to the solenoid 61*s*. The controller 15 acquires the operation amount of the arm input member 63 operated for raising and lowering the arm 45 from the rotation detection sensor 18, and outputs the control amount u4 to be applied to the solenoid 61*s* based on the operation amount. When the arm input member 63 is tilted forward, the controller 15 operates the third pilot control valve 60, and the pilot pressure pp3 is output from the third pilot control valve 60 to the partial oil passage PR11. The pilot pressure pp3 acts on the pilot port 20P1 of the second control valve 20. When the arm input member 63 is tilted rearward, the controller 15 operates the fourth pilot control valve 61 to output the pilot pressure pp4 to the partial oil passage PR12 from the fourth pilot control valve 61. The pilot pressure pp4 acts on the pilot port 20P2 of the second control valve 20. To be more specific, when an operation for raising the arm 45 is performed by the arm input member 63 (an operation for tilting the arm input member 63 rearward), the pilot pressure pp3 applied to the pilot port 20P1 becomes larger than the pilot pressure pp4 applied to the pilot port 20P2 by the predetermined pressure. When an operation for lowering the arm 45 is performed by the arm input member 63 (an operation of tilting the arm input member 63 forward), the pilot pressure pp4 applied to the pilot port 20P2 becomes higher than the pilot pressure pp3 applied to the pilot port 20P1 by the predetermined pressure. When the operation amount of the arm input member 63 is smaller than the predetermined amount, the absolute value of the difference between the pilot pressure pp4 applied to the pilot port 20P2 and the pilot pressure pp3 applied to the pilot port 20P1 is equal to or smaller than the predetermined pressure.

The second pilot oil passage PR2 connects the pilot ports 25P1 and 25P2 to the pilot pump 12. To be specific, the second pilot oil passage PR2 includes a partial oil passage PR10 common to the first pilot oil passage PR1 extending from the pilot pump 12 to the first pilot control valve 65 and the second pilot control valve 66, a partial oil passage PR21 extending from the first pilot control valve 65 to the pilot port 25P1, and a partial oil passage PR22 extending from the second pilot control valve 66 to the pilot port 25P2. The first pilot control valve 65 is a solenoid control valve provided in the second pilot oil passage PR2. The first pilot control valve 65 includes a solenoid 65*s*, and controls the hydraulic pressure of the pilot oil applied to the pilot port 25P1 based on a control amount u1 applied to the solenoid 65*s*. The implement input member 68 is mounted with the rotation detection sensor 19 such as a potentiometer, and the controller 15 acquires the tilt angle of the implement input member 68 detected by the rotation detection sensor 18, and outputs a control amount u1 to be applied to the solenoid 65*s* based on the operation amount. The second pilot control valve 66 is a solenoid control valve provided in the second pilot oil passage PR2. The second pilot control valve 66 includes a solenoid 66*s*, and controls the hydraulic pressure of the pilot oil applied to the pilot port 25P2 based on the control amount u2 applied to the solenoid 66*s*. The controller 15 acquires the tilt angle of the implement input member 68 detected by the rotation detection sensor 18, and outputs a control amount u2 to be applied to the solenoid 66*s* based on the operation amount.

When the implement input member 68 is tilted to the right side, the controller 15 operates the first pilot control valve 65, and the pilot pressure pp1 is output from the first pilot control valve 65 to the partial oil passage PR21. The pilot pressure pp1 acts on the pilot port 25P1 of the first control valve 25. When the implement input member 68 is tilted to the left side, the controller 15 operates the second pilot control valve 66, and the pilot pressure pp2 is output from the second pilot control valve 66 to the partial oil passage PR22. The pilot pressure pp2 acts on the pilot port 25P2 of the first control valve 25.

To be more specific, when an operation for tilting the implement tip 41T downward by the implement input member 68 (an operation for tilting the implement input member 68 to the right side) is performed, the pilot pressure pp1 applied to the pilot port 25P1 becomes larger than the pilot pressure pp2 applied to the pilot port 25P2 by the predetermined pressure. When an operation for tilting the implement tip 41T upward is performed by the implement input member 68 (an operation of tilting the implement input member 68 to the left side), the pilot pressure pp2 applied to the pilot port 25P2 becomes larger than the pilot pressure pp1 applied to the pilot port 25P1 by the predetermined pressure. When the operation amount of the implement input member 68 is smaller than the predetermined amount, the difference between the pilot pressure pp2 applied to the pilot port 25P2 and the pilot pressure pp1 applied to the pilot port 25P1 is equal to or smaller than the predetermined pressure.

The bypass oil passage BR1 is configured to connect the fourth oil passage R4 and the first oil passage R1. The bypass oil passage BR1 is connected to the fourth oil passage R4 at the first joint J1. The bypass oil passage BR1 is connected to the first oil passage R1 at the third joint J3. The switching mechanism 70 is configured to control connection and disconnection of the fourth oil passage R4 and the first oil passage R1 by the bypass oil passage BR1. The controller 15 is configured to control the switching mechanism 70 to connect the fourth oil passage R4 and the first oil passage R1 when it is determined that the horizontal control of the implement 41 is performed. The controller 15 is, for example, a hardware controller such as an ECU. Accordingly, the controller 15 comprises electronic circuit such as a hardware processor 15P and a memory 15M. The memory 15M may be referred to as a memory.

The hardware processor 15P is configured to control the hydraulic pump 11, the engine 6 and the first control valve 25. The controller 15 is configured to control the switching mechanism 70 to connect the fourth oil passage R4 and the first oil passage R1 when performing the implement posture mechanical control for controlling the implement direction by changing the connection relationship of the hydraulic circuit 100. That is, when the third instruction is received and the second instruction for increasing the arm height $H_A$ is received, the controller 15 (hardware processor 15P) controls the switching mechanism 70 to connect the fourth oil passage R4 and the first oil passage R1.

The switching mechanism 70 includes a solenoid valve 71 and a first switching valve 72. The first switching valve 72 is provided in the fourth oil passage R4 between the first joint J1 and the second control valve 20, and has a first pilot port PP1. The first switching valve 72 is configured to block the connection between the second control valve 20 and the fourth chamber CB4 of the second hydraulic cylinder 48 via the fourth oil passage R4 when a pressure of the pilot oil (a first pilot pressure) which is applied to the first pilot port PP1 is equal to or higher than a first threshold pressure or higher, and to connect the second control valve 20 and the fourth chamber CB4 via the fourth oil passage R4 when the pressure of the pilot oil which is applied to the first pilot port PP1 is lower than or equal to a first threshold pressure. The position of the solenoid valve 71 can be switched between a second position VP2 for communicating the first pilot port PP1 with the hydraulic fluid tank 10 and a first position VP1 for connecting the first pilot port PP1 to an oil passage capable of applying a pilot pressure equal to or higher than a first threshold pressure to the first pilot port PP1.

The solenoid of the solenoid valve 71 is connected to the controller 15. The work vehicle 1 further includes a first input device 16 configured to receive an instruction (a fourth instruction) for performing the implement posture mechanical control by changing the connection relationship of the hydraulic circuit 100. In the present embodiment, this instruction is referred to as a third instruction. For example, when the third instruction is received and the second instruction for increasing the arm height $H_A$ is received, the controller 15 transmits an electric signal for switching the position of the solenoid valve 71 to the first position VP1 to the solenoid valve 71.

The first input device 16 includes ON/OFF changeover switch 16SW for turning ON/OFF the instrument posture mechanical control which is electrically connected to the hardware processor 15P. When the switch 16SW is changed to ON, then, the controller 15 transmits an electric signal for switching the position of the solenoid valve 71 to the first position VP1 to the solenoid valve 71. The switch 16SW is turned on when the implement posture mechanical control is performed. When the implement posture mechanical control is turned on by the switch 16SW and the second input device (arm input member 63) receives the raising instruction, the hardware processor 15P switches the position of the solenoid valve 71 to the first position VP1. When the implement posture mechanical control is turned off by the switch 16SW, the hardware processor 15P switches the position of the solenoid valve 71 to the second position VP2 regardless of the operation of the second input device (arm input member 63).

The work vehicle 1 further includes an additional bypass oil passage BR2 that connects the second oil passage R2 and a fourth oil passage R4 between the first switching valve 72 and the second control valve 20. The additional bypass oil passage BR2 is connected to the fourth oil passage R4 at the second joint J2, and is connected to the second oil passage R2 at the fourth joint J4. The switching mechanism 70 further includes a second switching valve 73 provided in the bypass oil passage BR1 and a third switching valve 74 provided in the additional bypass oil passage BR2. The additional bypass oil passage BR2 includes a partial oil passage BR20 from the second joint J2 to the third switching valve 74, and a partial oil passage BR21 from the third switching valve 74 to the fourth joint J4. The work vehicle 1 further includes a first connection passage CR1 connecting an additional bypass oil passage BR2 an additional bypass oil passage BR2 (partial oil passage BR20) between the second joint J2 and the third switching valve 74, a second connection passage CR2 connecting a bypass oil passage BR1 (partial oil passage BR11) between the third joint J3 and the second switching valve 73, and a third connection passage CR3 connecting the second switching valve 73 and the bypass oil passage BR1 (partial oil passage BR11) between the second connection passage CR2 and the second switching valve 73.

When the first oil pressure of the bypass oil passage BR1 (partial oil passage BR10) between the first joint J1 and the second switching valve 73 is larger than the second oil pressure of the first connection passage CR1, the second switching valve 73 is configured to switch its position to the first communication position CP1 to connect the first joint J1 and the third joint J3. When the second oil pressure is equal to or greater than the first oil pressure, the second switching valve 73 is configured to switch its position to the first blocking position BP1 to block the first joint J1 and the third joint J3. When it is switched to the first blocking position BP1, the second switching valve 73 is configured to connect the partial oil passage BR10 and the first connection passage CR1. When it is switched to the first communication position CP1, the second switching valve 73 is configured to block the partial oil passage BR10 and the first connection passage CR1.

The third switching valve 74 switches to any one of the second shutoff position BP2, the twenty first communication position CP21, and the twenty second communication position CP22 based on the third oil pressure of the additional bypass oil passage BR2 (partial oil passage BR2) between the second joint J2 and the third switching valve 74; and the fourth oil pressure in the second connection passage CR2. Note that the twenty first communication position CP21 and the twenty second communication position CP22 are collectively referred to as a second communication position CP2. Since the check valve CKV is provided between the second connection passage CR2 and the third joint J3, the hydraulic pressure of the first oil passage R1 does not affect the hydraulic pressure of the second connection passage CR2. The third switching valve 74 is configured to switch its position to a second communication position CP2 for communicating the second joint J2 with the fourth joint J4 when the third oil pressure is smaller than the fourth oil pressure, and to switch to a second shutoff position BP2 for shutting off the communication between the second joint J2 and the fourth joint J4 when the fourth oil pressure is equal to or smaller than the third oil pressure. The third switching valve 74 switches to a twenty first communication position CP21 to communicate the second joint J2 with the fourth joint J4, and disconnect the third connection passage CR3 and the partial oil passage BR11. On the other hand, when the third oil pressure is smaller than the fourth oil pressure by a predetermined pressure or more, the switching to the twenty first communication position CP21 is performed, the second joint J2 and the fourth joint J4 are communicated, and the third connection passage CR3 and the bypass oil passage BR1 (partial oil passage BR11) are connected. This can prevent the oil pressure of the bypass oil passage BR1 (partial oil passage BR11) from becoming too high.

The work vehicle 1 further includes a first drain oil passage DR1 that connects the fourth chamber CB4 and the hydraulic fluid tank 10 when the second control valve 20 and the fourth chamber CB4 of the second hydraulic cylinder 48 is connected via the fourth oil passage R4 by the first switching valve 72. The switching mechanism 70 further includes a third pilot oil passage PR3 connected to a first counterbalance valve BV1 provided in the first drain oil passage DR1, the fourth switching valve 75, and the first pilot port PP1 of the first switching valve 72 and the fourth switching valve, the switching and the first pilot port PP1 of the first switching valve 72, and a fourth pilot oil passage PR4 connecting the fourth switching valve 75 and the first drain oil passage DR1 between the first switching valve 72 and the first counterbalance valve BV1, and a second drain oil passage DR2 connecting the fourth switching valve 75 and the hydraulic fluid tank 10. The first counterbalance valve BV1 is a control valve configured to be opened when the pressure in the joint J8 shown in the figure becomes higher than the hydraulic pressure in the joint J9 by a predetermined value or more, and to allow the hydraulic fluid to flow from the joint J8 to the joint J9. The first threshold pressure is lower than the predetermined pressure at which the first counterbalance valve BV1 opens. Note that the same counterbalance valves BV2 to BV4 are connected to the fourth to sixth drain oil passages DR4 to DR6 connected to the third oil passage R3, the first oil passage R1, and the second oil passage R2, respectively. The fourth to sixth drain oil passages DR4 to DR6 are connected to the first drain oil passage DR1.

The fourth switching valve 75 includes a first connection port ZP1 connected to the third pilot oil passage PR3, a second connection port ZP2 connected to the fourth pilot oil passage PR4, a third connection port ZP3 connected to the second drain oil passage DR2, and a switching-valve pilot port 75P to which a pilot pressure is applied by the solenoid valve 71. When the pilot oil pressure is applied to the switching-valve pilot port 75P by the second threshold or more, the position of the fourth switching valve 75 is switched to the drain position DP at which the first connection port ZP1, the second connection port ZP2, and the third connection port ZP3 are communicated with each other. When the pilot oil pressure smaller than the second threshold pressure is applied to the switching-valve pilot port 75P, the position of the fourth switching valve 75 is switched to the pressurizing position UP at which the first connection port ZP1 and the second connection port ZP2 are communicated with each other and the third connection port ZP3 is disconnected from the first connection port ZP1 and the second connection port ZP2.

When the position of the solenoid valve 71 is switched to the second position VP2 by the controller 15, the pilot oil pressure is applied to the switching-valve pilot port 75P at a second threshold pressure or higher. Thus, the position of the fourth switching valve 75 is switched to the drain position DP, and the pilot pressure applied to the first pilot port PP1 becomes lower than the first threshold pressure. In this case, the first switching valve 72 is opened, and the second control valve 20 and the fourth chamber CB4 are connected via the fourth oil passage R4, and the fourth oil passage R4 and the first drain oil passage DR1 to the first counterbalance valve BV1 are connected.

At this time, when the arm input member 63 is tilted forward, the pilot pressure pp3 applied to the pilot port 20P2 becomes larger than the pilot pressure pp4 applied to the pilot port 20P2 by the predetermined pressure, and thus the position of the second control valve 20 is switched to the second hydraulic cylinder extension control position AEP. Therefore, the hydraulic fluid having a pressure higher than the third threshold pressure from the hydraulic pump 11 is supplied to the third chamber CB3 of the second hydraulic cylinder 48 through the second control valve 20. As a result, the hydraulic fluid is output from the fourth chamber CB4 of the second hydraulic cylinder 48 to the fourth oil passage R4. Since the first switching valve 72 is opened, the hydraulic fluid is sent to the second arm control valve port XP2 of the second control valve 20 and is discharged to the third drain oil passage DR3 connected to the first drain oil passage DR1.

When the arm input member 63 is tilted rearward, the pilot pressure pp4 applied to the pilot port 20P2 becomes higher than the pilot pressure pp3 applied to the pilot port 20P1 by the predetermined pressure, and thus the position of the second control valve 20 is switched to the second hydraulic cylinder retraction control position ASP. Therefore, the hydraulic fluid having a pressure higher than the third threshold pressure is supplied to the fourth chamber CB4 of the second hydraulic cylinder 48 via the second control valve 20 and the first switching valve 72. Thus, the hydraulic fluid is output from the third chamber CB3 of the second hydraulic cylinder 48 to the third oil passage R3. The hydraulic fluid is sent to the third arm control valve port XP3 of the second control valve 20 and is discharged to the third drain oil passage DR3 connected to the first drain oil passage DR1.

When the position of the solenoid valve 71 is switched to the second position VP2 by the controller 15, the control of the implement 41 is performed independently of the control of the arm 45 except for automatic implement return control described later. In this state, when the implement input member 68 is tilted to the right, the pilot pressure pp1 applied to the pilot port 25P1 becomes larger than the pilot pressure pp2 applied to the pilot port 25P2 by the predetermined pressure, and thus the position of the first control valve 25 is switched to the first hydraulic cylinder extension control position BEP. Therefore, the hydraulic fluid having a pressure higher than the fourth threshold pressure is supplied to the first chamber CB1 of the first hydraulic cylinder 49 through the first control valve 25. Thus, the hydraulic fluid is output from the second chamber CB2 of the first hydraulic cylinder 49 to the second oil passage R2. The hydraulic fluid is sent to the third implement control valve port YP3 of the first control valve 25 and is discharged to the seventh drain oil passage DR7 connected to the first drain oil passage DR1.

When the implement input member 68 is tilted to the left, the pilot pressure pp2 applied to the pilot port 25P2 becomes larger than the pilot pressure pp2 applied to the pilot port 25P1 by the predetermined pressure, and thus the position of the first control valve 25 is switched to the first hydraulic cylinder retraction control position BSP. Therefore, the hydraulic fluid having a pressure higher than the fourth threshold pressure is supplied to the second chamber CB2 of the first hydraulic cylinder 49 through the first control valve 25. Thus, the hydraulic fluid is output from the first chamber CB1 of the first hydraulic cylinder 49 to the first oil passage R1. The hydraulic fluid is sent to the second implement control valve port YP2 of the first control valve 25 and is discharged to the seventh drain oil passage DR7 connected to the first drain oil passage DR1.

After the position of the solenoid valve 71 is switched to the second position VP2, when the position of the solenoid valve 71 is switched to the first position VP1 by the controller 15, pilot oil pressure lower than the second threshold pressure is applied to the switching-valve pilot port 75P, and the position of the fourth switching valve 75 is switched to the pressurizing position UP. At the beginning of the switching, the pilot pressure applied to the first pilot port PP1 is lower than the first threshold pressure, but the pilot pressure immediately increases due to the hydraulic fluid flowing from the fourth oil passage R4. Since the predetermined pressure at which the first counterbalance valve opens is higher than the first threshold pressure, the pilot pressure exceeds the first threshold pressure, and the first switching valve 72 is closed. Therefore, the connection between the second control valve 20 and the fourth chamber CB4 of the second hydraulic cylinder 48 via the fourth oil passage R4 is cut off.

When the first switching valve 72 is closed, if the operation of raising the arm 45 is performed (the operation of tilting the arm input member 63 rearward) and the implement 41 is not operated (the operation of tilting the implement input member 68 to nothing), the position of the second control valve 20 is switched to the second hydraulic cylinder extension control position AEP and the position of the first control valve 25 is switched to the first hydraulic cylinder rest control position BNP. When the arm input member 63 and the implement input member 68 are the same, the same input member is not tilted to the left or right but tilted to the rear side.

At this time, as described above, the hydraulic fluid flows out from the fourth chamber CB4 of the second hydraulic cylinder 48, but flows from the first joint J1 to the second switching valve 73 because the first switching valve 72 is closed. Further, since the additional bypass oil passage BR2 and the first connection passage CR1 connected thereto are connected to the third drain oil passage DR3, the first oil pressure of the bypass oil passage BR1 (partial oil passage BR10) between the first joint J1 and the second switching valve 73 is larger than the second oil pressure of the first connection passage CR1. As a result, the position of the second switching valve 73 is switched to the first communication position CP1. At this time, the hydraulic fluid is sent from the second switching valve 73 to the first chamber CB1 of the first hydraulic cylinder 49 via the bypass oil passage BR1 (partial oil passage R1) and the first oil passage R1 (partial oil passages R13). At this time, the hydraulic fluid is output from the second chamber CB2 of the first hydraulic cylinder 49 to the second oil passage R2 and the additional bypass oil passage BR2 (partial oil passage BR21), however, since the third switching valve 74 is located at the second shutoff position BP2, the hydraulic fluid cannot flow, and the oil pressure of the second connection passage CR2 rises. When the difference between the fourth oil pressure of the second connection passage CR2 and the third oil pressure of the additional bypass oil passage BR2 (partial passage BR20) exceeds the connection threshold pressure, the switching to either the twenty first communication position CP21 or the twenty second communication position CP22 is performed based on the difference between the third oil pressure of the additional bypass oil passage BR2 (partial passage BR20) and the fourth oil pressure of the second connection passage CR2. When the difference between the fourth oil pressure and the third oil pressure is smaller than a predetermined switching threshold value, the position of the third switching valve 74 is switched to the twenty first communication position CP21. When the difference between the fourth oil pressure and the third oil pressure is equal to or larger than a predetermined switching threshold value, the position of the third switching valve 74 is switched to the twenty second communication position CP22. When the position of the third switching valve 74 is switched to the twenty first communication position CP21 or the twenty second communication position CP22, the hydraulic fluid output from the second chamber CB2 of the first hydraulic cylinder 49 is discharged to the hydraulic fluid tank 10 via the additional bypass oil passage BR2 and the third drain oil passage DR3.

However, when the hydraulic fluid flows out from the fourth chamber CB4 of the second hydraulic cylinder 48, when the second oil pressure of the first connection passage CR1 is increased and the position of the second switching valve 73 is switched to the first blocking position BP1, the hydraulic fluid flowing out from the fourth chamber CB4 is discharged to the hydraulic fluid tank 10 through the first connection passage CR1, the additional bypass oil passage BR2, and the third drain oil passage DR3. Thus, as the hydraulic fluid flows into the third chamber CB3 of the second hydraulic cylinder 48, part of the oil discharged from the fourth chamber CB4 of the second hydraulic cylinder 48 flows into the first chamber CB1 of the first hydraulic cylinder 49, and the rest is discharged to the hydraulic fluid tank 10. The amount of the hydraulic fluid discharged to the hydraulic fluid tank 10 is adjusted by empirically adjusting the size of the throttle at the first blocking position BP1 of the second switching valve 73 so that the change in the elevation angle of the arm 45 with respect to the vehicle body 2 per unit amount of the hydraulic fluid discharged to the hydraulic fluid tank 10 is substantially equal to the change in the swing angle with respect to the arm 45. In this way, the ratio of the amount of the hydraulic fluid flowing into the first chamber CB1 of the first hydraulic cylinder 49 to the amount of the hydraulic fluid flowing out of the fourth chamber CB4 of the second hydraulic cylinders 48 is adjusted by the size of the throttle of the second switching valve 73 at the first blocking position BP1. The ratio of the amount of the hydraulic fluid flowing into the first chamber CB1 of the first hydraulic cylinder 49 is adjusted. It is referred to the first hydraulic cylinder=the second hydraulic cylinder oil amount variation ratio K0. The second switching valve 73 is controlled to switch between the first communication position CP1 and the first blocking position BP1 so that the amount of the hydraulic fluid per unit time output from the second control valve 20 to the second oil supplied chamber (CB3 or CB4) multiplied by the first hydraulic cylinder=the second hydraulic cylinder oil amount variation ratio K0 is output from the first control valve 25 to the first oil supplied chamber (CB1 or CB2) per unit time. Thus, it is controlled to change the swing angle of the implement tip 41T to the arm 45 corresponding to the elevation angle of the arm, and to make a direction from the joint 43 toward the implement tip 41T face toward substantially the horizontal direction. Such control is called horizontal control. Such control is the implement posture mechanical control described above.

When the first switching valve 72 is closed, if the operation of lowering the arm 45 is performed (the operation of tilting the arm input member 63 forward) and the implement 41 is not operated (the operation of tilting the implement input member 68 to nothing), the position of the second control valve 20 is switched to the second hydraulic cylinder retraction control position ASP and the position of the first control valve 25 is switched to the first hydraulic cylinder rest control position BNP. At this time, the hydraulic fluid having a pressure that exceeds the third threshold pressure is output from the second arm control valve port XP2. Since the third threshold pressure is higher than the first threshold pressure and the threshold pressure for opening the first counterbalance valve BV1, the hydraulic fluid is sent to the fourth chamber CB4 of the second hydraulic cylinder 48 via the fourth oil passage R4 by pushing and opening the first switching valve 72. At this time, the hydraulic fluid is discharged from the third chamber CB3 of the second hydraulic cylinder 48 to the hydraulic fluid tank 10 via the third oil passage R3 and the third drain oil passage DR3.

<Implement Posture Electric Control>

Figure 11:
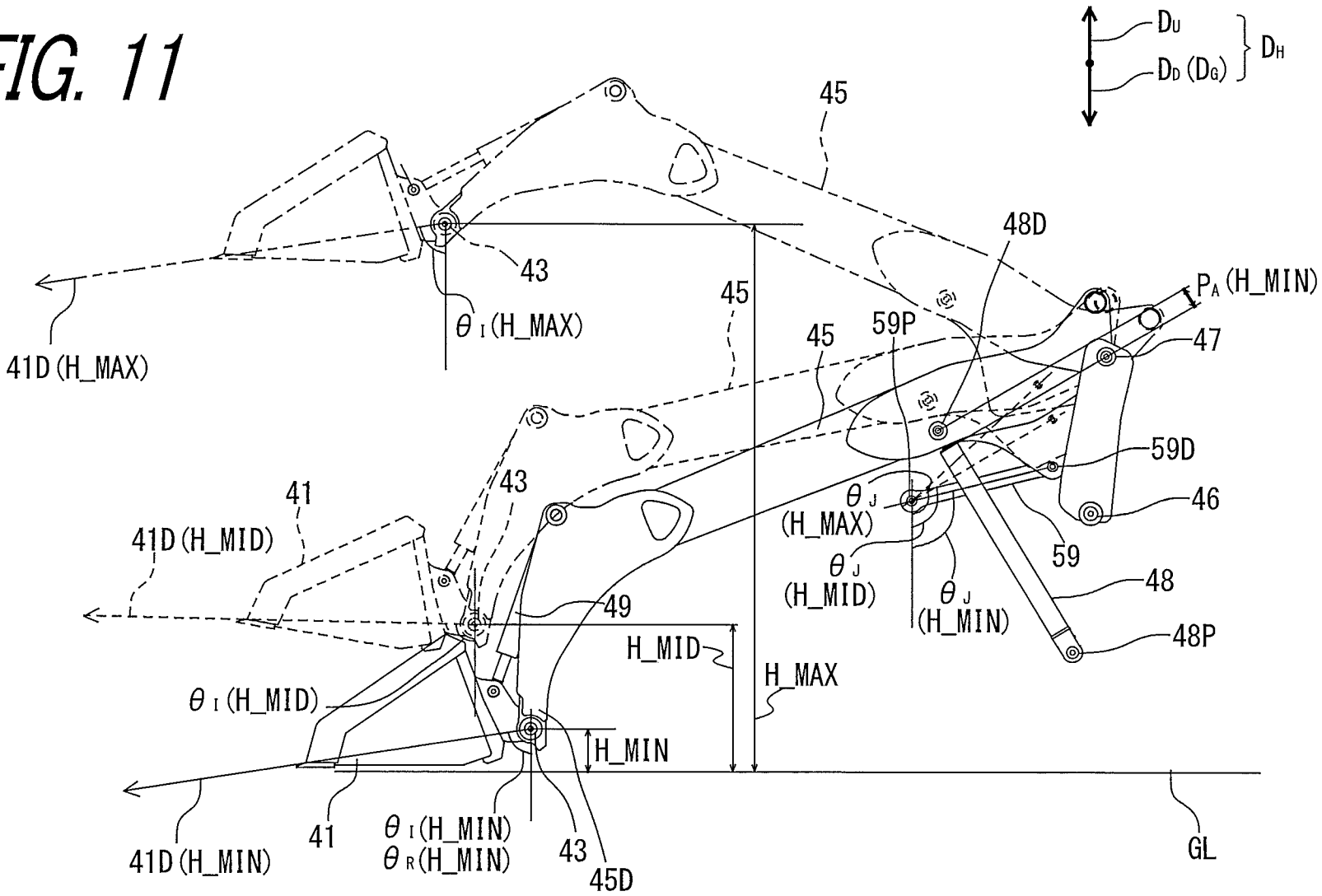
FIG. 11 is a conceptual diagram of the implement posture electric control/implement posture mechanical control in the case where the implement posture detection sensor is formed of a first inertial measurement unit and a second inertial measurement unit, and the arm posture detection sensor is formed of a potentiometer.

Next, the implement posture electric control will be described. FIG. 11 is a conceptual diagram of the implement posture electric control/implement posture mechanical control in the case where the implement posture detection sensor 57 is formed of the first inertial measurement unit 57*a* and the second inertial measurement unit 57*b*, and the arm posture detection sensor 56 is formed of the potentiometers 56*r*. The implement posture electric control electrically controls the implement direction 41D by changing the swing angle of the implement tip 41T with respect to the arm 45 in accordance with the elevation angle of the arm 45 as in the implement posture mechanical control only by operating the arm input member 63 (only by operating the operation lever 55 in the front-rear direction) so that the direction from the joint 43 to the implement tip 41T is substantially horizontal. The position and posture of the arm 45 can be defined by an arm height $H_A$. The arm height $H_A$ at the start of the implement posture electric control is set as an initial height $H_A$*(0). The arm height $H_A$ at the start of the implement posture electric control is set as an initial height $H_A$*(0), and the implement direction 41D at the start of the implement posture electric control is set as the initial orientation D(0).

In the automatic implement return control, the implement direction 41D is electrically controlled such that the amount of change in the second posture parameter when the arm height $H_A$ changes from STA_H to $H_A$ is the same as the amount of change in the second posture parameter when the arm height $H_A$ changes from STA_H to $H_A$ in the implement posture mechanical control. In order to obtain the arm height $H_A$ from the outputs of the potentiometer 56*r*, the memory 15M stores a table representing the correspondence between the rotation angle $\theta_j$ of the fulcrum shaft 59P and the arm height $H_A$. The hardware processor 15P is configured to obtain the arm height $H_A$ from the rotation angle $\theta_j$ detected by the potentiometer 56*r* based on the correspondence relationship.

In order to realize the implement posture electric control, the memory 15M stores a first correspondence relationship (first relational data) in which a first posture parameter and a second posture parameter that change in the implement posture mechanical control are associated with each other. To be specific, the first correspondence relationship represents a correspondence relationship between the arm height $H_A$ and the implement direction 41D which changes when the implement posture mechanical control is executed after the arm height $H_A$ is set to the reference height serving as the reference of the arm height $H_A$ by the second input device (arm input member 63) and the implement direction 41D is set to the reference implement direction serving as the reference of the implement direction 41D by the third input device (implement input member 68). The reference height is the initial height $H_A$*(0). The reference implement direction is the initial orientation D(0). In the first correspondence relationship, the first posture parameter and the second posture parameter when the rotation speed $N_E$ of the engine 6 is rotated at the first rotation speed are associated with each other.

The memory 15M stores at least one second correspondence relationship (at least one set of second relational data) in which the first posture parameter is associated with the second posture parameter when the implement posture electric control is performed in a state where the engine 6 is driven at least one rotation speed different from the first rotation speed.

To be more specific, the at least one second correspondence relationship represents a correspondence relationship between the arm height $H_A$ and the implement direction 41D, which changes when the implement posture mechanical control is executed after the arm height $H_A$ is set to a reference height serving as a reference of the arm height $H_A$ by the second input device (arm input member 63) and the implement direction 41D is set to a reference implement direction serving as a reference of the implement direction 41D by the third input device (implement input member 68) when the rotation speed of the engine 6 is at least one second rotation speed different from the first rotation speed.

Figure 12:
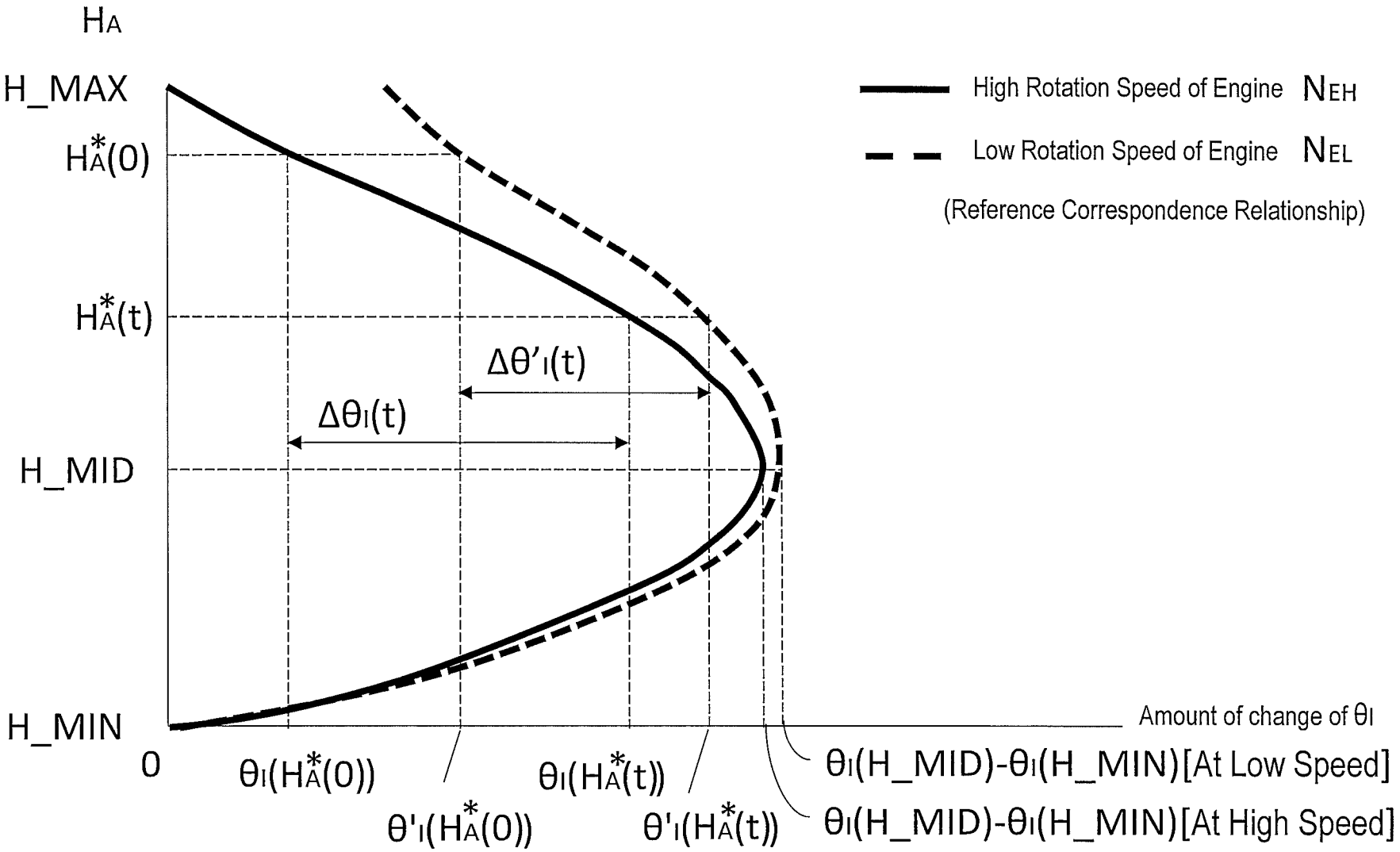
FIG. 12 is a diagram showing the relationship between the change in arm height and the change in implement inclination angle in the implement posture electric control.

FIG. 12 shows a map M1 representing first correspondence relationship and the second correspondence in the case where the second posture parameter is the implement inclination angle $\theta_I$. FIG. 4 shows that the implement inclination angle $\theta_I$ corresponding to the arm height $H_A$ when the implement posture mechanical control is performed is represented as θI (H_MIN) which is the implement inclination angle $\theta_I$ when the arm height $H_A$ is equal to H_MIN, being 0. H_MIN is the minimum arm height $H_A$ at which the lower end of the implement 41 coincides with the ground contact surface GL of the traveling device 3. In FIG. 12, as an example, the relationship between the first posture parameter and the second posture parameter when the rotation speed $N_E$ of the engine 6 is high ($N_{EH}$) may be referred to as a first correspondence relationship, and the relationship between the first posture parameter and the second posture parameter when the rotation speed $N_E$ of the engine 6 is low ($N_{EL}$) may be referred to as a second correspondence relationship. The relationship between the first posture parameter and the second posture parameter when the rotation speed $N_E$ of the engine 6 is the low speed (NEL) may be referred to as a second correspondence relationship, and the relationship between the first posture parameter and the second posture parameter when the rotation speed NE of the engine 6 is the high speed ($N_{EH}$) may be referred to as the first correspondence relationship. The case where the rotation speed $N_E$ of the engine 6 is low refers to, for example, a case where the engine 6 is rotating at a low idle rotation speed, and the case where the rotation speed $N_E$ of the engine 6 is high refers to, for example, a case where the engine 6 is rotating at a high idle rotation speed. In FIG. 12, the rotation speed $N_E$ of the engine 6 may include a speed other than the high speed ($N_{EH}$) and the low speed ($N_{EL}$) described above. In this case, a plurality of second correspondence relationships exist. Ideally, it is desirable that the implement inclination angle $\theta_I$ changes at 0 regardless of the arm height $H_A$. However, since the implement posture mechanical control is realized by the size of the throttle of the second switching valve 73 at the first blocking position BP1, the implement inclination angle $\theta_I$ transitions so that the implement inclination angle $\theta_I$ becomes the maximum in the middle stage (when the arm height HA is H_MID). By performing the control in this manner, it is possible to prevent the accumulation of errors in the implement inclination angle $\theta_I$ when the implement posture mechanical control and the implement posture electric control are repeated.

Furthermore, the first input device 16 is configured to receive an instruction for performing the implement posture electric control to control the implement direction 41D based on the first correspondence relationship. In the following embodiments, this instruction is referred to as a first instruction. The switch 16SW is configured to set both the implement posture electric control and the implement posture mechanical control to OFF, and set both the implement posture electric control and the implement posture mechanical control to ON. That is, the switch 16SW is also a switch for turning ON/OFF the implement posture electric control.

When the switch 16SW is turned on, the second instruction as the raising instruction is received by the second input device (arm input member 63), and the first instruction as the dump instruction (the direction in which the implement direction 41D is directed downward) is received, the hardware processor 15P performs the control of the implement direction 41D based on the first instruction in addition to the implement posture mechanical control. When the switch 16SW is turned on, the second instruction as the lowering instruction is received by the second input device (arm input member 63), and the first instruction as the scooping instruction (the direction in which the implement direction 41D is directed upward) is received, the hardware processor 15P switches the position of the solenoid valve 71 to the second position PV2 to disable the implement posture mechanical control, and controls the implement direction 41D based on the first instruction.

When the switch 16SW is turned on, the second instruction as the lowering instruction is received by the second input device (arm input member 63), and the first instruction as the dump instruction (the direction in which the implement direction 41D is directed downward) is received, the hardware processor 15P switches the position of the solenoid valve 71 to the second position PV2 to disable the implement posture mechanical control, and controls the implement direction 41D based on the first instruction. When the switch 16SW is turned on and the second input device (arm input member 63) receives the second instruction as a lowering instruction, the hardware processor 15P disables the implement direction mechanical control by switching the position of the solenoid valve 71 to the second position PV2 when the first instruction as a scooping instruction (an instruction to direct the implement direction 41D upward) is received, and controls the implement direction 41D based on the larger one of the control amount of the implement direction 41D based on the first instruction and the control amount of the implement direction 41D by the implement direction electric control based on the second instruction. The control amount will be described later.

If there is no at least one second correspondence in FIG. 12 (there is only the above-mentioned fast ($N_{EH}$) correspondence), the hardware processor 15P may be configured to calculate a first posture parameter $H_A$*(0) representing a start arm height which is an arm height $H_A$ at a time of the second instruction being received after the first instruction is received $H_A$*(0) from the outputs $\theta_J$*(0) of the arm posture detection sensor 56 (potentiometer 56*r*). After the first instruction is received, the hardware processor 15P calculates a second posture parameter $\theta_I$*(0) representing a start implement direction which is the implement direction 41D at the time when the second instruction is received, from the output of the implement posture detection sensor 57. The hardware processor 15P acquires the first reference parameter $\theta_I$(HA*(0)) (see FIG. 12) which is the second posture parameter associated with the first posture parameter $H_A$*(0) representing the start arm height in the first correspondence relationship. Thereafter, the hardware processor 15P controls the second hydraulic cylinders 48 in accordance with the second instruction and receives the outputs $\theta_J$*(t) of the arm posture detection sensor 56 (potentiometer 56*r*) when the time t has elapsed. The hardware processor 15P calculates the measurement value $H_A$*(t) of the arm height $H_A$ from the output $\theta_J$*(t). Then The hardware processor 15P acquires the second reference parameter $\theta_I(H_A*(t))$ (see FIG. 12), which is the second orientation parameter associated with the first posture parameter $H_A$*(t) representing the measurement value in the first correspondence relationship. The hardware processor 15P determines the target direction such that a difference between a second posture parameter $\theta_I$(t) representing a target direction which is a target of the implement direction 41D when the arm height $H_A$ becomes the measurement value $H_A$*(t) and a second posture parameter $\theta_I$*(0) representing the start implement direction is equal ($\theta_I(t)=\theta_I*(0)+\Delta\theta_I(t)$) to a difference $\Delta\theta_I$(t) between the second reference parameter $\theta_I(H_A*(t))$ and the first reference parameter $\theta_I(H_A*(0))$. The hardware processor 15P controls the first spool position so that the implement direction 41D (the orientation represented by the observed value $\theta_I$*(t)) approaches the target direction (the orientation represented by $\theta_I$(t)).

The hardware processor 15P determines, as the reference correspondence relation, the correspondence relation corresponding to the rotation speed closest to the detected rotation speed $N_E$ of the engine 6 among the first rotation speed and at least one rotation speed (the correspondence relation of the high speed $N_{EH}$ and the correspondence relation of the low speed $N_{EL}$ in the example of FIG. 12) from the first correspondence relationship and at least one second correspondence relation. In FIG. 12, the correspondence of the low-speed $N_{EL}$ is illustrated as the reference correspondence. The hardware processor 15P acquires a third reference parameter $\theta'_I(H_A*(0))$ which is a second posture parameter associated with the first posture parameter $H_A$*(0) representing the start arm height in the reference relation. The hardware processor 15P acquires a fourth reference parameter $\theta'_I(H_A*(t))$ which is a second posture parameter associated with the first posture parameter $H_A$*(t) representing the measurement value in the reference relation. The hardware processor 15P controls the first spool position to determine the target direction (the orientation represented by $\theta_I$(t)) such that the difference between the second posture parameter $\theta_I$(t) representing the target direction and the second posture parameter $\theta_I$*(0) representing the start implement direction is equal ($\theta_I(t)=\theta_I^*(0)+\Delta\theta'_I(t)$) to the difference $\Delta\theta'_I(t)$ between the fourth reference parameter $\theta'_I(H_A^*(t))$ and the third reference parameter $\theta'_I(HA^*(0))$.

Figure 13:
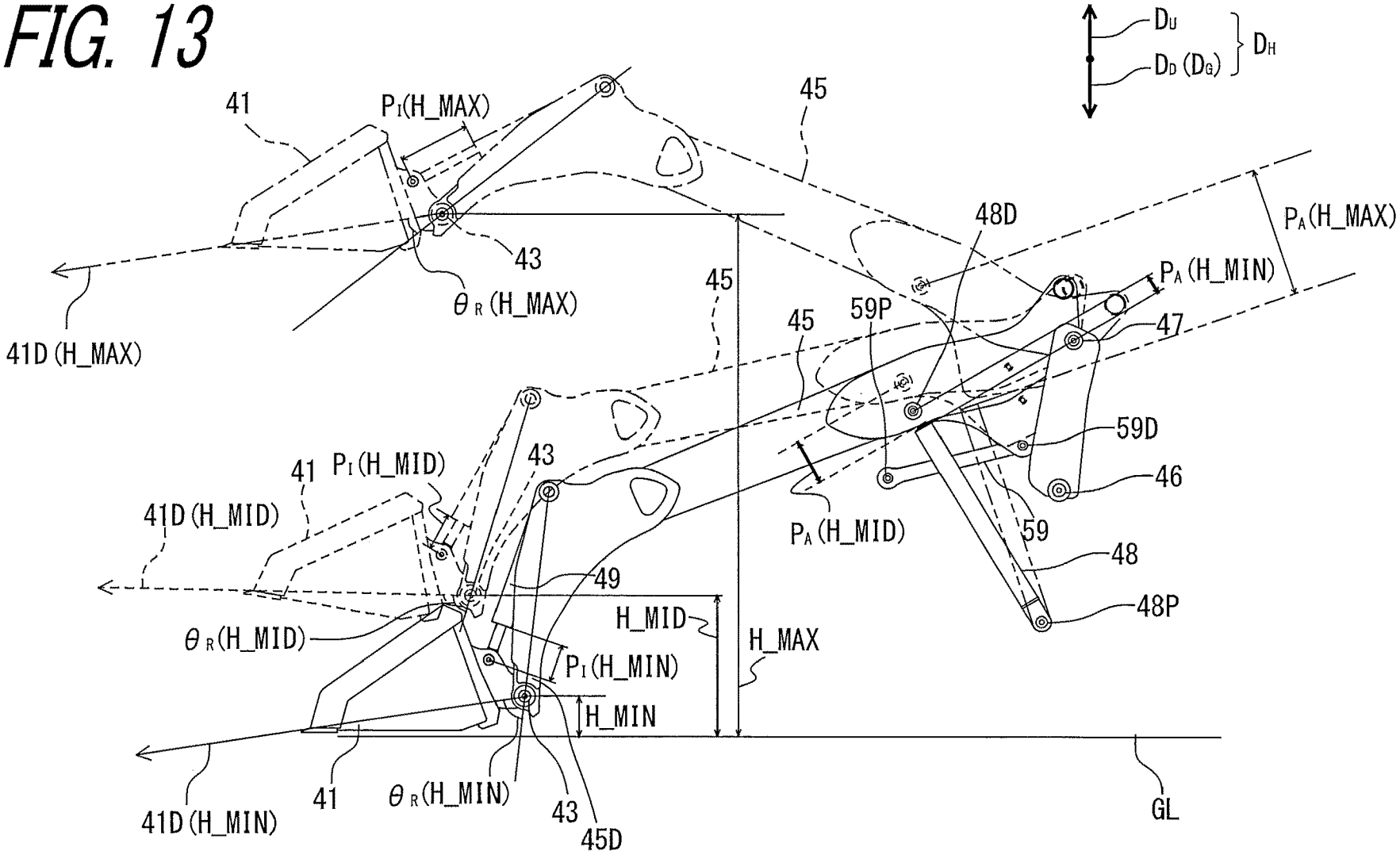
FIG. 13 is a conceptual diagram of the implement posture electric control/implement posture mechanical control in the case where the implement posture detection sensor is formed of a potentiometer or a linear sensor and the arm posture detection sensor is formed of a linear sensor.

FIG. 13 is a conceptual diagram of the implement posture electric control/implement posture mechanical control in the case where the implement posture detection sensor 57 is formed of a potentiometer 57*r* or a linear sensor 57*p* and the arm posture detection sensor 56 is formed of a linear sensor 56*p*. FIG. 13 shows the same implement direction 41D and arm height HA as in FIG. 11. In this case, the memory 15M stores a table representing the correspondence between the position $P_A$ of the second hydraulic cylinders 48 and the arm height $H_A$. The hardware processor 15P is configured to obtain the arm height $H_A$ from the position $P_A$ of the second hydraulic cylinders 48 detected by the linear sensor 56*p* based on the correspondence relationship.

Figure 14:
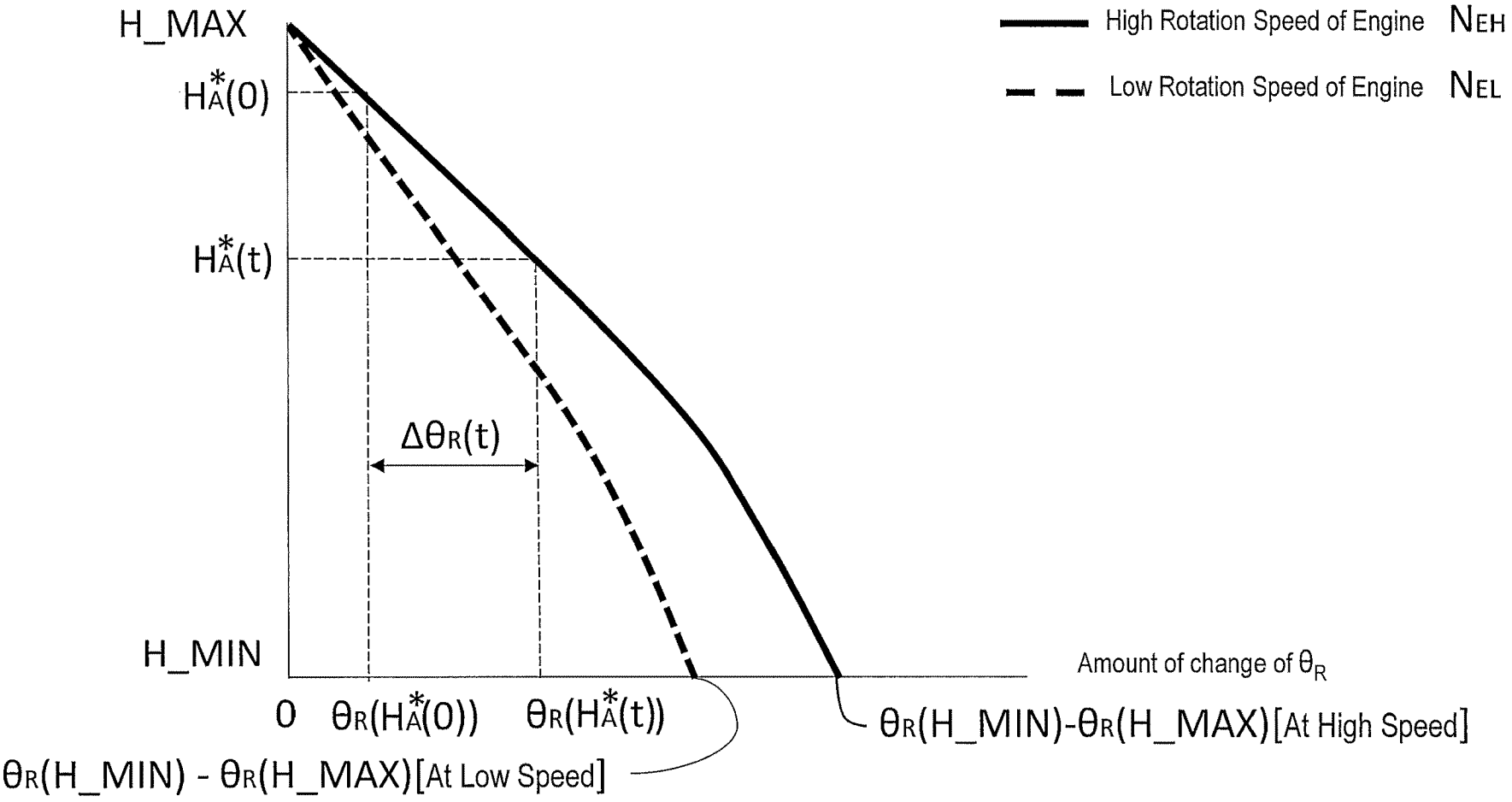
FIG. 14 is a diagram showing the relationship between the change in the arm height and the change in the rotation angle of the joint in the implement posture electric control.

FIG. 14 shows a map M2 representing the first correspondence relationship and the second correspondence when the second posture parameter is the rotation angle $\theta_R$ of the joint 43. FIG. 14 shows the rotation angle $\theta_R$ corresponding to the arm height $H_A$ when the implement posture mechanical control is performed, with $\theta_R$(H_MAX), which is the rotation angle $\theta_R$ when the arm height $H_A$ is equal to the maximum height H_MAX that can be set, being 0. In FIG. 14, as an example, the relationship between the first posture parameter and the second posture parameter when the rotation speed $N_E$ of the engine 6 is high may be referred to as a first correspondence relationship, and the relationship between the first posture parameter and the second posture parameter when the rotation speed $N_E$ of the engine 6 is low may be referred to as a second correspondence relationship. The relationship between the first posture parameter and the second posture parameter when the rotation speed $N_E$ of the engine 6 is low may be referred to as a second correspondence relationship, and the relationship between the first posture parameter and the second posture parameter when the rotation speed $N_E$ of the engine 6 is high may be referred to as the first correspondence relationship. The meaning of the low/high speed of the rotation speed $N_E$ of the engine 6 is the same as the meaning described in FIG. 12. In FIG. 14, the rotation speed $N_E$ of the engine 6 may include a speed other than the high speed and the low speed described above. In this case, a plurality of second correspondence relationships exists.

Hereinafter, the case where the first posture parameter is obtained from the position $P_A$ of the second hydraulic cylinders 48, which is the output from the linear sensor 57*p*, and the second posture parameter is the rotation angle $\theta_R$ of the joint 43 will be described, focusing on the differences from the description in FIG. 12. After the first instruction is received, the hardware processor 15P calculates a first posture parameter $H_A^*(0)$ representing a start arm height which is the arm height $H_A$ at the time when the second instruction is received, from the outputs $P_A^*(0)$ of the arm posture detection sensor 56 (linear sensor 56*p*). After the first instruction is received, the hardware processor 15P calculates a second posture parameter $\theta_R^*(0)$ representing a start implement direction which is the implement direction 41D at the time when the second instruction is received, from the output of the implement posture detection sensor 57. The hardware processor 15P acquires the first reference parameter $\theta_R(H_A^*(0))$ (see FIG. 14) which is the second posture parameter associated with the first posture parameter $H_A^*(0)$ representing the start arm height in the first correspondence relationship. Thereafter, the hardware processor 15P controls the second hydraulic cylinder 48 in accordance with the second instruction and receives the output $P_A^*(t)$ of the arm posture detection sensor 56 (linear sensor 56*p*) when the time t has elapsed. The hardware processor 15P obtains a measurement value $H_A^*(t)$ of the arm height $H_A$ from the outputs $P_A^*(t)$. The hardware processor 15P acquires the second reference parameter $\theta_R(H_A^*(t))$ (see FIG. 14), which is the second posture parameter associated with the first posture parameter $H_A^*(t)$ representing the measurement value in the first correspondence relationship. The hardware processor 15P determines the target direction so that the difference between the second posture parameter $\theta_R(t)$ representing the target direction of the implement direction 41D when the arm height $H_A$ becomes the measurement value $H_A^*(t)$ and the second posture parameter $\theta_R^*(0)$ representing the start implement direction becomes equal to the difference $\Delta\theta_R(t)$ between the second reference parameter $\theta_R(H_A^*(t))$ and the first reference parameter $\theta_R(H_A^*(0))$ ($\theta_R(t)=\theta_R^*(0)+A\ \theta_R(t)$). The hardware processor 15P controls the first spool position so that the implement direction 41D (the orientation represented by the observed value $\theta_R^*(t)$) approaches the target direction (the orientation represented by $\theta_R(t)$).

Figure 15:
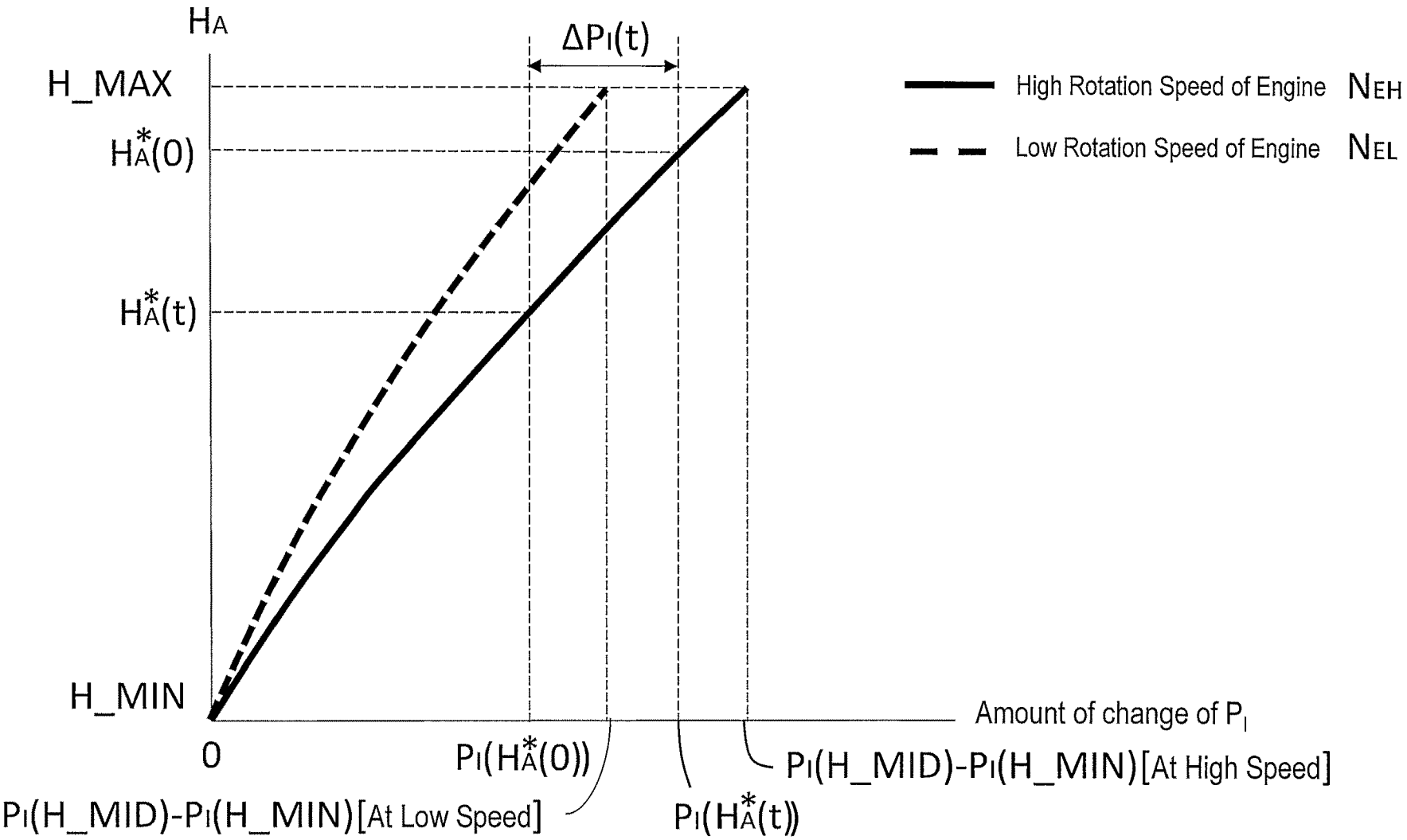
FIG. 15 is a diagram showing the relationship between the change in the arm height and the change in the position of the first hydraulic cylinder in the implement posture electric control.

FIG. 15 shows a map M3 representing the first correspondence relationship and the second correspondence when the second posture parameter is the position $P_I$ of the first hydraulic cylinders 49. FIG. 15 shows the position $P_I$ corresponding to the arm height $H_A$ when the implement posture mechanical control is performed, which is the position $P_I$(H_MIN) when the arm height $H_A$ is equal to the minimum height H_MIN, being 0. In FIG. 15, as an example, the relationship between the first posture parameter and the second posture parameter when the rotation speed $N_E$ of the engine 6 is high may be referred to as a first correspondence relationship, and the relationship between the first posture parameter and the second posture parameter when the rotation speed $N_E$ of the engine 6 is low may be referred to as a second correspondence relationship. The relationship between the first posture parameter and the second posture parameter when the rotation speed $N_E$ of the engine 6 is low may be referred to as a second correspondence relationship, and the relationship between the first posture parameter and the second posture parameter when the rotation speed $N_E$ of the engine 6 is high may be referred to as the first correspondence relationship. The meaning of the low/high speed of the rotation speed $N_E$ of the engine 6 is the same as the meaning described in FIG. 12. In FIG. 15, the rotation speed $N_E$ of the engine 6 may include a speed other than the high speed and the low speed described above. In this case, a plurality of second correspondence relationships exists.

Hereinafter, the case where the first posture parameter is obtained from the position $P_A$ of the second hydraulic cylinder 48, which is the output from the linear sensor 57*p*, and the second posture parameter is the position $P_I$ of the first hydraulic cylinders 49 will be described, focusing on the differences from the above description with reference to FIG. 14. After the first instruction is received, the hardware processor 15P calculates a second posture parameter $P_I^*(0)$ representing a start instrument direction which is the implement direction 41D at the time when the second instruction is received, from the output of the implement posture detection sensor 57. The hardware processor 15P acquires the first reference parameter $P_I(HA^*(0))$ (see FIG. 15) which is the second posture parameter associated with the first posture parameter $H_A^*(t)$ representing the start arm height in the first correspondence relationship. Thereafter, the hardware processor 15P controls the second hydraulic cylinder 48 in accordance with the second instruction to obtain the measurement value $H_A^*(t)$ of the arm height $H_A$ when the time t has elapsed. The hardware processor 15P acquires the second reference parameter $P_I(H_A^*(t))$ (see FIG. 15) which is the second posture parameter associated with the first posture parameter $H_A^*(t)$ representing the measurement value in the first correspondence relationship. The hardware processor 15P determines the target direction so that the difference between the second posture parameter $P_I(t)$ representing the target direction of the implement direction 41D when the arm height $H_A$ becomes the measurement value $H_A^*(t)$ and the second posture parameter $P_I^*(0)$ representing the start implement direction becomes equal ($P_I(t)=P_I^*(0)+\Delta P_I(t)$) to the difference $\Delta P_I(t)$ between the second reference parameter $P_I(H_A^*(t))$ and the first reference parameter $P_I(H_A^*(0))$. The hardware processor 15P controls the first spool position so that the implement direction 41D (the orientation represented by the observed value $P_I^*(t)$) approaches the target direction (the orientation represented by $P_I(t)$).

Figure 16:
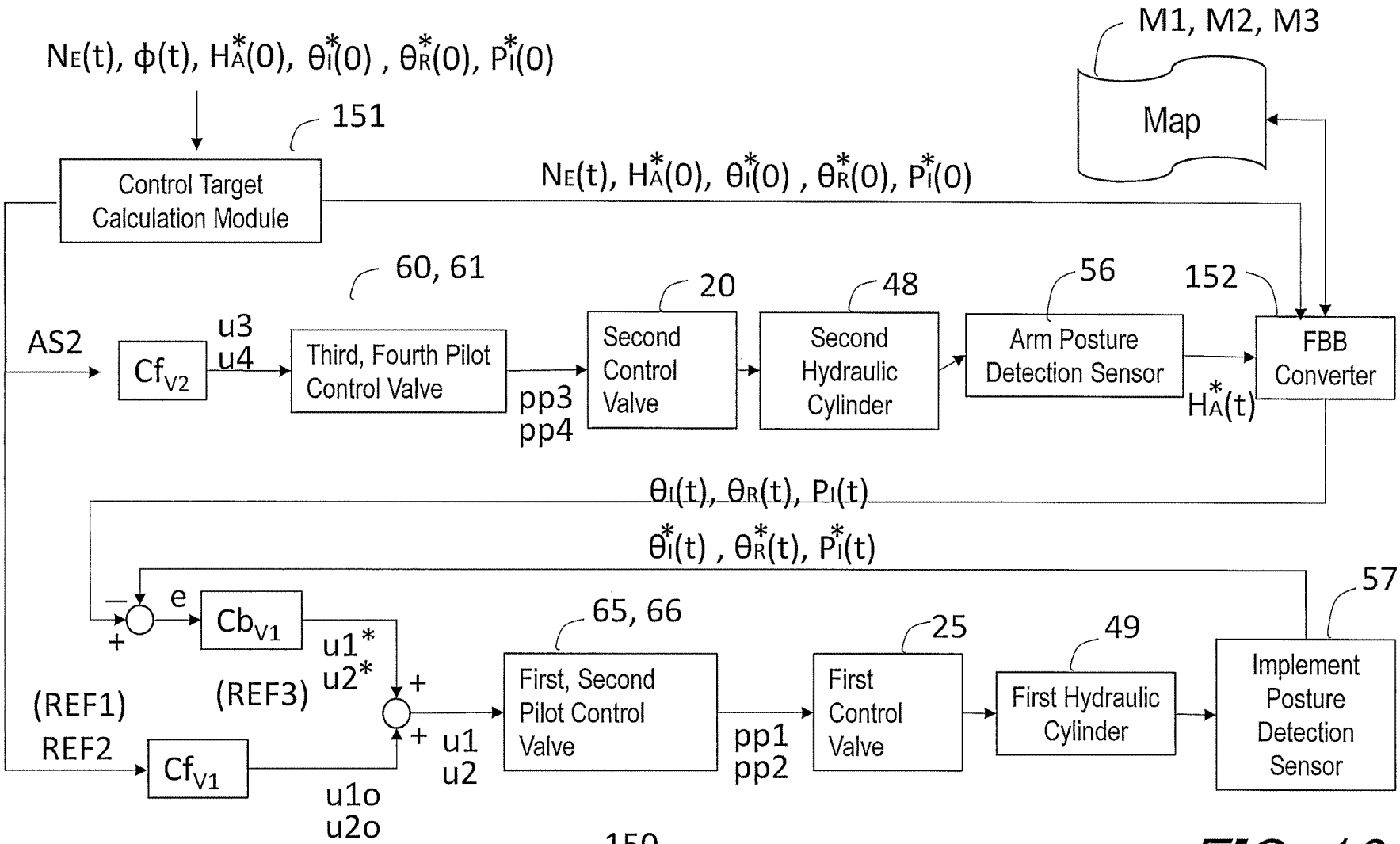
FIG. 16 is a control block diagram according to the embodiment.

FIG. 16 is a control block diagram according to the embodiment. The control system 150 according to the embodiment includes a control target calculation module 151. The control target calculation module 151 is realized by, for example, a program stored in the memory 15M and executed by the hardware processor 15P. First, the control target calculation module 151 calculates the rotation speed of the engine 6 at an arbitrary time t.$N_E(t)$ The operation amount φ (t) of the arm input member 63 (the movement of the operation lever 55 in the front-rear direction) at time t is acquired from the rotation detection sensor 18, the first posture parameter $H_A^*(0)$ indicating the start arm height is acquired from the arm posture detection sensor 56, and the second posture parameters $\theta_I^*(0)$, $\theta_R^*(0)$, and $P_I^*(0)$ indicating the start implement direction are acquired from the implement posture detection sensor 57. That is, the hardware processor 15P acquires the detected rotation speed $N_E$ (t) of the engine 6 detected by the rotational speed sensor 6*a*. The parameters $H_A^*(0)$, $\theta_I^*(0)$, $\theta_R^*(0)$, and $P_I^*(0)$ are processed by the feedback converter 152 described later.

<Feedforward Control>

The control target calculation module 151 performs feedforward control on the first hydraulic cylinder 49 and the second hydraulic cylinder 48 based on the rotation speed $N_E$ of the engine 6. Therefore, the ratio of the flow rate of the hydraulic fluid per unit time through the first control valve 25 to the flow rate of the hydraulic fluid per unit time through the second control valve 20 can be adjusted by the ratio of the first opening area AS1 set by the first control valve 25 to the second opening area AS2 set by the second control valve 20. In the implement posture electric control, the control target calculation module 151 calculates the ratio of the second opening area AS2 to the first opening area AS1 so that the ratio of the amount of the hydraulic fluid flowing out from the first chamber CB1 of the first hydraulic cylinder 49 to the amount of the hydraulic fluid flowing into the fourth chamber CB4 of the second hydraulic cylinder 48 is equal to the first hydraulic cylinder=second hydraulic cylinder oil amount variation ratio K0.

Figure 18:
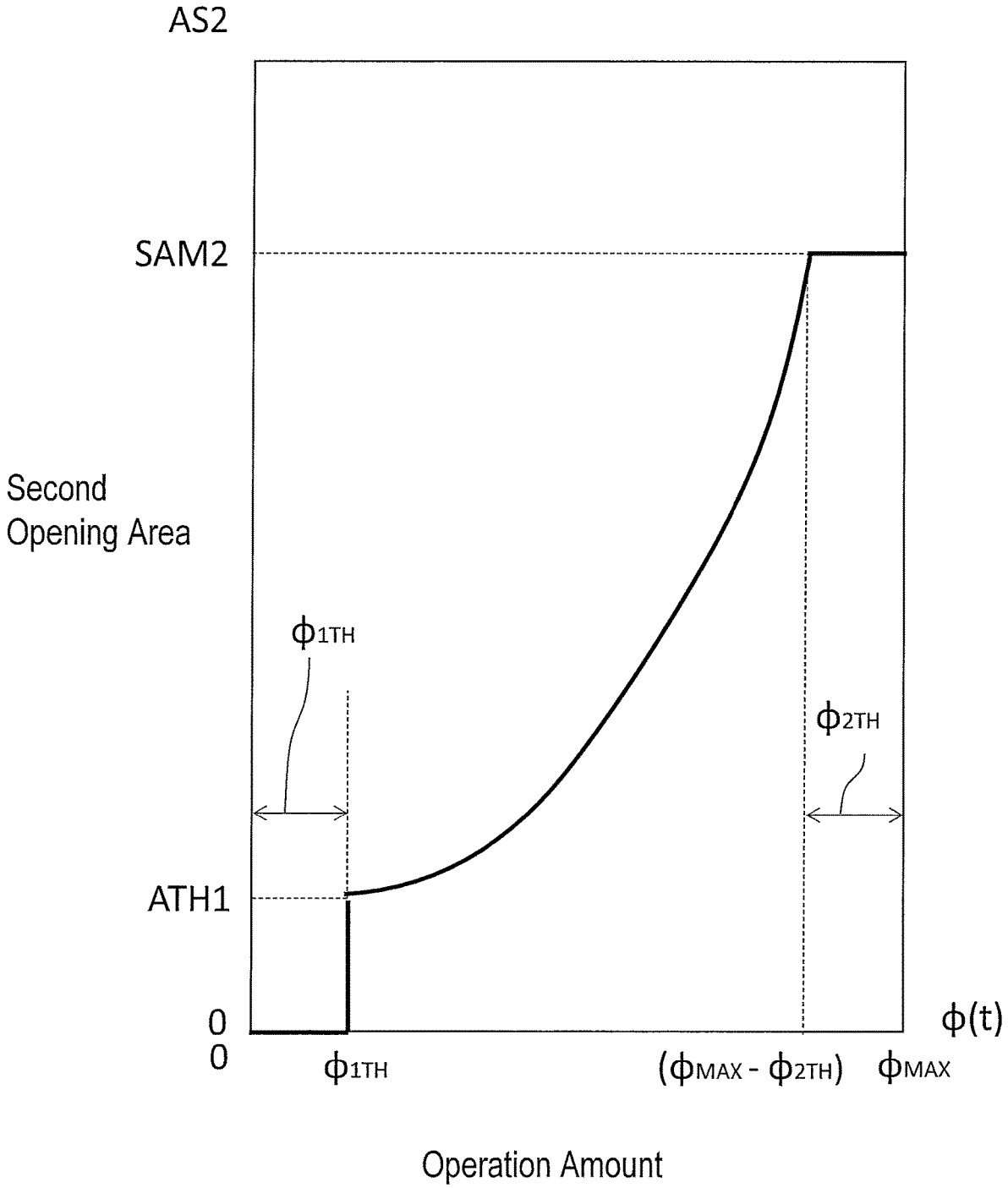
FIG. 18 is an example of a correspondence relationship between an operation amount of an operation lever (a movement of an arm input member in a front-rear direction) and a second opening area according to the embodiment.

The control target calculation module 151 determines the second opening area AS2 based on the operation amount φ (t) of the operation lever 55 (the movement of the arm input member 63 in the front-rear direction). FIG. 18 is an example of the correspondence between the operation amount φ (t) of the operation lever 55 (the movement of the arm input member 63 in the front-rear direction) and the second opening area AS2 determined by the control target calculation module 151. Referring to FIG. 18, the operation amount φ (t) of 0 to $\varphi_{1TH}$ corresponds to play when the operation is not performed, and thus the second opening area AS2 is determined to be 0. When the operation amount φ (t) is operated between ($\varphi_{MAX}$-$\varphi_{2TH}$) and $\varphi_{MAX}$, it can be considered that the operation amount φ (t) is fully operated in consideration of play, and thus the second opening area AS2 is determined to be the maximum value SAM2. When the operation amount φ (t) changes in the section from φ 1TH to (φ MAX-φ 2TH), the second opening area AS2 change exponentially from ATH1 to SAM2 in accordance with the magnitude of the operation amount φ (t). In this way, the hardware processor 15P is configured to determine the second spool position in accordance with the second instruction (the operation amount φ (t)) and to obtain the second opening area AS2 based on the determined second spool position.

The second opening area AS2 is input to the feedforward controller $C_{fv2}$. In the execution of the feedforward controller $C_{fv2}$, the hardware processor 15P determines the control amount u3 of the third pilot control valve 60 and the control amount u4 of the fourth pilot control valve 61 so that the second opening size of the second control valve 20 becomes the value u4, and outputs the control amount u3 to the solenoid 60*s* of the third pilot control valve 60 and the control amount u4 to the solenoid of the fourth pilot control valve 61. In this way, the hardware processor 15P is configured to control the second spool SPL2 so that the position of the second spool SPL2 becomes the second spool position determined in accordance with the second instruction (the operation amount φ (t)).

Figure 17:
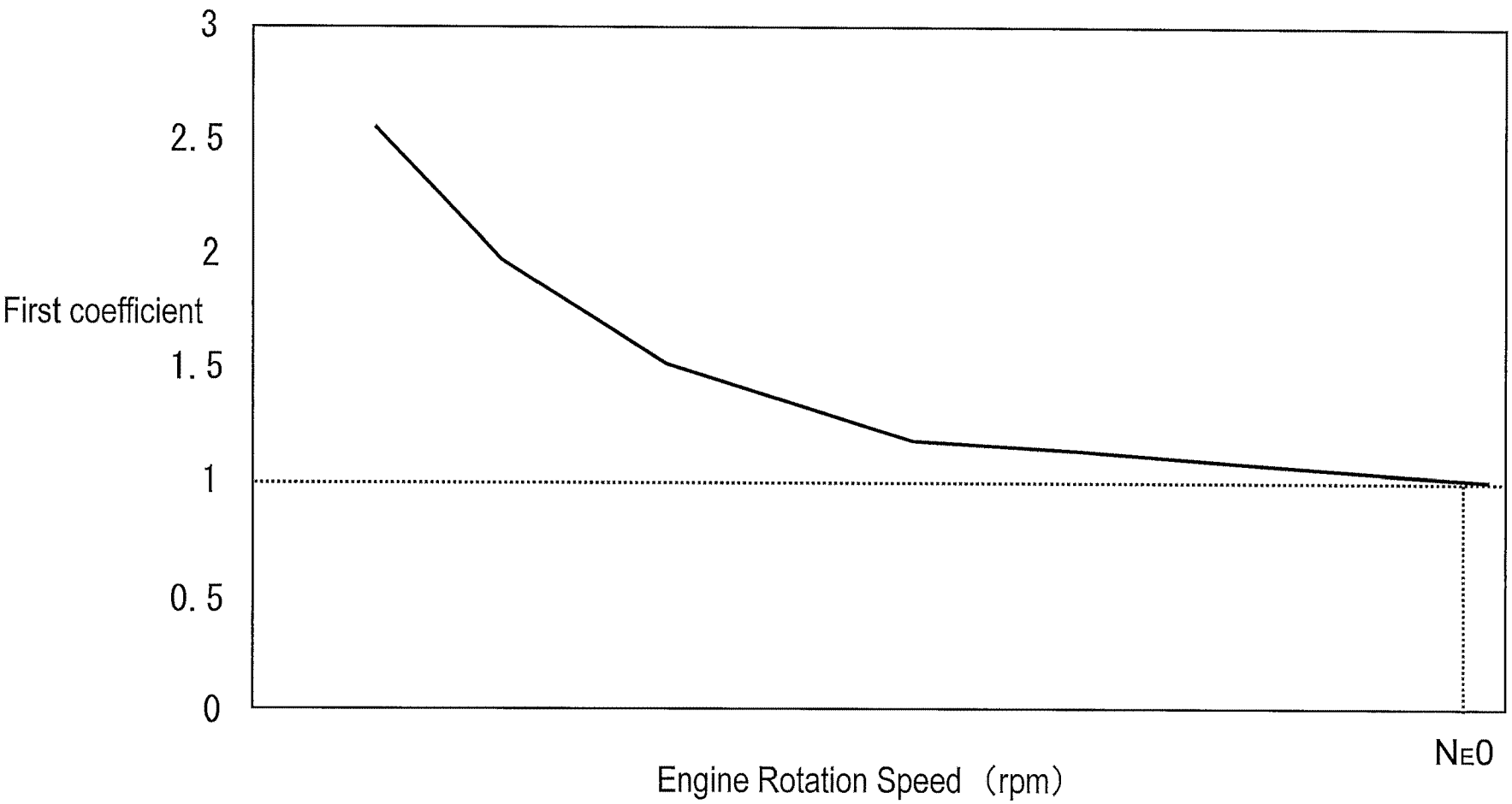
FIG. 17 is a diagram showing the relationship between the rotation speed of an engine and a correction gain.

The hardware processor 15P is configured to determine the first opening area AS1 to be a first reference area REF1 multiplied by a predetermined ratio (first hydraulic cylinder=second hydraulic cylinder oil variation ratio K0). However, first hydraulic cylinder=second hydraulic cylinder oil variation ratio K0 of the first and second hydraulic cylinders varies according to the rotation speed $N_E$ of the engine 6. This is because the arm 45 tends to lower the arm height $H_A$ due to the influence of gravity, whereas the implement 41 must ascend the implement tip 41T against gravity, and therefore, when the rotation speed $N_E$ of the engine 6 is low, that is, when the discharge amount from the hydraulic pump 11 is small, the amount of fluctuation of the implement direction 41D with respect to the amount of fluctuation of the arm height $H_A$ becomes smaller than the control target. In order to take this influence into consideration, the control target calculation module 151 determines the first opening area AS1 from the second opening area AS2 such that the value obtained by multiplying the correction gain K1 of FIG. 17 by the first hydraulic cylinder=the second hydraulic cylinder oil amount variation ratio K0 becomes equal to the first opening area AS1/the second opening area AS2. The memory 15M stores a third correspondence relationship (third relational data) between the rotation speed $N_E$ of the engine 6 and the correction gain K1 as shown in FIG. 17. The hardware processor 15P is configured to determine the correction gain K1 corresponding to the detected rotation speed $N_E$ (t) of the engine 6 based on the third correspondence relationship. The engine rotation speed $N_E0$ corresponding to the correction gain K1 of 1 in FIG. 17 is a high idle rotation speed of the engine 6.

The hardware processor 15P determines the first opening area AS1 to be a second reference area REF2, which is the product of the first reference area REF1 and the correction gain K1. That is, the hardware processor 15P calculates the second reference area REF2 based on the following (Equation 1). However, the correction gain K1 may be always set to 1, and the first reference area REF2 may be used instead of the second reference area REF2 in the subsequent processing.

$$REF2 = K1 \times REF1 = K1 \times K0 \times AS2 \quad \text{(Equation 1)}$$

The second reference area REF2 (the first reference area REF1 when the correction gains K1 are not considered) are input to the feedforward controller $C_{fv1}$. In executing the feedforward controller $C_{fv1}$, the controller 15 determines a feedforward control amount (FF control amount) u1*o* of the first pilot control valve 65 and an FF control amount u2*o* of the second pilot control valve 66 so that the first opening area AS1 of the first control valve 25 become the second reference area REF2 (the first reference area REF1 when the correction gain K1 is not considered), and outputs the FF control amount to the solenoid 65*s* of the first pilot control valve 65 and the FF control amount u20 to the solenoid 66*s* of the second pilot control valve 66. In this way, the hardware processor 15P is configured to control the first spool SPL1 so that the first opening area AS1 approaches the second reference area REF2 (the first reference area REF1 when the correction gain K1 is not considered), thereby causing the implement direction 41D to approach the target direction (e.g., the orientation represented by $P_I(t)$).

<Feedback Control>

Next, the feedback control will be described. Referring to FIGS. 12, 14, 15, and 16, the hardware processor 15P executing the feedback converter 152 obtains the arm height $H_A^*(t)$ detected by the arm posture detection sensor 56. The hardware processor 15P calculates the target value ($\theta_I(t)$, $\theta_R(t)$, or $P_I(t)$) of the second posture parameter (the implement inclination angle $\theta_I$, the rotation angle $\theta_R$ of the joint 43, or the position $P_I$ of the first hydraulic cylinder 49) corresponding to the arm height $H_A^*(t)$ based on the maps M1 to M3 based on the above-described method. In particular, the controller 15 obtains the arm height $H_A^*(t)$ from the rotation angle $\theta_J^*(t)$ of the fulcrum shaft 59P or the position $P_A^*(t)$ of the second hydraulic cylinder 48 detected by the arm posture detection sensor 56. Thereafter, the maps M1 to M3 are referred to, and $\theta_I(t)=\theta_I^*(0)+\Delta\theta_I(t)$, $\theta_R(t)=\theta_R^*(0)+\Delta\theta_R(t)$, or $P_I(t)=P_I^*(0)+\Delta P_I(t)$, which is the same timing t as the arm height $H_A^*(t)$, is obtained as the target value of the second posture parameter corresponding to the implement direction 41D.

Then, the hardware processor 15P that executes the feedback controller cbv1 acquires the detected value ($\theta_I^*(t)$, $\theta_R^*(t)$, or $P_I^*(t)$) of the second posture parameter detected by the implement posture detection sensor 57. The controller 15 that executes the feedback controller cbv1 performs feedback control with the first spool position as the control target so as to reduce the deviation when the deviation from the detected value ($\theta_I^*(t)$, $\theta_R^*(t)$, or $P_I^*(t)$) and the second posture parameter ($\theta_I(t)$, $\theta_R(t)$, or $P_I(t)$) representing the target direction is greater than or equal to the first thresholds. In other words, the controller 15 executing the feedback controller cbv1 performs feedback control so that the second opening area AS2 is changed from the second reference area REF2 (the first reference area REF1 when the correction gain K1 is not considered) to the third reference area REF3, when the deviation e from the detected value ($\theta_I^*(t)$, $\theta_R^*(t)$, or $P_I^*(t)$) and the second posture parameter ($\theta_I(t)$, $\theta_R(t)$, or $P_I(t)$) representing the target direction representing is larger than the first threshold value. The control amounts (u1*, u2*) of the first control valve 25, which are the outputs of the feedback controller cbv1, are determined based on the third reference area REF3. The deviation from the detected value ($\theta_I^*(t)$, $\theta_R^*(t)$, or $P_I^*(t)$) and the second posture parameter ($\theta_I(t)$, $\theta_R(t)$, or $P_I(t)$) representing the target direction is the absolute value of the difference e between the detected value ($\theta_I^*(t)$, $\theta_R^*(t)$, or $P_I^*(t)$) and the second posture parameter ($\theta_I(t)$, $\theta_R(t)$, or $P_I(t)$) representing the target direction. The first threshold value may be a value that varies depending on the type of the second posture parameter.

As described above, by performing the feedback control in complement to the feedforward control, the controller 15 can control the hydraulic circuit 100 so that the detected value ($\theta_I^*(t)$, $\theta_R^*(t)$, or $P_I^*(t)$) approaches the second posture parameter ($\theta_I(t)$, $\theta_R(t)$, or $P_I(t)$) representing the target direction defined by the maps M1 to M3.

The hardware processor 15P ends the feedback control when the deviation becomes equal to or less than a second reference value which is smaller than the first reference value as a result of the feedback control of the first opening area AS1. The hardware processor 15P calculates the correction coefficient K2 by dividing the third reference area REF3 by the second reference area REF2 (the first reference area REF1 when the correction gain K1 is not considered). When the correction gain K1 is not considered, the hardware processor 15P determines the product of the first reference area REF1 determined after the feedback control is terminated and the correction coefficient K2 to be the first opening are first blocking position BP a AS1 after the feedback control is terminated. When the correction gain K1 is taken into consideration, the hardware processor 15P determines the product of the first reference area REF1, the correction gain K1, and the correction coefficient K2, which are determined after the feedback control is terminated, to be the first opening area AS1 after the feedback control is terminated. When the feedback control is not performed, the output of the feedback controller cbv1, that is, the control amount (u1*, u2*) of the first control valve 25 is 0.

<Method for Controlling Work Vehicle>

Figure 19:
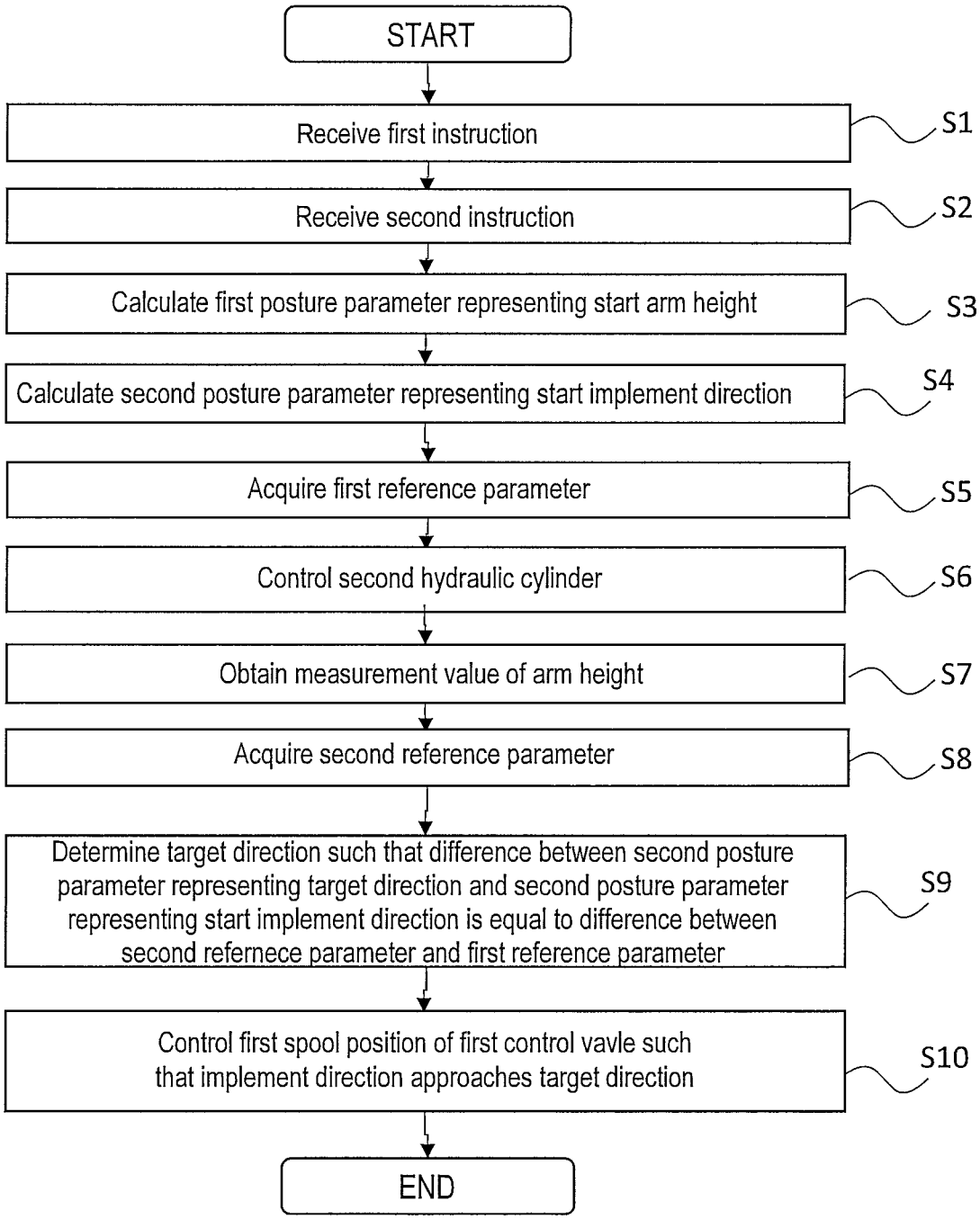
FIG. 19 is a flowchart showing a method of controlling the work vehicle.

Next, a method for controlling the work vehicle 1 according to the present embodiment will be described. FIG. 19 is a flowchart showing a method for controlling the work vehicle 1. In step S1, the control method includes receiving the first instruction for performing the implement posture electric control for controlling the implement direction 41D based on the first correlation relationship in which the first posture parameter representing the arm height $H_A$ which is the height of the traveling device 3 of the work vehicle with respect to the ground contact surface GL is associated with the second posture parameter representing the implement direction 41D toward the implement tip 41T from the joint 43 of the implement 41, via the first input device 16. In step S2, in the control method, a second instruction for changing the arm height $H_A$ is received via the second input device (the operation lever 55, the arm input member 63).

In step S3, in the control method, the hardware processor 15P calculates a first posture parameter $H_A^*(0)$ representing a start arm height which is the arm height $H_A$ at the time when the second instruction is received after the first instruction is received, from an output of the arm posture detection sensor 56 configured to detect the arm height $H_A$. In step S3, in the control method, the hardware processor 15P calculates, after the first instruction is received, second posture parameters $\theta_I^*(0)$, $\theta_R^*(0)$, and $P_I^*(0)$ representing a start implement direction which is the implement direction 41D at the time when the second instruction is received, from the implement posture detection sensor 57 configured to detect the implement direction 41D.

In step S5, in the control method, the hardware processor 15P acquires the first reference parameters $\theta_I(H_A^*(0))$, $\theta_R(H_A^*(0))$, and $P_1$ $(H_A^*(0))$ which are the second posture parameters associated with the first posture parameter $H_A^*(0)$ representing the start arm height in the first correspondence relationship. In step S6, in the control method, the hardware processor 15P controls the second hydraulic cylinder 48 configured to control the arm height $H_A$ according to the second instruction. In step S7, in the control method, the hardware processor 15P obtains a measurement value $H_A^*(t)$ of the arm height $H_A$ from the outputs $\theta_J^*(t)$ and $P_A^*(t)$ of the arm posture detection sensor 56 for detecting the arm height $H_A$.

In step S8, in the control method, the hardware processor 15P acquires the second reference parameters $\theta_I(H_A^*(t))$, $\theta_R(H_A^*(t))$, and $P_I(H_A^*(t))$, which are the second posture parameters associated with the first posture parameter $H_A^*(t)$ representing the measurement value in the first correspondence relationship. In step S9, the hardware processor 15P determines the target direction such that the difference between the second posture parameter $\theta_I(t)$ or $P_I(t)$ and the second posture parameter $\theta_I^*(0)$ or $P_I^*(0)$ representing the implement direction, which is the target of the implement direction 41D when the arm height HA is the measurement value, is equal to the difference $\Delta\theta_I(t)$ or $\Delta\theta_R(t)$ or $\Delta P_I(t)$ between the second reference parameter $\theta_I(H_A^*(t))$, $\theta_R(H_A^*(t))$, $P_I(H_A^*(t)$ and the first reference parameter $\theta_I$ $(H_A^*(0))$, $\theta_R(H_A^*(0))$, $P_I(H_A^*(0))$. In step S9, in the control method, the hardware processor 15P controls the first spool position of the first control valve 25 so that the implement direction 41D approaches the target direction.

Effects of Embodiment

The hardware processor 15P of the work vehicle 1 according to the present embodiment can realize the horizontal control by the hydraulic circuit 100 in the operation of raising the implement 41, and can realize the horizontal control by the first pilot control valve 65, the second pilot control valve 66, the third pilot control valve 60, and the fourth pilot control valve 61 in the operation of lowering the implement 41.

Modification

Figure 20:
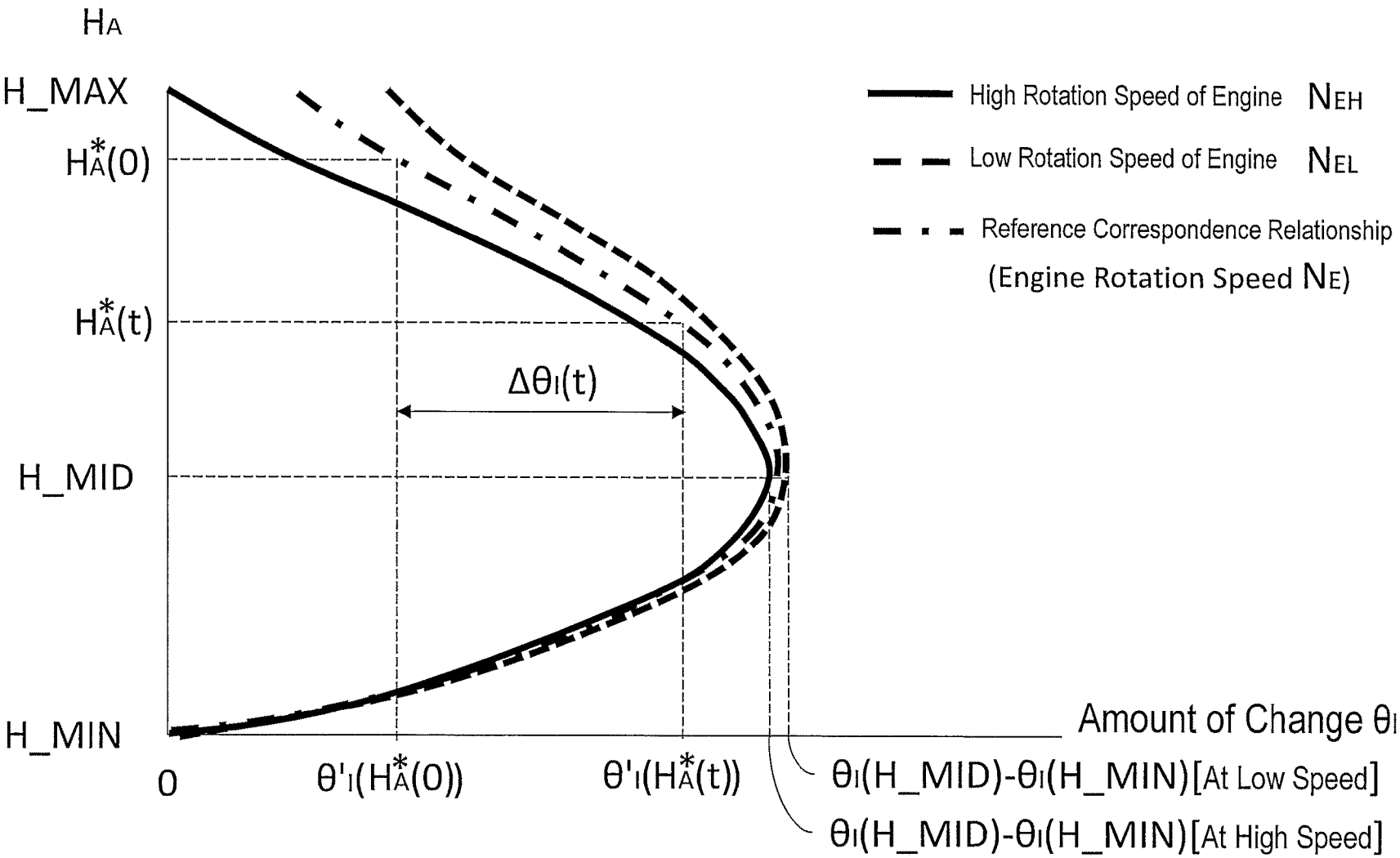
FIG. 20 is a diagram for explaining a reference correspondence.

The above example is a case where the correspondence relationship between the first posture parameter and the second posture parameter is directly represented in the map M1 of FIG. 12. The correspondence relationship between the first posture parameter and the second posture parameter with respect to the rotation speed $N_E$ of the engine 6 other than that shown in FIG. 12 may be derived from the first correspondence relationship and at least one second correspondence by using linear interpolation or the like as shown in FIG. 17. FIG. 20 shows a case where a correspondence relationship between the first posture parameter and the second posture parameter with respect to the rotation speed $N_E$ of the engine 6 other than that shown in FIG. 12 is obtained. The hardware processor 15P determines a reference relation to be referred to from the first correspondence relationship and at least one second correspondence relationship based on the detected rotation speed $N_E$ of the engine 6. In FIG. 20, the reference relation is indicated by a dashed line. The reference relation is obtained by linear interpolation from the first correspondence relationship and the second correspondence based on the speed difference between the detected rotation speed $N_E$ and the high rotation speed $N_{EH}$ and the speed difference between the detected rotation speed $N_E$ and the low rotation speed $N_{EH}$. The hardware processor 15P acquires a third reference parameter $\theta'_I$ $(H_A^*(0))$ which is a second posture parameter associated with the first posture parameter $H_A^*(0)$ representing the start arm height in the reference relation. The hardware processor 15P acquires a fourth reference parameter $\theta'_I(H_A^*(t))$ which is a second posture parameter associated with the first posture parameter $H_A^*(t)$ representing the measurement value in the reference relation. The hardware processor 15P controls the first spool position to determine the target direction (the orientation represented by $\theta_1(t)$) such that the difference between the second posture parameter $\theta_1(t)$ representing the target direction and the second posture parameter 1*(0) representing the start implement direction is equal $(\theta_1(t)=1^*(0)+\Delta\theta_I(t))$ to the difference $\Delta\theta_I(t)$ between the fourth reference parameter $\theta'_I(H_A^*(t))$ and the third reference parameter $\theta'_I(H_A^*(0))$.

In this application, the word "comprise" and its derivatives are used as open-ended terms to describe the presence of elements but not to exclude the presence of other elements not listed. This applies to "having", "including" and derivatives thereof.

The terms "member," "part," "element," "body," and "structure" may have a plurality of meanings, such as a single portion or a plurality of portions.

The ordinal numbers such as "first" and "second" are merely terms for identifying the configuration, and do not have other meanings (for example, a specific order). For example, the presence of a "first element" does not imply the presence of a "second element," and the presence of a "second element" does not imply the presence of a "first element."

Terms of degree such as "substantially", "about", and "approximately" can mean a reasonable amount of deviation such that the end result is not significantly changed, unless the embodiment is specifically described otherwise. All numerical values recited herein may be construed to include terms such as "substantially," "about," and "approximately."

The phrase "at least one of A and B" as used herein should be interpreted to include A alone, B alone, and both A and B.

Obviously, numerous modifications and variations of the present disclosure are possible in light of the above teachings. Thus, it is to be understood that the embodiments may be practiced otherwise than as specifically described herein without departing from the scope of the disclosure.

What is claimed is:

1. A work vehicle comprising:

an implement including a joint and an implement tip which is opposite to the joint;

an arm comprising:

an arm distal end including the joint and configured to swingably support the implement; and an arm proximal end opposite to the arm distal end;

a vehicle body configured to swingably support the arm proximal end;

a traveling device configured to move the vehicle body;

a first hydraulic cylinder having a first oil chamber and a second oil chamber and configured to control an implement direction from the joint toward the implement tip, the first hydraulic cylinder being configured to take a first status and a second status alternatively, the first oil chamber being a first oil supplied chamber and the second oil chamber being a first oil discharged chamber in the first status, the first oil chamber being the first oil discharged chamber and the second oil chamber being the first oil supplied chamber in the second status, hydraulic fluid being supplied to the first oil supplied chamber, hydraulic fluid being discharged from the first oil discharged chamber;

a second hydraulic cylinder configured to control an arm height which is a height of the arm distal end with respect to a ground contact surface of the traveling device in a height direction perpendicular to a traveling direction of the traveling device;

a hydraulic pump configured to supply the hydraulic fluid to the first hydraulic cylinder and the second hydraulic cylinder;

an engine configured to drive the hydraulic pump;

a rotational speed sensor configured to detect a detected rotation speed of the engine;

a first control valve including a first pool and configured to:

control the first hydraulic cylinder to take the first status and the second status alternatively in accordance with a first spool position which is a position of the first spool; and adjust an amount of the hydraulic fluid supplied to the first oil supplied chamber per unit time and an amount of the hydraulic fluid discharged from the first oil discharged chamber per unit time;

an arm posture detection sensor configured to detect the arm height;

an implement posture detection sensor configured to detect the implement direction;

a memory configured to store first relational data in which a first posture parameter is associated with a second posture parameter, the first posture parameter representing the arm height, the second posture parameter representing the implement direction;

a processor configured to control the hydraulic pump, the engine, and the first control valve;

a first input device configured to receive a first instruction to perform implement posture electric control to control the implement direction; and a second input device configured to receive a second instruction to change the arm height, the processor configured to calculate from an output of the arm posture detection sensor, the first posture parameter that represents a start arm height, the start arm height being the arm height detected at reception of the second instruction that occurs after reception of the first instruction, calculate from an output of the implement posture detection sensor, the second posture parameter that represents a start implement direction, the start implementation direction being the implement direction detected at reception of the second instruction that occurs after reception of the first instruction, acquire a first reference parameter that is the second posture parameter associated with the first posture parameter representing the start arm height in the first relational data, control the second hydraulic cylinder according to the second instruction, obtain a measurement value of the arm height from an output of the arm posture detection sensor, acquire a second reference parameter that is the second posture parameter associated with the first posture parameter representing the measurement value in the first relational data, determine a target direction that is a target of the implement direction to be controlled when the arm height is the measurement value such that a difference between the second posture parameter representing the target direction and the second posture parameter representing the start implement direction is equal to a difference between the second reference parameter and the first reference parameter, and control the first spool position such that the implement direction approaches the target direction.

2. The work vehicle according to claim 1, wherein, in the first relational data, the first posture parameter is associated with the second posture parameter when the engine is rotated at a first rotation speed, wherein the memory stores at least one set of second relational data corresponding to at least one rotation speed of the engine, respectively, the at least one rotation speed of the engine being different from the first rotation speed, wherein, in each of the at least one set of second rotational data, the first posture parameter is associated with the second posture parameter when the implement posture electric control is performed in a state where the engine is driven at a respective one of the at least one rotation speed, and wherein the processor is configured to determine, based on the detected rotation speed of the engine, a reference relation from relations specified in the first relational data and the at least one set of second relational data, acquire a third reference parameter which is the second posture parameter associated with the first posture parameter representing the start arm height in the reference relation, acquire a fourth reference parameter which is the second posture parameter associated with the first posture parameter representing the measurement value in the reference relation, and control the first spool position to determine the target direction such that a difference between the second posture parameter representing the target direction and the second posture parameter representing the start implement direction is equal to a difference between the fourth reference parameter and the third reference parameter.

3. The work vehicle according to claim 2, further comprising:

the second hydraulic cylinder having a third oil chamber and a fourth oil chamber and configured to take a third status and a fourth status alternatively, the third oil chamber being a second oil supplied chamber and the fourth oil chamber being a second oil discharged chamber in the third status, the third oil chamber being the second oil discharged chamber and the fourth oil chamber being the second oil supplied chamber in the fourth status, the hydraulic fluid being supplied to the second oil supplied chamber, the hydraulic fluid being discharged from the second oil discharged chamber;

a second control valve including a second spool and configured to:

control the second hydraulic cylinder to take the third status and the fourth status alternatively in accordance with a second spool position which is a position of the second spool; and adjust an amount of the hydraulic fluid supplied to the second oil supplied chamber per unit time and an amount of the hydraulic fluid discharged from the second oil discharged chamber per unit time in accordance with the second spool position;

a first oil passage configured to connect the hydraulic pump via the first control valve with a first chamber of the first hydraulic cylinder configured such that the hydraulic fluid flows into the first chamber when the implement tip is tilted downward;

a second oil passage configured to connect the first control valve with a second chamber of the first hydraulic cylinder configured such that the hydraulic fluid flows into the second chamber when the implement tip is tilted upward;

a third oil passage configured to connect the hydraulic pump via the second control valve with a third chamber of the second hydraulic cylinder configured such that the hydraulic fluid flows into the third chamber when the arm distal end is raised;

a fourth oil passage configured to connect the second control valve with a fourth chamber of the second hydraulic cylinder configured such that the hydraulic fluid flows into the fourth chamber when the arm distal end is lowered;

a bypass oil passage configured to connect the fourth oil passage with the first oil passage; and a switching mechanism configured to control connection and disconnection between the fourth oil passage and the first oil passage by the bypass oil passage, wherein the switching mechanism comprises:

a first switching valve provided in the fourth oil passage between the second control valve and a first joint connecting the bypass oil passage and the fourth oil passage, the first switching valve having a first pilot port and configured to cut off connection between the second control valve and the fourth chamber via the fourth oil passage when a first pilot pressure that is a pressure of pilot oil which is applied to the first pilot port is equal to or higher than a first threshold pressure, the first switching valve being configured to connect the second control valve and the fourth chamber via the fourth oil passage when the first pilot pressure is lower than the first threshold pressure; and a solenoid valve a position of which is switchable between a first position and a second position, the solenoid valve being configured to connect the first pilot port and an oil passage configured to allow a pilot pressure equal to or higher than the first threshold pressure to be applied to the first pilot port when the position of the solenoid valve is switched to the first position, the solenoid valve being configured to communicate the first pilot port with a hydraulic fluid tank when the position of the solenoid valve is switched to the second position, wherein the first input device is configured to receive a third instruction to perform implement posture mechanical control to control the implement direction by changing connection relations of hydraulic circuits, and wherein the processor is configured to control the switching mechanism to connect the fourth oil passage and the first oil passage, in response to the third instruction and the second instruction to increase the arm height.

4. The work vehicle according to claim 3, further comprising:

a third input device configured to receive a third instruction to change the implement direction, wherein the first relational data indicate a relation according to which the arm height and the implement direction change when the rotation speed of the engine is a first rotation speed during execution of the implement posture mechanical control after the second instruction to change a reference height is set by the second input device and the third instruction to change a reference implement direction is set by the third input device, the reference height serving as a standard of the arm height, the reference implement direction serving as a standard of the implement direction, and wherein each of the at least one set of second relational data indicates a respective relation according to which the arm height and the implement direction change when the rotation speed of the engine is the respective one of the at least one second rotation speed of the engine during execution of the implement posture mechanical control after the second instruction to change the reference height is set by the second input device and the third instruction to change the reference implement direction is set by the third input device.

5. The work vehicle according to claim 2, wherein the processor determines a relation corresponding to a rotation speed closest to the detected rotation speed of the engine among the first rotation speed and at least one of the rotation speed as the reference relation from the first relational data and the at least one set of second relational data.

6. The work vehicle according to claim 1, further comprising:

the second hydraulic cylinder having a third oil chamber and a fourth oil chamber and configured to take a third status and a fourth status alternatively, the third oil chamber being a second oil supplied chamber and the fourth oil chamber being a second oil discharged chamber in the third status, the third oil chamber being the second oil discharged chamber and the fourth oil chamber being the second oil supplied chamber in the fourth status, the hydraulic fluid being supplied to the second oil supplied chamber, the hydraulic fluid being discharged from the second oil discharged chamber;

the first control valve configured to change a first opening area in accordance with the first spool position, the first opening area being an area of a first opening that communicates an oil passage connecting the first oil supplied chamber and the first control valve with an oil passage connecting the hydraulic pump and the first control valve;

a first cylinder hydraulic circuit connecting the first hydraulic cylinder and the hydraulic pump via the first control valve;

a second control valve including a second spool and configured to:

control the second hydraulic cylinder to take the third status and the fourth status alternatively in accordance with a second spool position which is a position of the second spool;

adjust an amount of the hydraulic fluid supplied to the second oil supplied chamber per unit time and an amount of the hydraulic fluid discharged from the second oil discharged chamber per unit time in accordance with the second spool position; and to change a second opening area in accordance with the second spool position, the second opening area being an area of a second opening that communicates an oil passage connecting the second oil supplied chamber and the second control valve with an oil passage connecting the hydraulic pump and the second control valve;

a second cylinder hydraulic circuit connecting the second hydraulic cylinder and the hydraulic pump via the second control valve; and a pressure control mechanism comprising:

a first pressure compensation valve provided in the first cylinder hydraulic circuit between the first control valve and the hydraulic pump such that a hydraulic pressure applied to the first oil supplied chamber from the first opening is lower than a hydraulic pressure applied to the first opening from the first pressure compensation valve by a first pressure, and a second pressure control mechanism provided in the second cylinder hydraulic circuit between the second control valve and the hydraulic pump such that a hydraulic pressure applied to the second oil supplied chamber from the second opening is lower than a hydraulic pressure applied to the second opening from the first pressure compensation valve by the first pressure, wherein the processor is configured to determine the second spool position in accordance with the second instruction, control the second spool so that the second spool position reaches the determined second spool position, obtain the second opening area based on the determined second spool position, determine the first opening area to be a first reference area obtained by multiplying the second opening area by a predetermined ratio, and control the first spool such that the first opening area approaches the first reference area to cause the implement direction to approach the target direction.

7. The work vehicle according to claim 6, wherein the memory is configured to store third relational data in which a rotation speed of the engine is associated with a correction gain, wherein the processor is configured to acquire a detected rotation speed of the engine detected by the rotational speed sensor, determine the correction gain corresponding to the detected rotation speed of the engine by referring to the third relational data, and determine the first opening area to be a second reference area obtained by multiplying the first reference area by the correction gain.

8. The work vehicle according to claim 7, wherein the processor is configured to acquire a detected value which is the second posture parameter detected by the implement posture detection sensor, and perform, when a deviation of the detected value from the second posture parameter that represents the target direction is equal to or larger than a first threshold value, feedback control such that the first opening area is changed from the second reference area to a third reference area to reduce the deviation.

9. The work vehicle according to claim 8 wherein the processor is configured to terminate the feedback control when the deviation becomes equal to or smaller than a second threshold value which is smaller than the first threshold value as a result of the feedback control, calculate a correction coefficient obtained by dividing the third reference area by the second reference area, and determine the first opening area to be a fourth reference area that is a product of the first reference area, the correction gain, and the correction coefficient.

10. The work vehicle according to claim 6, wherein the processor is configured to acquire a detected value that is the second posture parameter detected by the implement posture detection sensor, and perform, when a deviation of the detected from the second posture parameter that represents the target direction is equal to or larger than a first threshold value, feedback control such that the first opening area is changed from the first reference area to a third reference area to reduce the deviation.

11. The work vehicle according to claim 10, wherein the processor is configured to terminate the feedback control when the deviation becomes equal to or smaller than a second threshold value which is smaller than the first threshold value as a result of the feedback control, calculate a correction coefficient obtained by dividing the third reference area by the first reference area, and determine as the first opening area after termination of the feedback control, a value obtained by multiplying the correction coefficient by the first reference area determined after termination of the feedback control.

12. The work vehicle according to claim 6, further comprising:

a first oil passage configured to connect the hydraulic pump via the first control valve with a first chamber of the first hydraulic cylinder configured such that the hydraulic fluid flows into the first chamber when the implement tip is tilted downward;

a second oil passage configured to connect the first control valve with a second chamber of the first hydraulic cylinder configured such that the hydraulic fluid flows into the second chamber when the implement tip is tilted upward;

a third oil passage configured to connect the hydraulic pump via the second control valve with a third chamber of the second hydraulic cylinder configured such that the hydraulic fluid flows into the third chamber when the arm distal end is raised;

a fourth oil passage configured to connect the second control valve with a fourth chamber of the second hydraulic cylinder configured such that the hydraulic fluid flows into the fourth chamber when the arm distal end is lowered;

a bypass oil passage configured to connect the fourth oil passage with the first oil passage;

an additional bypass oil passage configured to connect the second oil passage with the fourth oil passage between the second control valve and a first joint that connects the bypass oil passage and the fourth oil passage; and a switching mechanism configured to control connection and disconnection between the fourth oil passage and the first oil passage by the bypass oil passage, wherein the switching mechanism further comprises:

a first switching valve provided in the fourth oil passage between the first joint and a second joint connecting the additional bypass oil passage and the fourth oil passage, the first switching valve having a first pilot port and configured to cut off connection between the second control valve and the fourth chamber via the fourth oil passage when a first pilot pressure that is a pressure of pilot oil which is applied to the first pilot port is equal to or higher than a first threshold pressure, the first switching valve being configured to connect the second control valve and the fourth chamber via the fourth oil passage when the first pilot pressure is lower than the first threshold pressure;

a solenoid valve a position of which is switchable between a first position and a second position, the solenoid valve being configured to connect the first pilot port to an oil passage configured to allow a pilot pressure equal to or higher than the first threshold pressure to be applied to the first pilot port when the position of the solenoid valve is switched to the first position, the solenoid valve being configured to communicate the first pilot port with a hydraulic fluid tank when the position of the solenoid valve is switched to the second position;

a second switching valve provided in the bypass oil passage; and a third switching valve provided in the additional bypass oil passage, wherein the work vehicle further comprises:

a first connection passage configured to connect the second switching valve and the additional bypass oil passage between the third switching valve and the second joint; and a second connection passage configured to connect the third switching valve and the bypass oil passage between a third joint and the second switching valve, the third joint connecting the bypass oil passage and the first oil passage, wherein the position of the second switching valve is configured to be switched to a first communication position at which the first joint communicates with the third joint when a first hydraulic pressure of the bypass oil passage between the first joint and the second switching valve is larger than a second hydraulic pressure of the first connection passage, wherein the position of the second switching valve is configured to be switched to a first shutoff position at which the first joint is hindered from communicating with the third joint when the second hydraulic pressure is equal to or lower than the first hydraulic pressure, wherein the position of the third switching valve is configured to be switched to a second communication position at which the second joint communicates with a fourth joint connecting the second oil passage and the additional bypass oil passage when a third hydraulic pressure of the additional bypass oil passage between the second joint and the third switching valve is smaller than a fourth hydraulic pressure of the second connection passage, wherein the position of the third switching valve is configured to be switched to a second shutoff position at which the second joint is hindered from communicating with the fourth joint when the fourth hydraulic pressure is equal to or lower than the third hydraulic pressure, wherein the first input device is configured to receive a third instruction to perform implement posture mechanical control to control the implement direction by changing connection relations of hydraulic circuits, wherein the processor is configured to control the switching mechanism to connect the fourth oil passage and the first oil passage when the third instruction and the second instruction to increase the arm height are received, and wherein the position of the second switching valve is controlled to be switched between the first communication position and the first shutoff position so that an amount of the predetermined ratio times an amount of the hydraulic fluid per unit time supplied from the second control valve to the second oil supplied chamber is supplied from the first control valve to the first oil supplied chamber per unit time.

13. The work vehicle according to claim 1, wherein the processor is configured to acquire a detected value that is the second posture parameter detected by the implement posture detection sensor, and perform, when a deviation of the detected value from the second posture parameter that represents the target direction is equal to or larger than a first threshold value, feedback control of the first spool position to reduce the deviation.

14. The work vehicle according to claim 1, further comprising:

the second hydraulic cylinder having a third oil chamber and a fourth oil chamber and configured to take a third status and a fourth status alternatively, the third oil chamber being a second oil supplied chamber and the fourth oil chamber being a second oil discharged chamber in the third status, the third oil chamber being the second oil discharged chamber and the fourth oil chamber being the second oil supplied chamber in the fourth status, the hydraulic fluid being supplied to the second oil supplied chamber, the hydraulic fluid being discharged from the second oil discharged chamber;

a second control valve including a second spool and configured to:

control the second hydraulic cylinder to take the third status and the fourth status alternatively in accordance with a second spool position which is a position of the second spool; and adjust an amount of the hydraulic fluid supplied to the second oil supplied chamber per unit time and an amount of the hydraulic fluid discharged from the second oil discharged chamber per unit time in accordance with the second spool position;

a first oil passage connecting the hydraulic pump via the first control valve with a first chamber of the first hydraulic cylinder into which the hydraulic fluid flows when the implement tip is tilted downward;

a second oil passage connecting the first control valve with a second chamber of the first hydraulic cylinder into which the hydraulic fluid flows when the implement tip is tilted upward;

a third oil passage connecting the hydraulic pump via the second control valve with a third chamber of the second hydraulic cylinder into which the hydraulic fluid flows when the arm distal end is raised;

a fourth oil passage connecting the second control valve with a fourth chamber of the second hydraulic cylinder into which the hydraulic fluid flows when the arm distal end is lowered;

a bypass oil passage connecting the fourth oil passage with the first oil passage; and a switching mechanism configured to control connection and disconnection between the fourth oil passage and the first oil passage by the bypass oil passage, wherein the switching mechanism comprises:

a first switching valve provided in the fourth oil passage between the second control valve and a first joint connecting the bypass oil passage and the fourth oil passage and including a first pilot port, the first switching valve being configured to cut off connection between the second control valve and the fourth chamber via the fourth oil passage when a first pilot pressure that is a pressure of pilot oil which is applied to the first pilot port is equal to or higher than a first threshold pressure, the first switching valve being configured to connect the second control valve and the fourth chamber via the fourth oil passage when the first pilot pressure is lower than the first threshold pressure; and a solenoid valve a position of which is switchable between a first position and a second position, the solenoid valve being configured to connect the first pilot port and an oil passage configured to allow a pilot pressure equal to or higher than the first threshold pressure to be applied to the first pilot port when the position of the solenoid valve is switched to the first position, the solenoid valve being configured to communicate the first pilot port with a hydraulic fluid tank when the position of the solenoid valve is switched to the second position, wherein the first input device is configured to receive a fourth instruction to perform implement posture mechanical control to control the implement direction by changing connection relations of hydraulic circuits, and wherein the processor is configured to control the switching mechanism to connect the fourth oil passage and the first oil passage, in response to the fourth instruction and the second instruction to increase the arm height.

15. The work vehicle according to claim 14, further comprising:

a third input device configured to receive a third instruction to change the implement direction, wherein the first relational data indicate a relation according to which the arm height and the implement direction change during execution of the implement posture mechanical control after the second instruction to change a reference height is set by the second input device and the third instruction to change a reference implement direction is set by the third input device, the reference height serving as a standard of the arm height, the reference implement direction serving as a standard of the implement direction.

16. The work vehicle according to claim 14, wherein the first input device includes a switch electrically connected to the processor and configured to turn on and off the implement posture electric control, wherein the second input device includes an operation lever configured to receive a raising instruction to increase the arm height and a lowering instruction to decrease the arm height, and wherein when the implement posture electric control is turned on by the switch and the lowering instruction is received by the second input device, the processor switches the position of the solenoid valve to the second position.

17. The work vehicle according to claim 16, wherein the switch is configured to turn on and off the implement posture mechanical control, wherein when the implement posture mechanical control is turned on by the switch and the raising instruction is received by the second input device, the processor switches the position of the solenoid valve to the first position, and wherein when the implement posture mechanical control is turned off by the switch, the processor switches the position of the solenoid valve to the second position regardless of the operation of the second input device.

18. The work vehicle according to claim 17, wherein the switch is configured to turn off both the implement posture electric control and the implement posture mechanical control and turn on both the implement posture electric control and the implement posture mechanical control.

19. The work vehicle according to claim 1, wherein the arm posture detection sensor is a rotation angle detection sensor configured to detect a rotation angle of a link configured to swingably support the arm, wherein the implement posture detection sensor includes a first inertial measurement unit attached to the implement, and a second inertial measurement unit attached to the vehicle body, wherein the first posture parameter is a parameter representing the arm height converted from the rotation angle, and wherein the second posture parameter is an angle formed by a vehicle reference direction and the implement direction, which is obtained from a first angle and a second angle, the vehicle reference direction defining a posture of the vehicle body with respect to a gravity direction, the first angle being formed by the gravity direction and the vehicle reference direction, the second angle being formed by the gravity direction and the implement direction, the first inertial measurement unit being configured to the first angle, the second inertial measurement unit being configured to the second angle.

20. A method for controlling a work vehicle, comprising:

receiving a first instruction to perform implement posture electric control to control an implement direction from a joint of an implement of the work vehicle to an implement tip of the implement based on first relational data in which a first posture parameter is associated with a second posture parameter, the first relational data representing an arm height that is a height of an arm distal end of an arm of the work vehicle with respect to a ground contact surface of a traveling device of the work vehicle, the second posture parameter representing the implement direction;

receiving a second instruction to change the arm height;

calculating from an output of an arm posture detection sensor configured to detect the arm height, the first posture parameter representing a start arm height, which is the arm height detected at reception of the second instruction that occurs after reception of the first instruction;

calculating from an output of an implement posture detection sensor configured to detect the implement direction after reception of the first instruction, the second posture parameter representing a start implement direction which is the implement direction detected at reception of the second instruction that occurs after reception of the first instruction;

acquiring a first reference parameter that is the second posture parameter associated with the first posture parameter representing the start arm height in first relational data;

controlling according to the second instruction, a second hydraulic cylinder configured to control the arm height;

obtaining a measurement value of the arm height from an output of an arm posture detection sensor configured to detect the arm height;

acquiring a second reference parameter that is the second posture parameter associated with the first posture parameter representing the measurement value in the first relational data;

determining a target direction that is a target of the implement direction when the arm height is the measurement value such that a difference between the second posture parameter representing the target direction and the second posture parameter representing the start implement direction is equal to a difference between the second reference parameter and the first reference parameter; and controlling a first hydraulic cylinder configured to control the implement direction such that the implement direction approaches the target direction.

21. A controller of a work vehicle, comprising:

a memory configured to store first relational data in which a first posture parameter is associated with a second posture parameter, the first posture parameter representing an arm height which is a height of an arm distal end of an arm of the work vehicle with respect to a ground contact surface of a traveling device of the work vehicle, the second posture parameter representing an implement direction from a joint of an implement of the work vehicle toward an implement tip of the implement; and a processor configured to receive from a first input device, a first instruction to perform implement posture electric control to control the implement direction based on the first relational data, receive from a second input device, a second instruction to change the arm height, calculate from an output of an arm posture detection sensor configured to detect the arm height, the first posture parameter that represents a start arm height, the start arm height being the arm height detected at reception of the second instruction that occurs after reception of the first instruction, calculate from an output of an implement posture detection sensor configured to detect the implement direction, the second posture parameter that represents a start implement direction, the start implement direction being the implement direction detected at reception of the second instruction that occurs after reception of the first instruction, acquire a first reference parameter that is the second posture parameter associated with the first posture parameter representing the start arm height in the first relational data, control a second hydraulic cylinder configured to control the arm height according to the second instruction, receive an output of an arm posture detection sensor configured to detect the arm height to obtain a measurement value of the arm height, acquire a second reference parameter that is the second posture parameter associated in the first relational data with the first posture parameter representing the measurement value, determine a target direction that is a target of the implement direction when the arm height is the measurement value such that a difference between the second posture parameter representing the target direction the second posture parameter representing the start implement direction is equal to a difference between the second reference parameter and the first reference parameter, and control a first hydraulic cylinder configured to control the implement direction such that the implement direction approaches the target direction.

* * * * *